US006071346A

United States Patent [19]

Yamauchi et al.

[11] Patent Number: 6,071,346

[45] Date of Patent: Jun. 6, 2000

[54] MULTI-COLOR SMALL AMOUNT PAINTING SYSTEM

[75] Inventors: Kazumasa Yamauchi, Fussa; Tohru Takeuchi, Yokohama; Noriyasu Yamaguchi, Okazaki; Shinji Toshimitsu, Nagoya; Takao Yamamoto; Shigeki Fujiwara, both of Toyota, all of Japan

[73] Assignees: Hino Jidosha Kogyo Kabushiki Kaisha, Tokyo; Kansai Paint Co., Ltd., Hyogo-ken; Trinity Industrial Corp., Tokyo, all of Japan

[21] Appl. No.: 09/087,634

[22] Filed: May 29, 1998

[30] Foreign Application Priority Data

May 30, 1997 [JP] Japan ..... 9-158153
Jun. 10, 1997 [JP] Japan ..... 9-168048

[51] Int. Cl.[7] ..... B05C 11/00

[52] U.S. Cl. ..... 118/668; 118/708; 118/302; 118/326

[58] Field of Search ..... 118/300, 302, 118/326, 668, 708

[56] References Cited

U.S. PATENT DOCUMENTS

| | | | |
|---|---|---|---|
| 5,392,992 | 2/1995 | Farnsteiner et al. | 239/296 |
| 5,496,123 | 3/1996 | Gaither | 401/176 |
| 5,552,189 | 9/1996 | Shaffer | 427/421 |

OTHER PUBLICATIONS

Multicolor Coating Device, 4–83549 (A) Mar. 17, 1992, JP, Appl. No. 2–194829, Jul. 25, 1990 Toyota Motor Corp, Masashi Murate, Int. Cl. B05B12/14.

Fixed Delivery Of Volatile Liquid, 4–83551 (A) , Mar. 17, 1882,P, Appl. No. 2–198715, Jul. 26, 1990, Mitsubishi Plastics Ind Ltd, Tadashi Hashimoto (1) , Int. C1. B05C5/00, B05C11/10.

Wetting Device For Nozzle Of Adhesive Distribution Apparatus, 4–83552 (A), Mar. 17, 1992, JP, Appl. No. 2–193870, Jul. 24, 1990, TDK Corp, Jun Tamashima (1), Int.Cl. B05C5/00,H05K3/34.

Multi–Color Small Amount Paint Supply System, Japanese Utility Model Examined Publication No. Hei 4–46846, Trinity Industrial Corporation.

Multi–Color Small Amount Paint Supply System, Japanese Utility Model Examined Publication No. Hei 4–46847, Trinity Industrial Corporation.

Multi–Color Small Amount Painting System, Japanese Patent Application No. Hei 9–158153, Hino Jidosha Kogyo Kabushiki Kaisha, Kansai Paint Co., Ltd., Trinity Industrial Corporation.

Small Amount Paint Feeding System, Japanese Patent Application No. Hei 9–1668048, Hino Jidosha Kogyo Kabushiki Kaisha, Kansai Paint Co., Ltd., Trinity Industrial Corporation.

Spray Coating Device, Japanese Patent Examined Publication No. Hei 7–34882, Some Societe Anonyme.

*Primary Examiner*—James Sells

*Attorney, Agent, or Firm*—Nath & Associates PLLC; Gary M. Nath; Gregory B. Kang

[57] ABSTRACT

A multi-color small amount painting system of the present invention stores small unit amounts of paint having a variety of paint colors and may selectively feed desired color paint to a painter of a painting robot or the like. The painting system stores the paint having a large number of paint colors in a stock unit in the form of paint cartridges. The paint cartridge of the paint color selected is picked up from the stock unit and carried by a carrier and is loaded on the painting robot or an automatic painting device. Subsequently, the paint within the paint cartridge loaded is fed to the painter of the painting robot or the automatic painting device by a paint feeding mechanism. In addition, the system ensure an advantage that the painting system is high in efficiency of painting work including the exchange of colors and is small in size as a whole.

16 Claims, 51 Drawing Sheets

MULTI-COLOR SMALL AMOUNT PAINTING SYSTEM

BACKGROUND OF THE INVENTION

1. Field of the Invention

The present invention relates to a multi-color small amount painting system, i.e., a painting system in which a variety of colors of paint may be stored in a small unit amount and a desired color of paint may be selectively fed out of them to a painter.

More specifically, the present invention relates to a multi-color small amount painting system in which a large number of different paint colors of paint are stored in the form of paint cartridges, a paint cartridge of the designated paint color is carried to be mounted on a painting robot or an automatic painting device and the paint within the cartridge is fed to its painter.

2. Description of the Related Art

For example, referring to Japanese Utility Model Examined Publication No. Hei 4-46846, Japanese Utility Model Examined Publication No. Hei 4-46847 or the like, in order to enhance the workability of the multi-color painting corresponding to the increased number of the kinds of paint color, there have conventionally been proposed and developed a variety of multi-color small amount paint feeding systems.

Then, in recent years, a painting robot has often been used to paint, for example, an automotive body. Thus, nowadays, there have been proposed some multi-color painting systems for selectively feeding several to ten and several kinds of paint to the painting robot.

For example, Japanese Patent Examined Publication No. He 7-34882 discloses a spray painter in which a plurality of feeding paths P1 to P3 of respective paint colors are provided to be introduced into a working area of a painting robot 14, bottle-shaped reservoirs 22 are connected at fixed positions of the respective feeding paths, the reservoirs are carried by the robot 14 and connected to a spray 20 within the robot by the operation of the robot 14, and the spray painting is carried out.

Also, Japanese Patent Unexamined Application 4-83549 Lt discloses a multi-color painting apparatus in which painting guns 35*a* to 35*n* for respective colors and painting intermediate tanks 21*a* to 21*n* are arranged to be connectable to or separatable from painting recirculation systems separated in accordance with a painting color in the vicinity of a painting robot 51, one or both of the painting gun and the painting intermediate tank is selectively mounted on the robot 51 by using a mounting robot 41, and paint is discharged by a constant flow rate regulator 61 to thereby make it possible to perform a selective multi-color painting operation.

However, the invention of the above-described spray painter suffers from the following problem. In general, the number of the kinds of paint color is limited to several kinds since the feeding paths of the respective paint colors have to be introduced into the working area of the painting robot. Accordingly, there is a certain limit for enhancing the versatility of the multi-color painting. In addition, in order to introduce the feeding paths of the respective paint colors a into the working area of the painting robot, a very large size equipment is required as a whole. Furthermore, since the exchange of the paint colors is performed by the painting robot itself, it is impossible to simultaneously perform the color exchange operation and the painting operation. In addition, since it is necessary to perform a cleaning operation of the interior of the tank 22 whenever the colors are changed, the working efficiency of the multi-color painting is remarkably degraded.

Also, the invention of the above-described multi-color painting apparatus improves the aspect of the efficiency of the painting operation with the above-described spray painter but still suffers from the following problem. The more versatile the color becomes by increasing the number of the paint color, the wider the working area of the mounting robot expands. This requirement increases the size of the equipment and causes the remarkable broadening of the painting work space, disadvantageously. Also, since the color recirculation system is provided for each painting color, the painting equipment as a whole becomes large in size.

Furthermore, the above-described conventional multi-color painting system is suitable for the case where a relatively large amount paint for one kind of color is to be selectively fed to the painting robot. However, recently, there is a strong demand that an individual consumer of an automotive vehicle may request to paint the automotive body in paint color which is decided by him or her. Thus, the development of the painting technology that may meet such a request is highly appreciated. Under the above-described circumstances, the number of the colors of the paint to be usable for the automotive body painting is increased up to several tens of colors or more. The multi-color painting is further accelerated. On the other hand, corresponding to this trend, the amount of the used paint of the respective paint colors is relatively decreased except for a large amount of paint such as white color paint. Accordingly, there has been a demand for developing a multi-color painting system in which such a large number of colors of paint may be selectively fed to a painting device such as a painting robot in a small unit amount. However, in any of the conventional multi-color painting systems which have been developed, it is impossible to satisfactorily meet this demand.

Also, in the case where the automatic painting operation is performed by using the painting robot or the automatic painting device, in order to perform the painting operation without fail and in a stable manner, in general, it is necessary to automatically control the injection or the spray of paint from the painter in a stable manner.

Accordingly, also in the above-described multi-color painting system, in the same manner, the discharge amount of paint from the painter has to be numerically determined, and in other words, it is necessary to make it possible to feed the paint from the painting cartridge to the painter in a stable manner.

SUMMARY OF THE INVENTION

Under such a background technology, an object of the present invention is to further improve the conventional multi-color painting technology.

A main object of the present invention is to provide a novel multi-color small amount painting system in which a large number of kinds of color paint may be stored in a small unit amount and a desired amount of paint may be selectively fed to a painter of a painting robot or an automatic painting device, in addition, the efficiency of the painting work as a whole including a color exchange is high and further the overall equipment is very small in size.

More specifically, an object of the present invention is to provide a multi-color small unit amount painting system in which paint cartridges which are filled with a relatively small amount of paint are stored in stock units for a large number of paint, at the same time, the selected paint cartridge is mounted from the stock device to the painting robot or the automatic painting device by using a carrier, then, the paint within the paint cartridge mounted thereon may be fed to the painter such as a painting robot by a paint feeding mechanism, and on the other hand, the used paint cartridge may be carried and returned back to the stock unit by the painting robot or the automatic painting device.

Also, on the other hand, the present invention relates to a variety of devices and mechanisms to be used in the above-described multi-color small amount painting system.

Namely, an object of the present invention is to provide a carrier which reciprocatingly carries the paint cartridge between the stock unit of the multi-color small amount painting system and the painting robot or the automatic painting device, and may effectively perform the mounting of the paint cartridge on the painting robot or the automatic painting device and the collection to the stock unit.

Also, another object of the present invention is to provide a paint feeding mechanism which may feed the paint within the paint cartridge loaded in the painting robot or the automatic painting device to the painter in an automatic manner and a stable manner and may automatically clean the paint feeding path.

Also, still another object of the present invention is to provide a stock device which may smoothly collect the paint cartridge that has been carried and returned by the painting robot or the automatic painting device without any risk of clogging in the stock device, and which is low in a fear that the paint cartridge and its collection mechanism would be damaged or deformed and which is superior in durability (such as the number of operations).

Another object of the present invention is to provide a control system for the multi-color small amount painting system, which may selects the paint cartridge of paint color to be painted, and which may perform, without fail, the automatic painting operation to a workpiece using the paint cartridge.

Other objects will be understood with reference to the following description of the specification, the description of appended claims and the accompanying drawings.

A painting system according to the present invention is a system in which a large number of paint colors are stored in the form of paint cartridges in a stock unit, the paint cartridge having a desired paint color is selectively picked up from the stock unit by using its carrier and mounted on a painting robot or an automatic painting device, and subsequently, the paint within the paint cartridge mounted thereon is fed to a painter of the painting robot or the automatic painting device by a paint feeding mechanism.

More specifically, according to the present invention, the present invention relates to a multi-color small amount painting system which may store small unit amounts of a variety of colors of paint and may selectively feed a desired paint color of paint to a painter, comprising:

a suitable number of paint cartridges filled with small amounts of a certain paint color, respectively;

a stock unit provided with an endless conveyor mechanism for holding the suitable number of paint cartridges for rotating and carrying the suitable number of paint cartridges of the desired paint color up to a pickup position;

one of a painting robot and an automatic painting device provided with a structure for mounting the paint cartridge;

a carrier for picking up the paint cartridge of the desired paint color from the stock unit and loading the paint cartridge of the desired paint color onto one of the painting robot and the automatic painting device; and a paint feeding mechanism which may be connected to the loaded paint cartridge and extruding the paint within the paint cartridge upon the connection to feed the paint to the painter of one of the painting robot and the automatic painting device.

The carrier according to a preferred embodiment to be applied to this multi-color small amount painting system may simultaneously perform the loading of the paint cartridge to the painting robot or the automatic painting device and the collection of the used paint cartridge to the stock unit with one operation of the two chuck means which may grip and release the paint cartridges and reciprocate together between the stock unit and the painting robot or the automatic painting device.

Accordingly, the present invention relates to a carrier for picking up a paint cartridge from the stock unit and loading it on one of a painting robot and an automatic painting device, and picking up a used paint cartridge from one of the painting robot and the automatic painting device and collecting it to the stock unit, comprising:

a carrier body;

a carrier member supported to be reciprocatingly movable over the stock unit and one of the painting robot and the automatic painting device relative to the carrier body;

first and second chuck means mounted together on the carrier member for gripping and releasing the paint cartridges by the operations of approach to or separation from the paint cartridge and opening and closing operations of chuck members;

a driver for reciprocating the carrier member and operating the first and second chuck means; and a controller for controlling a series of operations of the first chuck means casting the used paint cartridge to a collection port of the stock unit and the second chuck means picking up the desired paint cartridge from the stock unit when the carrier member is located on the stock unit side, the first chuck means picking up the used paint cartridge loaded on one of the painting robot and the automatic painting device therefrom when the carrier member is located on the side of one of the painting robot and the automatic painting device, and subsequently, the second chuck means loading the desired paint cartridge on one of the painting robot and the automatic painting device.

Also, the above described multi-color small amount painting system proposed by the present inventor is such that the paint cartridge of certain paint color is loaded on the painting robot or the automatic painting device, then after the painting of the paint color has been completed, the used paint cartridge is collected, subsequently, a new paint cartridge of different paint color is loaded on the painting robot or the automatic painting device to paint with the paint color. And those sequential operations are repeated. Accordingly, in the present painting system, not only the paint within the paint cartridge must be fed to the painting robot or the automatic painting device but also must the cleaning of the paint flow path be performed by thinner and air during the exchange of the paint cartridges (color change).

Accordingly, the present inventors has invented the paint feeding mechanism which may be satisfactorily applied to the above-described multi-color small amount painting system to meet this requirement. Namely, also, the present invention relates to a paint feeding mechanism for feeding paint contained in a paint cartridge loaded on one of a painting robot and an automatic painting device to a painter, comprising:

a fixing means for fixing and holding the paint cartridge to the loading position within one of the painting robot and the automatic painting device;

a paint connector provided on a paint outlet side of the paint cartridge continuous to the painter through a predetermined paint flow path;

an extruder means for stably extruding the paint contained in the paint cartridge from its outlet portion to the outside;

a cleansing connector provided in the vicinity of the loading position for feeding cleaning thinner and air; and a painting/cleaning joint means provided in cooperation with the paint connector for moving the paint connector to engage with and disengage from the outlet portion of the paint cartridge, making it possible to connect the paint cartridge to the painter, displacing the paint connector to engage with and disengage from the cleaning connector, and making it possible to feed the thinner and air from the interior of the paint connector to the paint flow path.

Also, the present invention relates to a stock unit for storing a number of paint cartridges having a number of paint colors, rotating and carrying a selected paint cartridge out of the number of paint cartridges up to a pickup position by a carrier, an endless conveyor mechanism disposed for rotating and carrying the paint cartridge through a loading position and a pickup position;

a suitable number of retaining means assembled into the endless conveyor mechanism for retaining each paint cartridge to be detachable, respectively; and a controller for operating a driver for the endless conveyor mechanism on the basis of detected information and inputs of the loaded paint cartridge for rotating and carrying the selected paint cartridge up to the pickup position by the carrier.

The more preferable embodiment of the present invention relates to the stock unit, structurized such that the retaining means comprises: a receiver frame for receiving the paint cartridge; a pair of right and left retainer arms supported to be rotatable about each bent portion on the outside of the receiver frame; and a spring means for biasing the right and left retainer arms inwardly so as to grip the paint cartridge; wherein when each arm portion of the right and left retainer arms is pressed and widened outwardly, the other arm portions push upwardly the paint cartridge loaded in the receiver frame so that the paint cartridge may be picked up by the carrier from the stock unit.

Also, in the more preferable embodiment of the present invention, a mechanism for collecting a used paint cartridge that has been carried back from the painting robot or the automatic painting device by the carrier is further provided for the stock unit. In the mechanism for collecting the cylindrical used paint cartridge, in order to more suppress a damage and a deformation of the paint cartridge and to increase the reusable number of the cartridge, it is more preferable that a suitable number of cartridge receiver members (for example, substantially U-shaped bent receiver bars) are arranged so as to face each other in the vertical direction alternatively on right and left sides in a obliquely downward posture, and forms a collection passage through which the paint cartridge is slidingly dropped in a zigzag manner between the cartridge receiver members from a casting port located on an upper side, and a shock absorber, more preferably a synthetic resin or a rubber material having a Shore hardness of 50 to 60, is provided in each of the cartridge receiver members at a position where the dropping paint cartridge collides.

Also, the present inventors has invented a controlling system suitably fitting the above-described multi-color small amount painting system. Accordingly, the present invention relates to, in a painting system composed of a stock unit into which means for retaining detachably the paint cartridges are assembled and provided with an endless conveyor mechanism disposed for storing, rotating and carrying the paint cartridges having the large number of different paint colors, a carrier for picking up and carrying a paint cartridge from the stock unit and loading it on one of a painting robot and an automatic painting device, and a mechanism for extruding and feeding paint contained in the paint cartridge loaded to a painter, a control system provided with:

information recording medium added to each of the paint cartridges and/or the above-described retaining means for representing painting information such as the paint color needed for the automatic painting;

readout means added to the endless conveyor mechanism of the stock unit for reading out optically, magnetically or through a wireless communication the painting information from the information recording medium for each loaded paint cartridge; and a total controller for controlling the respective operations of the stock unit, the carrier and one of the painting robot and the automatic painting device on the basis of the readout painting information and performing the automatic painting selectively using the paint cartridge of the paint color to be painted to an individual workpiece.

DESCRIPTION OF THE PREFERRED EMBODIMENTS

Figure 1:
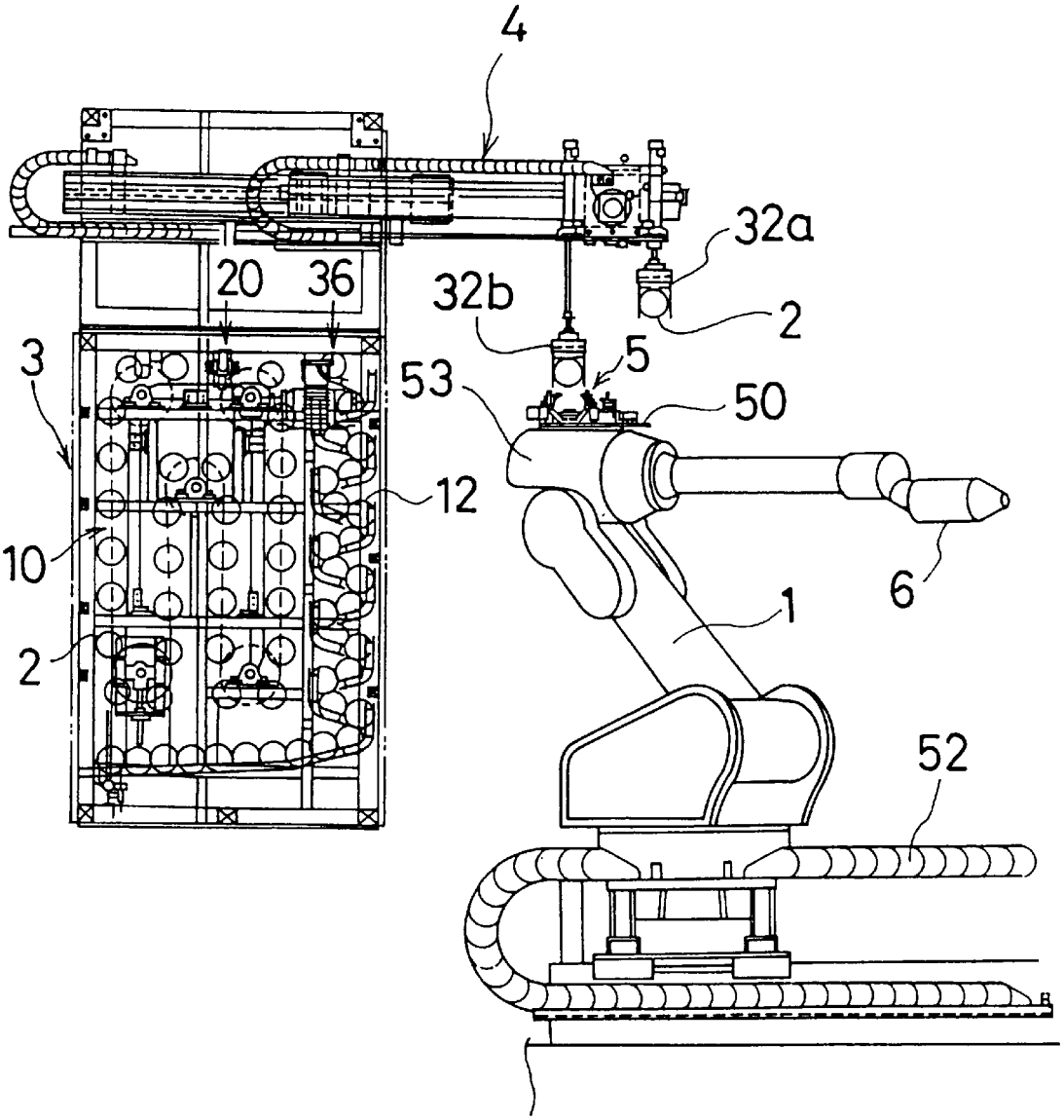
FIG. 1 is an overall view showing a multi-color small amount painting system in accordance with a first embodiment of the present invention.

A multi-color small amount painting system according to the present invention is a painting system which stores a variety kinds of paint in a small unit amount and may selectively feed the desired paint out of them to a painter and is composed of a paint cartridge, a stock unit, a painting robot or an automatic painting device, a carrier and a paint feeding mechanism.

The paint cartridge is a double wall structure container in which a relatively small amount of paint is filled. For example, sleeve-like paint bags (made of synthetic resin) may be replaced in the substantially cylindrical cartridge body made of metal or plastic. The paint cartridge has an outlet portion on its tip end side and is structured so that, when an external pressure is applied, for example, when air is pressurized and introduced into the cartridge, the paint bag within the cartridge is crashed, the paint is discharged from the outlet portion of the cartridge to the outside from its outlet portion.

A small amount of paint of each special paint color (special color (such as a moss green color) which is desired by an individual consumer of the automotive vehicle) is filled in the paint cartridge. In the painting system according to the present invention, usually, a suitable number (about 20 to 100) of paint cartridges are provided.

The stock unit is a unit for storing the paint of the large number (for example, 20 to 100 kinds) of the paint colors in the form of the paint cartridges and agitating the paint contained in the paint cartridge. As described later, it is possible to pick up the paint cartridge of the desired color and to exchange a new paint cartridge for the old one. Furthermore, more preferably the collection of the used paint cartridge returned back by the carrier is possible.

The stock unit is provided as the basic structure with an endless conveyor mechanism disposed for rotating and carrying the paint cartridge through a loading position and a pickup position;

a suitable number of retaining means assembled into the endless conveyor mechanism for retaining each paint cartridge to be detachable; and a controller for operating a driver for the endless conveyor mechanism on the basis of the address information of the loaded paint cartridge, or on the basis of the kind information of the paint cartridge detected optically for rotating and carrying the desired paint cartridge up to the pickup position by the carrier. Incidentally, it is possible to attain the more exact control with a structure for detecting when the paint cartridge is stopped at the original position and calculating the carrying and rotation amount on the paint cartridge by using a micro switch or the like.

With such an arrangement, the present device stores a large number of paint cartridges of paint colors and may selectively rotate and carry the desired paint cartridge to the pickup position for the pickup by the carrier. Furthermore, since the stock device carries the stored paint cartridge rotating axially, the paint within the paint cartridge is agitated so that the paint may be more homogeneously mixed during the rotation and carrying.

The endless conveyor mechanism is a conveyor mechanism having an endless conveyor path and may rotate and carry the paint cartridges along the path and is composed of, for example, an endless chain conveyor mechanism. The conveyor mechanism has a recirculation path passing through the loading position of the paint cartridge and the pickup position of the paint cartridge. the loading position of the paint cartridge is provided at, for example, a lower portion of the stock unit, and the pickup position of the paint cartridge is provided at, for example, an upper surface of the stock unit.

The retaining means is a means for detachably retain the respective paint cartridges and is assembled into the above-described endless conveyor mechanism. The retaining means are provided corresponding to the large number (for example, about 20 to 100) of the paint cartridges of the paint colors to be stored in the stock unit.

The retaining means must be means for positively holding the paint cartridges not only in the non-operation of the stock unit but also in the operation of the endless conveyor mechanism, i.e., during the rotation and carrying of the paint cartridge along the endless conveyor path. Also, at the same time, the retaining means must have a structure in which the paint cartridge may be picked up by the clamping operation of the chuck means of the carrier to be described later. Furthermore, the retaining means must have a structure in which the paint cartridge may readily be loaded thereinto.

In view of this point, more preferably, the retaining means may comprise: a receiver frame for receiving the paint cartridge; a pair of right and left bent retainer arms supported to be rotatable about each bent portion on the outside of the receiver frame; and a spring means for biasing the right and left retainer arms inwardly so as to grip the paint cartridge; wherein when each arm portion of the right and left retainer arms is pressed and widened outwardly, the other arm portions push upwardly the paint cartridge loaded in the receiver frame so that the paint cartridge may be picked up by the carrier. Most preferably, the retaining means are structured in a toggle mechanism as described below.

The receiver frame is a frame which receives the paint cartridge and may contain the paint cartridge. The shape and structure thereof are not limited to specific ones but must firmly hold the paint cartridge received therein. For example, if the paint cartridge is a cylindrical cartridge, when the paint cartridge is received in the receiver frame, a plurality of frame rods are provided so as to stably hold the paint cartridge in contact with suitable portions of the tip face, the rear end face or the outer circumferential surface thereof.

The retainer arms are a pair of right and left bent arms mounted on the outside of the receiver frame and supported rotatably about the bent portions.

The spring means is at least a spring means (for example, a coil spring) for biasing the right and left retainer arms inwardly. The retainer arms press the paint cartridge loaded in the receiver frame by the biasing force so that the paint cartridge is gripped in the receiver frame.

Most preferably, the retaining means is provided with a mechanism (so-called toggle mechanism) in which the right and left arms are biased inwardly when the first portions of the holding arms are slanted inwardly beyond a certain posture (for example, an upright posture), whereas the right and left arms are biased outwardly when the first portions of the retainer arms are slanted outwardly beyond the certain posture.

Accordingly, in the more preferable embodiment, the right and left retainer arms are pressed and rotated outwardly, respectively, when the first arm portions of the right and left arms are slanted outwardly from the certain posture, and the right and left retainer arms are strongly rotated outwardly by the outward working force of the spring means whereby the other arm portions of the right and left retainer arms push the paint cartridge, loaded in the frame, outwardly from the receiving frame. Accordingly, it is possible to readily pick up the paint cartridge by the carrier.

Also, in the above-described embodiment, thereafter, the right and left retainer arms are kept under the condition that they are pressed and widened outwardly. Thus, when the paint cartridge is loaded in the receiver frame, the loaded paint cartridge pushes and rotates the second arm portions of the right and left retainer arms. Then, when the right and left first arm portions are slanted inwardly, the right and left retainer arms are strongly rotated inwardly by the inward working force of the spring means whereby the first arm portion of the right and left retainer arms push the loaded paint cartridge in the receiver frame so that the paint cartridge is firmly gripped within the receiver frame. Accordingly, it is possible to readily load the paint cartridge and to stably hold the paint cartridge in the receiver frame.

Accordingly, more preferably, in the present stock unit, the chuck means grips the paint cartridges and at the same time, for example, the widening members of the chuck means are in contact with, for example, pins of the first arm portions of the retainer arms. Under this condition, the right and left first arm portions are pressed and rotated outwardly, respectively. When the first arm portions of the right and left retainer arms are slanted outwardly from a predetermined posture, the second arm portions of the right and left retainer arms push outwardly the paint cartridge loaded into the receiver frame, respectively (for example, push upwardly). As a result, the paint cartridge is readily gripped and carried by the above-described chuck means and may readily be picked up by the carrier.

The controller for the stock unit operates the driver of the endless conveyor mechanism to perform the control operation of rotating and carrying the desired paint cartridge to the pickup position where the cartridge is picked up by the carrier. The operation is performed on the basis of the address information of the paint cartridge loaded or the kind information of the paint cartridge detected by the sensor.

In the case where the control operation is performed on the basis of the address information, a device which may calculate the position of the loaded paint cartridge within the endless conveyor path on the basis of the drive amount of the endless conveyor mechanism is used. Then, when each paint cartridge is loaded in the loading position, the address of the paint cartridge is inputted into the controller by the automatic readout or the manual input. As a result, the controller calculates how the paint cartridges recirculated in the endless conveyor path are arranged in an address order, and furthermore, on the basis of thus calculated address information calculates the necessary amount for rotating and carrying the paint cartridge to be picked up to the pickup position. Then, the endless conveyor mechanism is driven by the necessary amount of rotation and carrying whereby the paint cartridge to be picked up is rotated and carried up to the pickup position.

Also, in the case where the control operation is performed on the basis of kind information, for example, paint cartridges to which identifier marks are added in advance for each paint color are prepared. Those are loaded in the stock unit, and the readout means which may optically read out the information of each paint color represented by the identifier mark is disposed at or in the vicinity of the pickup position of the paint cartridge. Then, out of the group of the paint cartridges rotated and carried, the sensor detects and identifies the paint cartridge to be picked up. Subsequently, the paint cartridge to be picked up is stopped at the pickup position on the basis of the kind information.

Also, it is possible to perform another control operation on the basis of kind information. For example, an identifier mark representative of an address is added to each retaining means within the stock unit, and a paint cartridge to which the identifier mark (for example, bar code mark) is added in advance is prepared for each paint color. A readout means (for example, bar code reader) which may optically read out the information of the paint color and the address represented by the identifier mark is disposed at a predetermined position within the stock unit. The paint cartridge to be picked up is rotated and carried to the pickup position and stopped thereat on the basis of the information of the paint color and the address read out for each loaded paint cartridge.

As described above, the present stock unit may continue to rotate and carry the large number of cartridges having the paint colors while holding them to the respective retaining means along the constant recirculation path by the endless conveyor mechanism while rotating the paint cartridges about the axial direction of each cartridge. Accordingly, in the present painting system, the paint within the paint cartridge is continued to be agitated also during its storage by the operation of the stock unit, so that the stagnation of the paint is prevented.

In addition, by using the retaining means composed of the above-described receiver frame, the retainer arms and the spring means, it is possible to always positively hold the paint cartridge not only in the non-operation of the stock unit but also during the rotational carrying of the paint cartridges in driving the endless conveyor mechanism. Furthermore, it is possible to readily pick up the paint cartridge from the stock unit by the carrier. Moreover, it is possible to readily load the paint cartridge to the stock unit.

Also, the cartridge receiver members of the collection mechanism are arranged vertically alternatively right and left in an oblique downward posture. The number of the cartridge receiver members is determined by the scale of the stock unit but is usually about 10 to about 20.

The structure of the cartridge receiver members is not limited to a special one. However, in the more preferable form, the right and left cartridge receiver members are substantially U-shaped bent receiver bars and are arranged alternatively vertically in the oblique downward posture with central side portions of the receiver bars being substantially in parallel.

Then, with such an arrangement, a collection path in which the paint cartridge is slidingly dropped in a zigzag manner between the right and left cartridge receiver members from an upper casting port (inlet for collecting the paint cartridges).

When the paint cartridge is slidingly dropped in the collection path, the paint cartridge is subjected to the reactive force upon the collision with the right and left cartridge receivers. In the case where the paint cartridge is in the form of a cylinder, the outer circumferential surface hereof is collided against the right and left cartridge receiver members and receives the repulsive force. Accordingly, in the present collection mechanism, in order to moderate this repulsive force, shock absorbers are provided at a position where the dropping paint cartridge is collided.

According to the knowledge of the present inventors, it is preferable that the shock absorbers are made of synthetic resin (in particular, polyvinylchloride resin) or rubber material having a Shore hardness of 50 to 60 as the most effective material.

Also, the present inventors have found out the fact that, in the case where the right and left cartridge receiver members are the substantially U-shaped bent receiver bars arranged as described above, if cover members (particularly, polyvinylchloride pipe member having the Shore hardness of 50 to 60) for covering the receiver bars are used and are provided with both end portions of the central side portions of the receiver bars and both side portions continuous thereto (namely, the cover members are not provided for the central portions of the central side portions), the repulsive force is most effectively moderated when the cylindrical paint cartridge is dropped and collides against the receiver bars, whereby the cartridge may be collected most smoothly.

Accordingly, the subject matter of the present invention is also related to the stock unit wherein each of the right and left cartridge receiver members is composed of a substantially U-shaped bent receiver bar, central side portions of the receiver bars are arranged substantially in parallel, and the shock absorbers are made of cover members for covering the receiver bars and are provided at both end portion of the central side portion of each receiver bar and both side portions continuous with the both end portions.

Incidentally, there is a fear that in a long term use, the paint cartridge would be damaged or deformed by the repeated collision with the cartridge receiver members. Accordingly, more preferably, jump preventing members such as bar members that may suppress the jump and may abut against the outer circumferential surface of both end sides of the actually jumping cylindrical paint cartridge are provided in the collection mechanism according to the present invention.

With the above-described collection mechanism, it is possible to collect the used paint cartridge smoothly without the clogging condition in the stock unit. There is a low possibility that the paint cartridge would be damaged or deformed in the collection process. Accordingly, it is possible to obtain the large usable number of operations for the paint cartridge. The durability is considerably improved.

Also, the multi-color small amount painting system according to the present invention is provided with the painting robot and/or the automatic painting device.

The structure of the painting robot and the automatic painting device is not limited to a special one. The painting robot and/or the automatic painting device employed has a structure in which the paint cartridge may be loaded at, for example, a head of the painting robot (i.e. the tip portion of the first arm or the rear end portions of the second arm.), and at the same time, the loaded paint cartridge may be connected to a painter (for example, bell type static electric painter) of the painting robot and/or the automatic painting device through the paint flow path. In general, a paint color changing unit (CCV), a flow rate regulator means (gear pump) and a dump valve for discharging the internal liquid are connected in the paint flow path up to the painter. Also, a feed source of the cleaning thinner and air is connected through the thinner valve and the air valve for cleaning the flow path. The other structure of the painting robot and the automatic painting device, for example, the mechanism for operation of the rotation, deflection and the like of the robot arms is not limited to a special one.

Incidentally, the paint feeding mechanism used in the invention is provided at the head portion of the painting robot and the automatic painting device, that is, around the loading position of the paint cartridge.

The carrier is a device which may reciprocatingly carry the paint cartridge between the stock unit and the painting robot and/or the automatic painting device while supporting (suspending) the paint cartridge, which may pick up the selected paint color cartridge from the stock unit and load the cartridge to the painting robot and/or the automatic painting device, and which may, more preferably, collect the used paint cartridge out of the painting robot and/or the automatic painting device to the stock unit, and in general is provided with a mechanism for reciprocatingly carrying the paint cartridge between the stock unit and the painting robot and/or the automatic painting device and a chuck means which may grip and release the paint cartridge.

Incidentally, the carrier according to the present invention includes both a carrier robot that has a high degree of freedom with respect to the operation of carrying and may change as desired the locus for carrying the paint cartridge and an automatic carrier device which has lower degree of freedom with respect to the operation of carrying and which has a predetermined locus for carrying the paint cartridge.

In a more preferable carrier, two chuck means which are moved together are provided. By the two chuck means, on the stock unit side, the paint cartridge of the paint color to be painted is picked up and the used paint cartridge is cast in the collection port. On the other hand, on the side of the painting robot and/or the automatic painting device, the paint cartridge of the paint color to be painted is loaded and the used paint cartridge is picked up.

For example, the carrier is composed of a carrier member, two chuck means, a driver and a controller in addition to the device body. The carrier, particularly, the body is located in the vicinity of the stock unit of the paint cartridge and the painting robot and/or the automatic painting device, for example, over or on the side of these units.

The carrier member is a jig or structural member supported to be reciprocatingly movable over the stock unit and the painting robot and/or the automatic painting device relative to the device body, for example, to be reciprocatingly slidable along guide rails laid on the device body.

The two chuck means are mounted together on the above-described carrier member. Then, the chuck means are provided with the mechanism for opening/closing the pair of chucks and a mechanism for causing the pair of chucks to be close to the paint cartridge and to be separated away from the paint cartridge when the carrier member is located on the stock unit side, and for causing the pair of chucks to be close to the loaded paint cartridge and to be separated away from the paint cartridge when the carrier member is located on the side of the painting robot and/or the automatic painting device, and may respectively grip and release the paint cartridges by those operations. For instance, in the case where the carrier is located above the stock unit and the painting robot or the like, the mechanism for approaching to and separating from the paint cartridge is a mechanism for moving the pair of chucks up and down toward the paint cartridge within the stock unit and toward the paint cartridge loaded on the painting robot or the like.

The driver is a driving means for performing the reciprocating motion of the above-described carrier member and the operation of the two chuck means and is not always a one-piece device. For instance, it is composed, in combination, of a convey mechanism for reciprocating the carrier member, a motor in device (preferably, explosion preventing AC servo motor) for moving the pair of chucks up and down, and a cylinder assembly for opening/closing the pair of chucks.

As described above, with the two chuck means respectively gripping the paint cartridge, the paint cartridge is carried between the stock unit and, the painting robot and/or the automatic painting device by the reciprocation of the carrier member while gripping the paint cartridge, and thereafter the paint cartridge may be released as desired.

The controller for the carrier is a device for controlling the overall various operation such as reciprocation of the career member and opening/closing operation of the two chuck means. More preferably, the device controls a series of operations of causing a first chuck means, which has carries the used paint cartridge, to approach the collection port (cast port for collecting the paint cartridge) when the carrier member is located on the stock unit, subsequently to release the used paint cartridge to cast it to the collection port of the stock unit, and causing the second chuck means to approach the pickup position within the stock unit, subsequently to grip the paint cartridge of the paint color to be painted next which has been carried in advance to the pickup position, and causing the first chuck means to approach the loading portion (the position where the paint cartridge is loaded) of the painting robot and/or the automatic painting device when the carrier member is located on the side of the painting robot and/or the automatic painting device to grip and pick up the used paint cartridge which has been already loaded out of the painting robot and/or the automatic painting device, and subsequently causing the second chuck means that has carried the paint cartridge of the paint color necessary next to approach the loading portion of the painting robot and/or the automatic painting device to release the paint cartridge to load it on the painting robot and/or the automatic painting device.

With such a series of operations, i.e., with the single reciprocating motion with the two chuck means moving together, the loading of the paint cartridge of the paint color to be painted from the stock unit to the painting robot and/or the automatic painting device and the collection of the used paint cartridge from the painting robot and/or the automatic painting device to the stock unit may be simultaneously performed. Accordingly, the loading of the paint cartridge to the painting robot or the like and the collection of the paint cartridge to the stock unit may be very effectively performed.

Finally, the paint feeding mechanism is provided with the paint flow path from the loading portion of the paint cartridge continuous to the painter in the painting robot and/or the automatic painting device. Then, for example, by the operation of the air cylinder assembly, the paint feeding mechanism may be connected to the paint cartridge loaded on the loading portion (namely, the paint cartridge may be connected to the paint flow path). Then, upon the connection, for example, pressurized air is injected into the paint cartridge so that the paint bag in the interior is crashed to thereby extrude the paint within the paint cartridge to the outside to make it possible to feed the paint through the above-described paint flow path to the painter.

The present feeding mechanism is composed of the fixing means of the paint cartridge, the paint connector, the extruder means, the cleaning connector and the joint means for painting and cleaning. These means and components are provided together at, for example, the head portion of the painting robot, namely, at tip portions of the first arms or rear end portions of the second arms, more preferably, on a single base plate.

The fixing means is a means for fixing and holding the paint cartridge to a loading position within the painting robot and/or the automatic painting device. The loading position is a position determined so that the paint cartridge is loaded on the head portion or the like of the painting robot.

The fixing means should be a means that may always positively hold the paint cartridge whenever the paint cartridge is loaded on the painting robot and/or the automatic painting device, and at the same time, should be a structure in which the paint cartridge may readily be detached by, for example, the gripping operation of the chuck means of the carrier.

In view of this, the fixing means is composed, for example, of a certain number of fixing arms supported to be rotatable around the loaded paint cartridge and an air cylinder assembly for rotating these fixing arms so that the paint cartridge is depressed. Instead of the air cylinder assembly, it is possible to use a spring means for biasing the fixing arms so that the paint cartridge may be fixed. Furthermore, it is possible to provide a fixed receiver frame for receiving the paint cartridge in the loading position.

The paint connector is provided on the outlet portion (tip side) of the loaded paint cartridge so that the passage on the outlet portion is continuous to the painter of the painting robot and/or the automatic painting device through a predetermined paint flow path.

Then, more preferably, when the paint connector is connected to the outlet portion of the paint cartridge, in view of preventing the leakage of the paint, the outlet portion of the paint cartridge has a structure as a male engagement and the paint connector has a structure as a female engagement.

Also, more preferably, when the paint connector is connected to the cleaning connector, in view of obtaining a complete cleaning of the paint connector, the paint connector has a structure as a male engagement and the cleaning connector has a structure as a female engagement.

The extruder means is a means for crashing the paint bag contained in the paint cartridge into which, for example, pressurized air is injected, to thereby stably extrude the paint within the paint cartridge from its outlet portion to the outside.

Here, the term "stably" means that it is possible to perform the stable control with respect to the amount of paint to flow out of the outlet portion of the paint cartridge. For example, it means the case where the flow rate of the paint flowing from the outlet portion of the paint cartridge may be adjusted by the magnitude of the pressure of the air to be injected into the paint cartridge. Accordingly, the mechanism and means for instantaneously discharging the paint within the cartridge are excluded from the extruder means of the present invention. Incidentally, the easier and more accurate the above-described stable control is, the more preferable the result will become.

The extruder means is for example a combination of the air connector for feeding the pressurized air and the air cylinder assembly which moves the air connector for being coupled with the air inlet port of the paint cartridge. The mounting position of the air inlet port is not limited to a special one but in general, the inlet port is provided on the opposite side to the outlet portion of the paint cartridge.

Also, the extruder means may be a mechanism which may pressingly insert, for example, a plunger into the interior of the paint cartridge and crash the paint bag of the paint cartridge from its end side.

The cleaning connector is a member for feeding the cleaning thinner and air, which is disposed in the vicinity of the loading position of the paint cartridge, preferably, in parallel with the loaded paint cartridge. The cleaning connector has a structure that may be connected to the above-described paint connector, preferably, a female structure.

The joint means for painting/cleaning is provided in cooperation with the painting connector and is a means for moving (approaching/separating) the paint connector relative to the paint cartridge and coupling the paint connector with the outlet portion of the paint cartridge and disengaging the coupling, and also is a means for displacing the paint connector and moving the paint connector to approach to and separate from the cleaning connector to engage and disengage the cleaning connector.

Namely, the paint cartridge may be connected to the painter by the engagement and disengagement between the paint connector and the outlet portion of the paint cartridge. also, the cleaning thinner and air may be fed, respectively, to the paint flow path from the interior of the paint connector by the engagement and disengagement between the paint connector and the cleaning connector.

The joint means is composed, for example in combination, of the air cylinder assembly for the engagement and disengagement between the paint connector and the outlet portion of the paint cartridge and the cleaning connector, and the air cylinder assembly for operating the displacement of the paint connector. Instead of the air cylinder assembly, it is possible to use a device for performing such an operation with an electromagnetic working force.

Accordingly, with such a mechanism, in the painting robot and/or automatic painting device, the paint within the loaded paint cartridge may be fed in a stable manner automatically to the painter, and the paint feeding path may be automatically cleaned.

As described above, in the multi-color small amount painting system according to the present invention, the paint having a large number of paint colors may be stored in the stock unit in the form of paint cartridges, then, the paint cartridge of the selected paint color is picked up and carried the stock unit by using the carrier, the cartridge is loaded on the painting robot and/or the automatic painting device, and thereafter, the paint within the loaded paint cartridge is extruded to the outside by the paint feeding mechanism and is fed to the painter of the painting robot and/or the automatic painting device.

Accordingly, by using the present painting system, the paint having a large number (for example, about 20 to about 100) of paint colors is stored in a small unit amount for each color, and at the same time, the paint of the desired paint color out of a group of the paint colors is selectively fed to the painter of the painting robot and/or the automatic painting device to thereby perform the painting.

In addition, in the painting system according to the present invention, during the performance of the automatic painting in the painting robot and/or the automatic painting device, the paint cartridge of the paint color to be painted next is picked up from the stock unit and is carried close to the painting robot and/or the automatic painting device. Thus, the preparation before the loading may be performed. In addition, in the present system, a time for cleaning the interior of the paint cartridge at the site after the use of the paint cartridge may be saved, and the used paint cartridge is collected directly to the stock unit. Accordingly, the efficiency of the painting work as a whole including the color exchange is very high.

Furthermore, in the painting system according to the present invention, it is unnecessary to provide the paint recirculation system (i.e., a large number of paint recirculation paths in parallel) for each paint color. In addition, a structure for providing individually and independently small amount paint tanks for respective paint colors is not present in the working area of the painting robot and/or the automatic painting device. In other words, in the painting system according to the present invention, it is sufficient to provide only the relatively small size stock unit and carrier. This is advantageous in space saving. Accordingly, this system may contribute to the miniaturization of the overall painting equipment.

Also, furthermore, in the painting system according to the present invention, the paint cartridge in the stock unit is rotated and carried so that the more homogeneously mixed paint is fed to the painter to be used for painting and the paint of the large number of paint colors may be stably stored for a long period of time.

In the control system used in the present invention, the information recording medium is added to each paint cartridge or the like, the painting information needed for the automatic painting such as a paint color represented by the mark is read out by a readout means within the stock unit, and then, the running operation of the multi-color small amount painting system is controlled on the basis of the read-out painting information, so that the automatic painting using the paint cartridge of the predetermined paint color may be effected without fail to the individual workpiece.

The total controller provided in the present control system performs the control operations of operating the driver of the above-described endless conveyor mechanism for the stock unit to thereby selecting the desired paint cartridge (the paint cartridge of the paint color being used next) out of the group of the large number of paint cartridges stored, rotating and carrying the cartridge accurately to the pickup position by the carrier and performing the preparation for the pickup by the carrier.

Also, the total controller controls the overall operation for the carrier. Among others, the total controller controls a series of operations of causing a first chuck means, to approach the collection port within the stock unit when the carrier member is located on the stock unit side, subsequently to release the used and carried paint cartridge to cast it to the collection port of the stock unit, and at the same time, causing the second chuck means to approach the pickup position within the stock unit, subsequently to grip and pick up the paint cartridge of the paint color to be painted next out of the stock unit, and also causing the first chuck means to approach the loading portion of the painting robot and/or the automatic painting device when the carrier member is located on the side of the painting robot and/or the automatic painting device to grip and pick up the used paint cartridge out of the painting robot and/or the automatic painting device, and subsequently causing the second chuck means that has carried the paint cartridge to approach the loading portion of the painting robot and/or the automatic painting device to release the carried paint cartridge to load it on the painting robot and/or the automatic painting device.

Also, the total controller performs the control of the operation of the entire robot for the painting robot, particularly, the control of the operation of the paint feeding mechanism.

The present control system is composed of the readout means and the total controller.

The readout means is a means which may read out, optically, magnetically or in a wireless communication, painting information needed for the automatic painting such as a paint color from the information recording medium. For example, when the information recording medium is a bar code mark, the bar code reader corresponds to this means.

The readout means is added to the endless conveyor mechanism of the stock unit, and for example, it is disposed at a position to face the paint cartridge rotated and carried by the conveyor mechanism along the conveyor path of the endless conveyor mechanism.

Accordingly, the readout means may read out the painting information represented in the information recording medium for each loaded paint cartridge.

In addition to the above-described bar code reader, a magnetic stripe reader, an IC card readout device, an OCR device or the like may be used as the readout means.

The information recording medium is a recording medium representing the painting information needed for the automatic painting, is added to an outer surface (for example, a circumferential surface) of each paint cartridge, and is added to each retaining means, for example, a retainer frame for representing an address of the loaded paint cartridge if necessary.

The information recording medium is a recording medium in which the painting information is binary coded or the painting information may be stored in an installed memory or the like, or the information may be mechanically read out in an optical manner, in a magnetic manner or in a wireless communication. For example, a bar code mark, a cutaway mark or the like may be used as the information recording medium which may be optically mechanically read out. For example, a magnetic stripe or the like may be used as the information recording medium which may be magnetically mechanically read out. For example, an IC card (for example, an IC chip embedded in a plastic card body) or the like may be used as the information recording medium that may be mechanically read out in the wireless communication. The IC card used in the present invention is provided with a memory function (ROM function or RAM function). In addition to this memory function, the IC card provided with a calculation function may be used.

Then, in addition to the kind of the paint color of the paint to be filled in the paint cartridge, the painting information includes a date when the paint cartridge is loaded in the stock unit, a kind of the workpiece to be painted, painting data for determining a range, a condition and an order of the workpiece. Among the information, any combination for one group of painting information may be selected as desired.

The information of a kind of color of the paint is needed for making it possible to select a desired paint color. For example, this is determined by a model number of paint product, a tone of used paint, a brightness thereof, a color saturation thereof and a distinction between metallic paint and non-metallic paint.

The information of date is needed for selecting for use of the older paint cartridge out of the cartridges having the same color, namely, for shortening the storage period of the paint cartridge in the stock unit. Instead of the loading date of the paint cartridge to the stock unit, it is possible to perform the control of the use order or the use expiration of the paint cartridges on the basis of the adjustment date of the paint in the cartridge or the production date of the paint cartridge.

Furthermore, the information of the kind of the workpiece and the information of the paint data are needed for the automatic painting operation by the painting robot to take the suitable correspondence with the respective parameters for the individual workpiece to be painted. This is used to determine, with respect to a kind of each workpiece to be subjected to the painting and each workpiece, a range of the outer surface thereof to be painted, a condition of painting (for example, an applied voltage of the painter (in case of the static electric painter), paint flow rate to the painter (the air pressure of the pattern air, spray air), and an order of painting (for example, insertion direction of the painter to the workpiece).

The total controller is a device for performing the operational control for each of the stock unit, the carrier and the painting robot, is connected to the above-described readout means and operates in cooperation with the readout means. Namely, the total controller controls the running operation of each of the stock unit, the carrier and the painting robot on the basis of the painting information read out by the readout means. Furthermore, the automatic painting selectively using the paint cartridge of the paint color to be used to the individual workpiece is performed in correspondence with the various parameters of each workpiece.

For instance, in the present system, when the bar code mark representative of the address is added to each retaining means within the stock unit and the bar code reader is additionally provided to the endless conveyor mechanism of the stock unit, in the stage of painting, the operator suitably loads into the stock unit the paint cartridge to which the bar code mark representing the paint color, the date, the paint data and the like are added so that the large number of the paint cartridges to which the respective bar code marks are added are always stored in the stock unit.

Otherwise, if the present system relates to the system in which the IC card readout device, in particular, the transmitter/receiver is provided in the endless conveyor mechanism of the stock unit, in the stage of painting, the operator suitably loads into the stock unit the paint cartridge to which the IC card representing the paint color, the date, the paint data and the like are added so that the large number of the paint cartridges to which the respective IC cards are added are always stored in the stock unit.

In these cases, according to the total controller, with respect to each loaded paint cartridge, the painting information such as the address read out by the bar code reader or the IC card readout device, the paint color, the paint data and the like is stored, first of all, the operation of the endless conveyor mechanism of the stock unit is controlled on the basis of the painting information, the paint cartridge of the paint color to be used is rotated and carried up to the pickup position and stopped thereat, subsequently, the operation of the carrier is controlled, and the paint cartridge of the paint color is picked up from the stock unit and loaded on the painting robot. Subsequently, by the total controller, the operation of the painting robot is controlled, the paint within the loaded paint cartridge is extruded to be fed to the painter, and subsequently, the automatic painting by the painting robot for the workpiece to be painted is performed in accordance with the painting data whereby a coating film of the paint color is formed at a predetermined thickness at the predetermined position on the surface of the workpiece. Furthermore, preferably, the total controller controls the following operations of the carrier or the like after the painting is completed for some paint cartridge. The used paint cartridge is picked up from the painting robot. The cartridge is carried to the stock unit and collected to the stock unit.

As described above, according to the control system of the present invention, for the individual workpiece, the automatic painting selectively using the paint cartridge of the paint color to be used to the individual workpiece is performed in correspondence with the various parameters of each workpiece.

Incidentally, there is required such a structure that if the multi-color small amount painting system according to the present invention is installed in the paint spry booth actually used, it is possible to load a new paint cartridge and remove the used paint cartridge in the stock unit from the paint spry booth, i.e., without any necessity for the operator to enter the paint spray booth.

In order to meet this requirement, the present inventors have proposed the multi-color small amount painting system composed of the following two structures.

One of them is that, in the above-described multi-color small amount painting system, a partition chamber for receiving and surrounding the stock unit is formed so as to face the outside or the interior of the paint spray booth in or outside of the paint spray booth, and working doors for loading a new paint cartridge from the outside of the paint spray booth and picking up the collected paint cartridge are provided on the wall for partitioning the interior of the partition chamber and outside of the paint spray booth.

The partition chamber is a chamber for surrounding and receiving the stock unit, which is formed to face the outside of the paint spray booth in the paint spray booth or formed to face the interior of the paint spray booth outside of the paint spray booth. Also, the partition chamber may be formed to in the vicinity of the boundary between the outside and the interior of the paint spray booth at the position at which a part has been removed from the wall of the paint spray booth, so as to cross the outside and the interior thereof. The partition chamber should be partitioned from the interior of the paint spry booth in the range in which the partition is not an obstruction against the operation of the carrier. Accordingly, in general, the partition wall of the partition chamber to the interior of the paint spray booth is provided so as to surround and receive the stock unit except for the carrier and the motion range thereof.

The other of the structures is that, in the above-described multi-color small amount painting system, a partition chamber for receiving and surrounding the stock unit is formed so as to face the outside or the interior of the paint spray booth in or outside of the paint spray booth, then, a partition wall for partitioning the outside or inside of the paint spray booth and the interior of the stock unit is formed from a casing of the stock unit or including the casing, and furthermore, working doors for loading a new paint cartridge from the outside of the paint spray booth and picking up the collected paint cartridge are provided on the wall for partitioning the interior of the stock unit and outside of the paint spray booth.

The partition wall represents a wall structure formed in the structure of the interior of the stock unit sealed from the outside of the paint spray booth. The stock unit is disposed so that it faces the interior of the paint stray booth in the outside of the paint spray booth or faces the outside of the paint spray booth in the paint spray booth. Then, when the stock unit is disposed outside of the paint spray booth, the partition wall for partitioning the interior of the stock unit and the outside of the paint spray booth is formed. Also, when the stock unit is disposed interior of the paint spray booth, the partition wall for partitioning the interior of the stock unit and the interior of the spray booth is formed. These partition walls are formed into the closed wall structure by the casing of the stock unit or by a separate coupling member (wall member) connected to the casing or an extension member (wall member) extending from the casing including the casing.

Then, the working doors are provided in the wall partitioning the outside of the paint spray booth from the interior of the partition chamber (i.e., in the booth wall or the wall of the partition chamber) or in the wall partitioning the outside of the paint spray booth from the interior of the stock unit (i.e., in the booth wall or the partition wall). The working doors should be formed into doors having a structure with a high sealing property so that the atmosphere within the paint spray booth is not leaked outside when the doors are closed.

Thus, it is unnecessary for the operator to enter the interior of the paint spray booth. For example, it is unnecessary to carry a vehicle, by hand, on which the paint cartridges are loaded. The maintenance/administration work may be performed from the outside of the paint spray booth. More specifically, the exchange work (replenishment) of picking up the used and collected paint cartridges from the stock unit and loading new paint cartridges into the stock unit may be performed even if the operator would not enter the paint spray booth.

In addition, even if the operator opens the working door in the operation of the paint spray booth to perform such a work, there is no fear that the atmosphere within the paint spray booth is subjected to a serious turbulence. Accordingly, this would not adversely affect the substantial quality of the coating film of the painted product.

Embodiments of the present invention will now be described with reference to the accompanying drawings. It is apparent that those embodiments are described and exemplified and it is needless to say that the present invention is not limited to those embodiments at all.

Embodiment 1

As shown in FIG. 1, a multi-color small amount painting system according to the embodiment is composed of a painting robot 1, a stock unit 3 for cartridges 2, 2, . . . disposed on a side thereof, a carrier 4 disposed above the stock unit 3, and a paint feeding mechanism 5 provided at a head portion of the painting robot 1, i.e., a rear end of a second arm in a painting booth (not shown).

Figure 2:
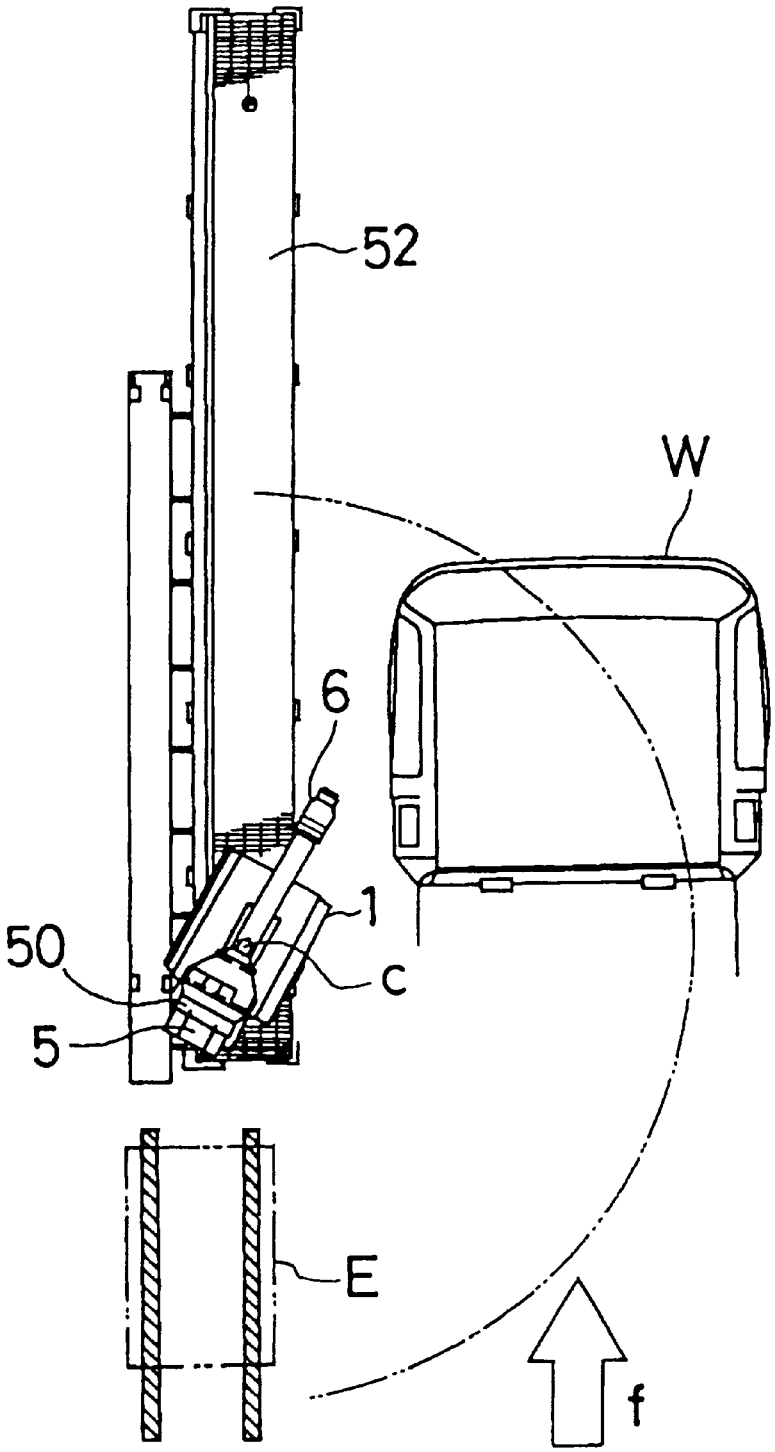
FIG. 2 is a top view of the multi-color small amount painting system shown in FIG. 1.

This painting system is a painting system in which in order to provide a surface painting for a workpiece W (automotive body) to be carried in a horizontal direction as shown in FIG. 2, a variety of kinds of paint are stored in the stock unit 3 in a small unit amount (namely, in the form of the cartridges 2), the paint cartridge 2 of the color of paint to be painted is picked up from the stock unit 3 and loaded on the painting robot 1 by the carrier 4, and the paint within the cartridge 2 is fed to a painter 6 of the painting robot 1 by the paint feeding mechanism 5 so that an automatic painting may be performed by the painting robot 1 with the paint having the desired paint color. Incidentally, in FIG. 2, character f denotes a carrying deflection of the workpiece W, and character c denotes a swivel center of the painting robot 1.

Figure 14:
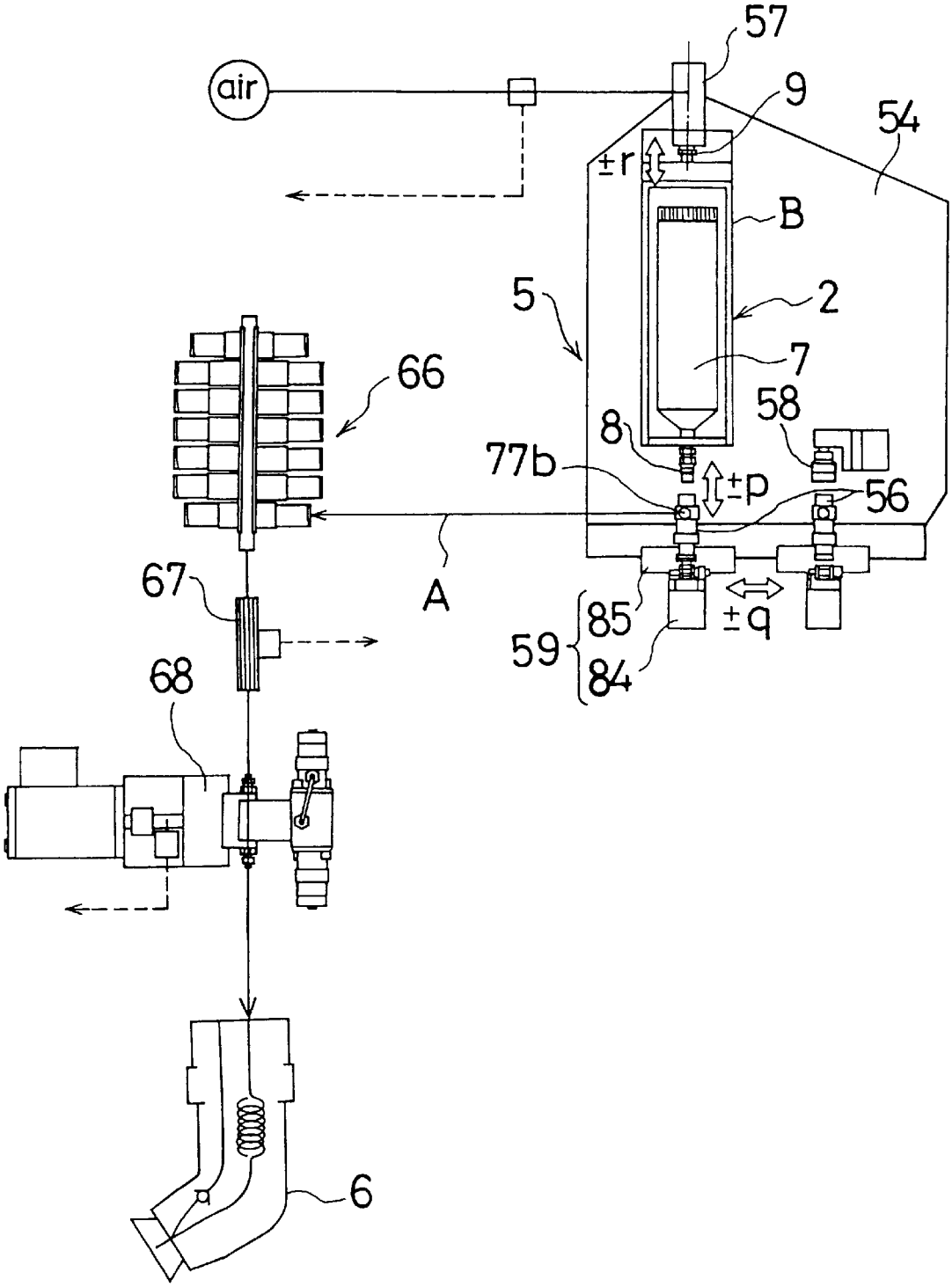
FIG. 14 is a schematic view showing a paint feeding mechanism used in the multi-color small amount painting system according to the first embodiment and a paint flow path from the paint feeding mechanism to a painter.
Figure 18:
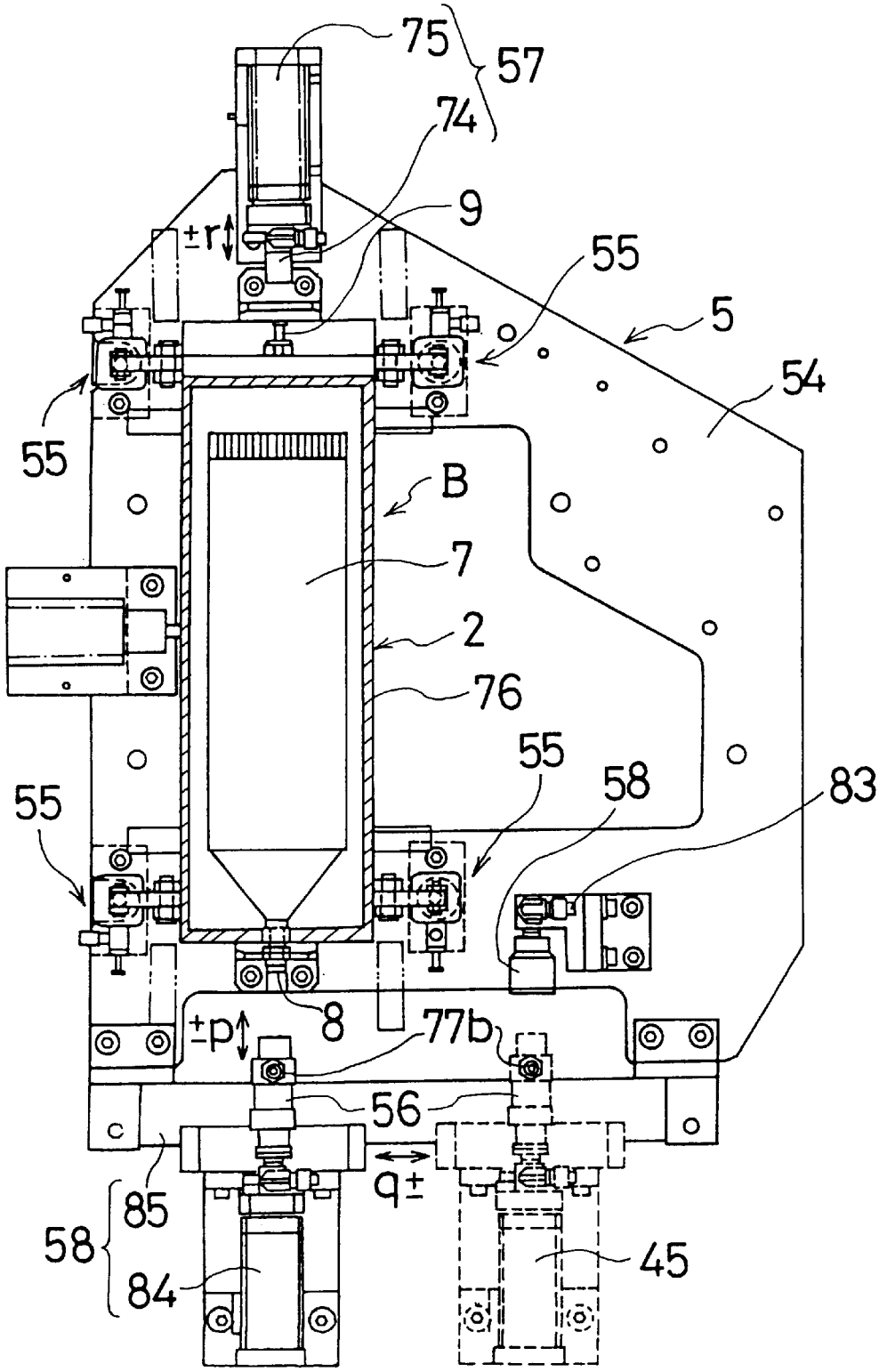
FIG. 18 is a view showing an interior of the mounted paint cartridge in the paint feeding mechanism shown in FIG. 15.

The paint cartridge 2 is a cylindrical metal or plastic container. As shown in FIGS. 14 and 18, the interior thereof is filled with a sleeve-like flexible paint bag (made of synthetic resin) 7 in an exchangeable manner. The paint cartridge 2 is provided at its front end side with an outlet portion 8 continuous to the paint bag 7 and at its rear end side with an air inlet port 9.

A suitable number (about 20 to about 100) of paint cartridges 2, 2, . . . which are different in color of paint are prepared in the painting system. Namely, a small amount of paint having an individual color, i.e., an amount of paint that is needed for the painting operation for a single workpiece is filled in the paint bag 7 of the paint cartridge 2.

The stock unit 3 is a device which is provided with an endless conveyor mechanism for holding a suitable number of the paint cartridges 2, 2, . . . and may carry the selected paint cartridge to the pickup position (In FIG. 2, a frame line E denotes its installation position).

Figure 3:
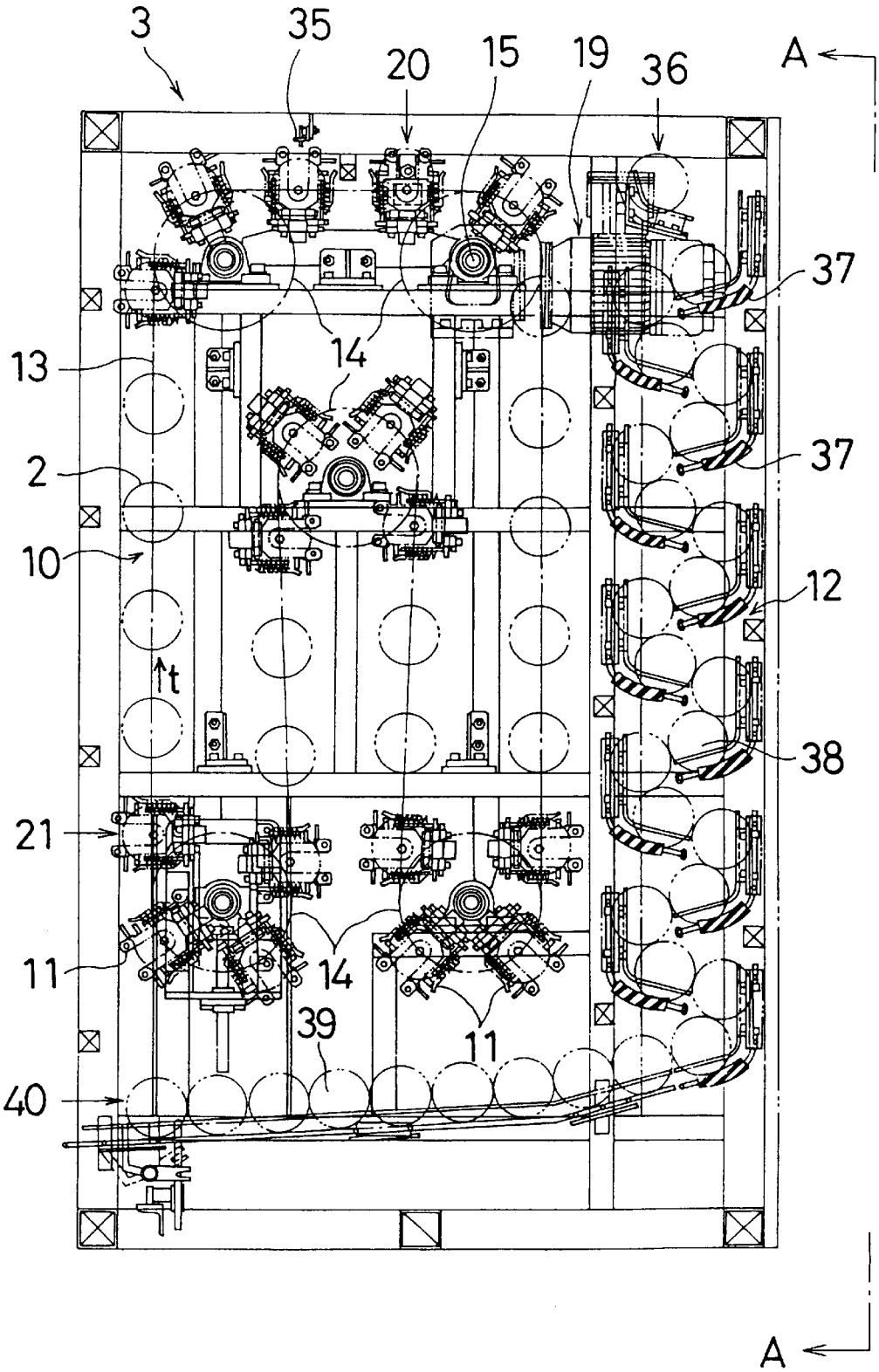
FIG. 3 is a schematic frontal view showing an interior of a stock unit used in the multi-color small amount painting system in accordance with the first embodiment.
Figure 4:
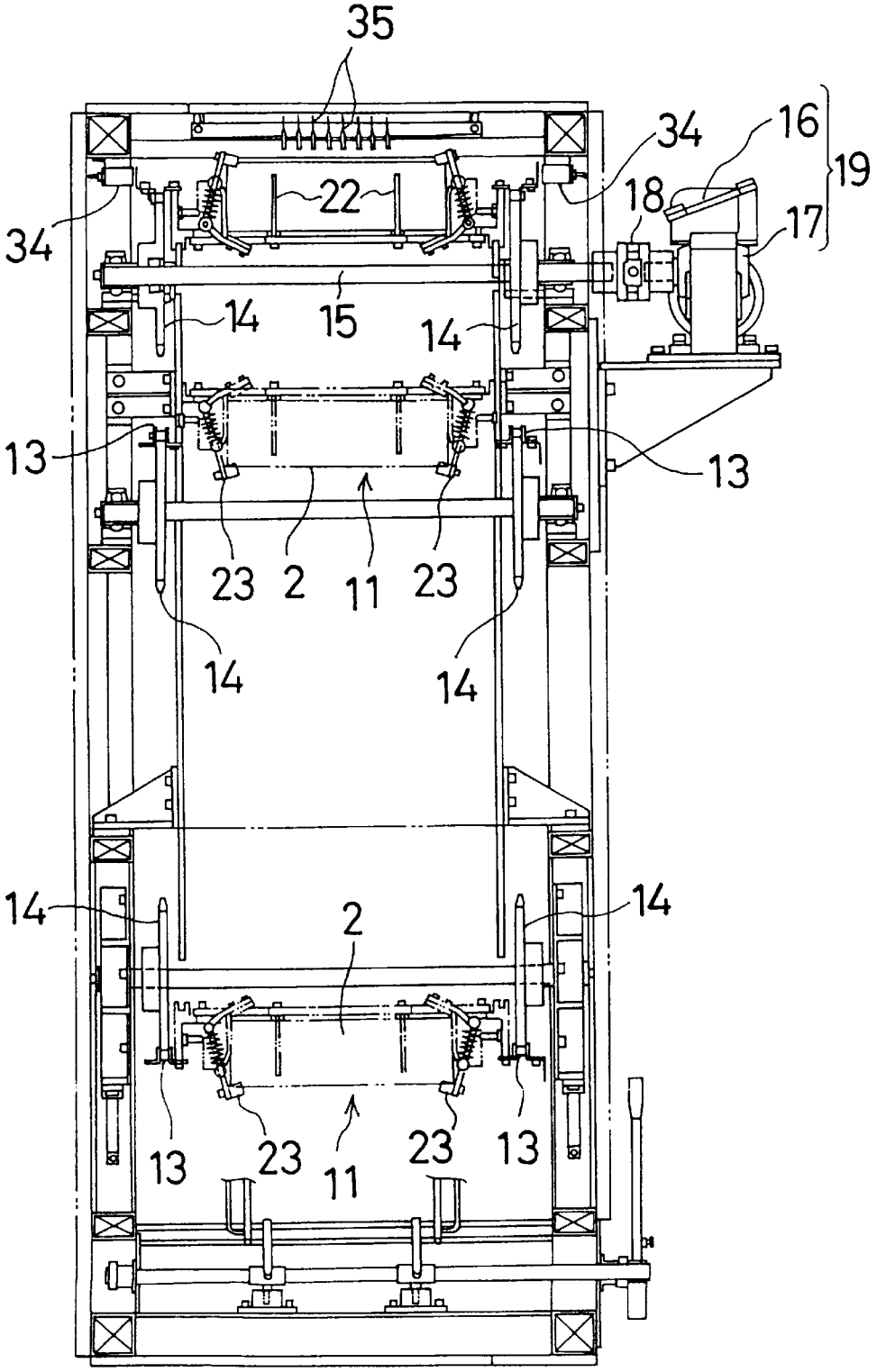
FIG. 4 is a side elevational view showing the stock unit shown in FIG. 3.

More specifically, the stock unit 3 is provided with the endless chain conveyor mechanism 10 and a number (about 30) of retaining means 11 assembled thereto as shown in FIGS. 3 and 4 and is further provided with a controller (not shown) for controlling the conveyor mechanism 10. The stock unit 3 is so constructed that it may store a number (about 30) of cartridges 2 having paint colors and may selectively pick up the desired paint cartridge 2 by the carrier 4. Furthermore, as shown in FIG. 3, the stock unit 3 is provided also with a collection mechanism 12 for collecting the used paint cartridges 2 in parallel with the endless chain conveyor mechanism 10.

In the endless chain conveyor mechanism 10, as shown in FIG. 4, a pair of right and left endless chains 13 and 13 (each of which is wound around five sprockets 14 are provided in parallel with each other at a constant interval, and one sprocket shaft 15 is connected to an explosion preventing invertor motor 16 and a speed reducer 17 through a coupling 18. By the operation of this drive mechanism 19, the paint cartridge 2 held between the left and right endless chains 13 and 13 may be rotated and carried (in a direction of an arrow t in FIG. 3).

A pickup position (position where the paint cartridge 2 is picked up) 20 is provided at the top portion of the stock unit 3. Also, a loading position for the paint cartridge 2 (position where a new paint cartridge 2 is added from the outside) 21 is provided at the lower portion of the stock unit 3. The above-described endless chain conveyor mechanism 10 has an endless conveyor path passing through the pickup position 20 and the loading position 21 of the paint cartridges 2. Incidentally, also a collection port (i.e., a port where the paint cartridge 2 is to be cast and collected) 36 is provided in addition to the pickup position 19 in the upper portion of the stock unit 3 (see FIG. 3).

The retaining means 11 is means for retaining the respective cartridges 2 in a detachable manner and whose number corresponds to the number (about 30) of the paint cartridges 2, 2, . . . to be stored in the stock unit 3. This retaining means 11 is composed of a receiver frame 22 which may receive and retain the paint cartridge 2, a pair of right and left bent retainer arms 23 and 23 and coil springs 24 and 24 provided on the retainer arms 23 and 23 as shown in FIGS. 5 and 6.

The receiver frame 22 is made by the arrangement of some upright frame rods 25, 25, . . . in a frame base 26 so as to surround the paint cartridge 2. The paint cartridge 2 may be held in a stable manner by the arrangement in which the frame rods 25 are brought into contact with a front end face, a rear end face and an outer circumferential surface of the paint cartridge 2 without any gap when the paint cartridge 2 is received therein.

Also, right and left retainer arms 23 and 23 are arms bent substantially at a right angle and supported so that the respective inner angle sides face each other and rotatable about their bent portions 27 on the outside of the receiver frame 22. Retainer members 29 are mounted at tip ends of upper arm portions 28 of the retainer arms 23, whereas pusher members 31 are mounted at tip ends of lower arm portions 30 thereof.

Figure 5:
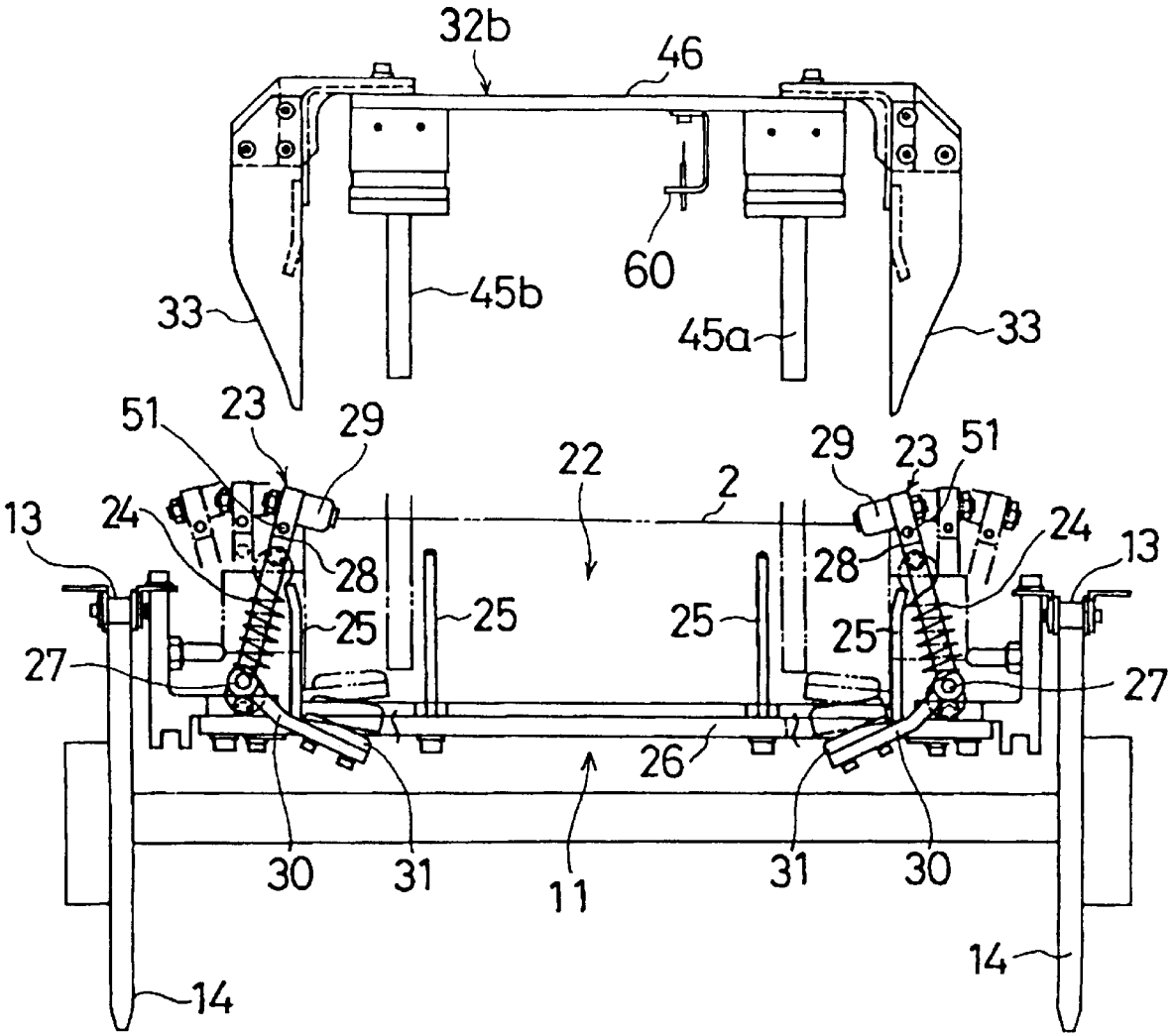
FIG. 5 is a view showing a lower portion of a chuck means of a carrier and a retainer provided in the stock unit shown in FIG. 3.
Figure 6:
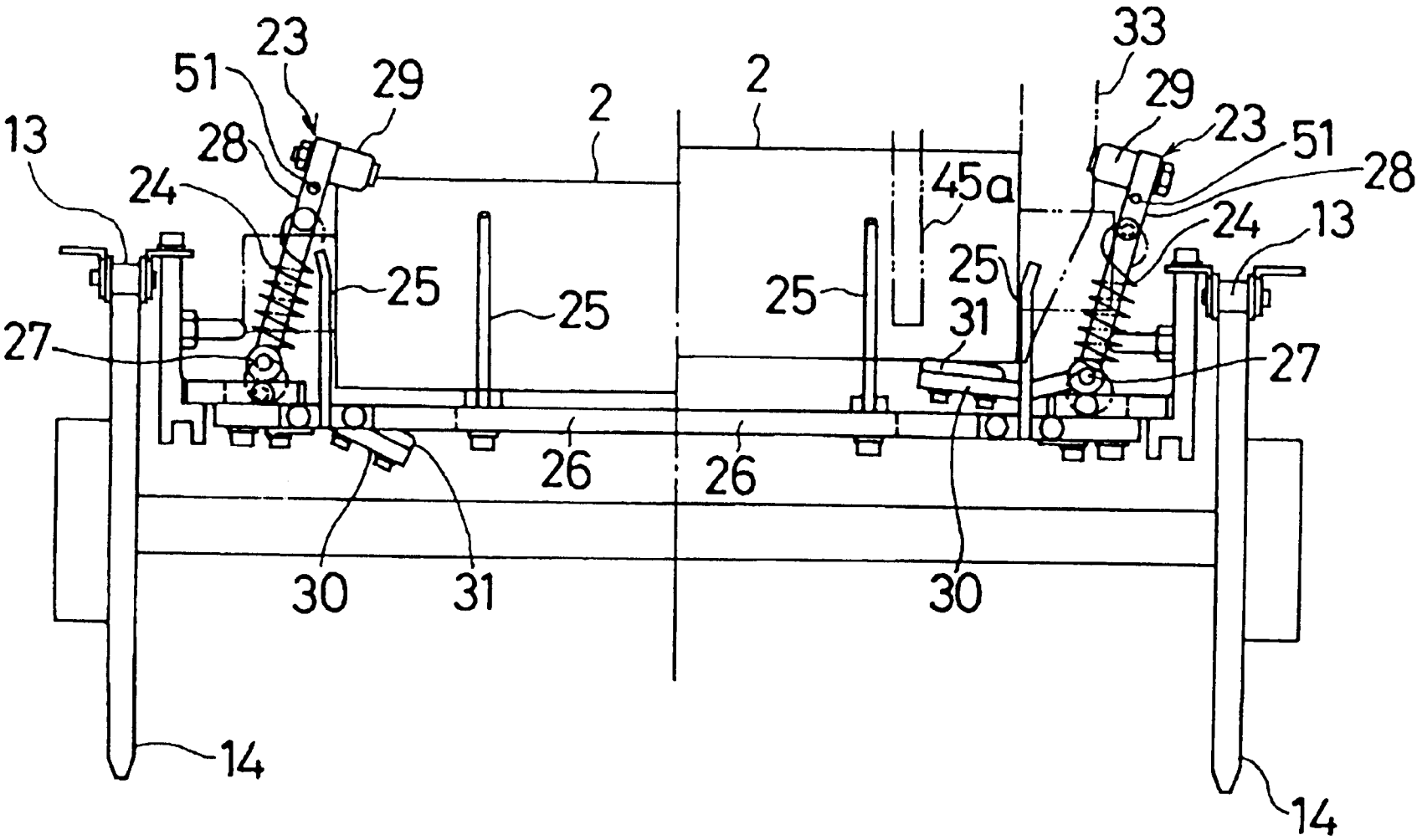
FIG. 6 is a view showing a state of the retention of the paint cartridge (left half) and the pickup thereof (right half)

A mechanism (so-called toggle mechanism) is provided in which coil springs 24 and 24 are interposed between the upper arm portions 28 of the retainer arms 23 and the frame base 26 of the receiver frame 22, respectively, whereby, when the upper arm portions 28 are slanted inwardly from an upright posture, the right and left retainer arms 23 and 23 are biased inwardly, respectively, whereas, when the upper arm portions 28 are slanted outwardly from the upright posture, the right and left retainer arms 23 and 23 are biased outwardly, respectively (see FIG. 5). Accordingly, the retainer members 29 and 29 at the tip ends of the upper arms of the retainer arms 23 and 23 are caused to push the paint cartridge 2 loaded in the receiver frame 22 by the inwardly working force of the right and left coil springs 24 and 24 so that the paint cartridge 2 is firmly gripped.

As shown in FIGS. 5 and 6, thin elongated pins 51 are implanted horizontally in the upper arm portions 28 of the retainer arms 23 on the right and left sides, respectively. On the other hand, as shown in FIGS. 5 and 6, widening members 33 and 33 are provided at both right and left ends of a base portion 46 of the chuck means **32*b* of the carrier 4 to be described later. Then, when the retaining means 11 is stopped at the pickup position 20 of the cartridge 2, the chuck means 32*b* that has been located just above its position is lowered. Simultaneously therewith, the widening members 33 and 33 are brought into contact with the right and left pins 51 and 51 to cause the upper arm portions 28 and 28 of the right and left retainer arms 23 and 23 to pressingly rotate outwardly, respectively. Then, when the right and left upper arm portions 28 and 28 are slanted outwardly from the upright posture, the right and left retainer arms 23 and 23 are strongly rotated outwardly by the outwardly working force of the right and left coil springs 24 and 24 so that the pusher members 31 and 31 at the lower arm tip ends thereof push upwardly the paint cartridge loaded in the receiver frame 22, respectively. With such an arrangement, it is possible to readily grip and carry away the paint cartridge 2 in the pickup position 20. Namely, it is possible to readily pick up the paint cartridge 2 by the carrier 4**.

After the paint cartridge 2 has been picked up, the right and left retainer arms 23 and 23 are kept under the condition that they are pushed and widened outwardly, respectively. Then, when this retaining means 11 has been rotated and carried up to the loading position 21 of the paint cartridge 2 and then the operator inserts a new paint cartridge 2, the loaded paint cartridge 2 pushes downwardly the pusher members 31 and 31 of the right and left retainer arms 23 and 23 to cause the right and left lower arm portions 30 and 30 to be pushed and rotated inwardly. Then, when the right and left upper arm portions 28 and 28 are slanted inwardly from the upright posture, the right and left retainer arms 23 and 23 are strongly rotated inwardly so that the right and left retainer members 29 and 29 at the upper arm tip ends thereof push the inserted paint cartridge 2 upwardly and retain it in the receiver frame 22. With such an arrangement, it is possible to readily load the paint cartridge 2.

The controller for the paint cartridge 2 is a unit which performs the control of operating the driver mechanism of the endless chain conveyor mechanism 10 by a suitable amount and rotatively carrying the paint cartridge 2 of the desired, i.e., designated paint color up to the pickup position 20, on the basis of the address information of the paint cartridge 2. Namely, this controller is the unit which may perform the control of calculating the position, within the endless conveyor path, of the loaded paint cartridge 2, on the basis of the drive amount (advance amount of the chain conveyor 13) of the endless chain conveyor mechanism 10, and on the basis of the address information read automatically or inputted manually when each paint cartridge 2 is loaded, calculating how the paint cartridges 2, 2, . . . are arranged in an address order on the basis of the original positions, then calculates, on this calculation, the necessary drive amount to rotatively carry the paint cartridge 2 of the paint color to be picked up, up to the pickup position 20, and driving the endless chain conveyor mechanism 10 by the necessary rotative carrier amount so that the paint cartridge 2 of the paint color to be picked up is rotatively carried up to the pickup position 20.

Also, instead of the structure described above, the controller may be provided with an optical readout means (bar code reader) on the side of the rotative carrier path of the paint cartridge 2. With this, such a control is performed that the address mark attached to each retaining means 11 and a mark (bar code mark) for the paint color attached to each cartridge 2 are optically read out, and the paint cartridge 2 of the paint color to be painted next is rotatively carried up to the pickup position 20 on the basis of the address and paint color information that have been read out.

Incidentally, in FIG. 4, numeral 34 denotes a stop confirmation sensor (proximity-switch) for detecting the stop of the paint cartridge 2, that has been rotatively carried, in the pickup position 20. Also, in FIGS. 3 and 4, numeral 35 denotes a sensor for optically reading out the paint data such as a kind of color or the like of the paint of the paint cartridge which has come to the pickup position 20, in the vicinity of and from above the pickup position 20. With this, it is possible to perform such a control that, on the basis of the paint data that have been read out, the rotative carrier amount of the target paint cartridge 2 or the like may be calculated so that the desired paint cartridge 2 may be stopped at the pickup position 20.

Accordingly, the stock unit 3 has a structure in which a large number (about 30) of kinds of paint color may be stored therein, and when the paint color to be painted is designated in the controller of the stock unit 3, in accordance with this control, first of all, the endless chain conveyor mechanism 10 starts its operation so that the paint cartridge 2 of the paint color may be rotatively carried up to the pickup position 20.

In addition, since the stock unit 3 rotates and carries the stored paint cartridge 2 in operation while rotating the cartridge 2 about a center in the axial direction thereof, the paint contained within the paint cartridge 2 is agitated so that the paint may be more homogeneously mixed.

Also, as shown in FIG. 3, in the collection mechanism 12, receiver bars 37, 37, . . . are alternatively arranged on the right and left sides up and down below the collecting ports 36 of the paint cartridge 2 so that the paint cartridges 2 slidingly drop in a zigzag manner between the receiver bars 37, 37, . . . from the collection port 36 and form a vertical collection passage 38, and further subsequently to the collection passage 38, form a collection passage 39 extending horizontally. Accordingly, when the used paint cartridges 2 are cast from the collection port 36, the used paint cartridges 2 pass through these passages 38 and 39 and are finally collected by the pickup port 40 on the side surface of the stock unit 3.

Figure 7:
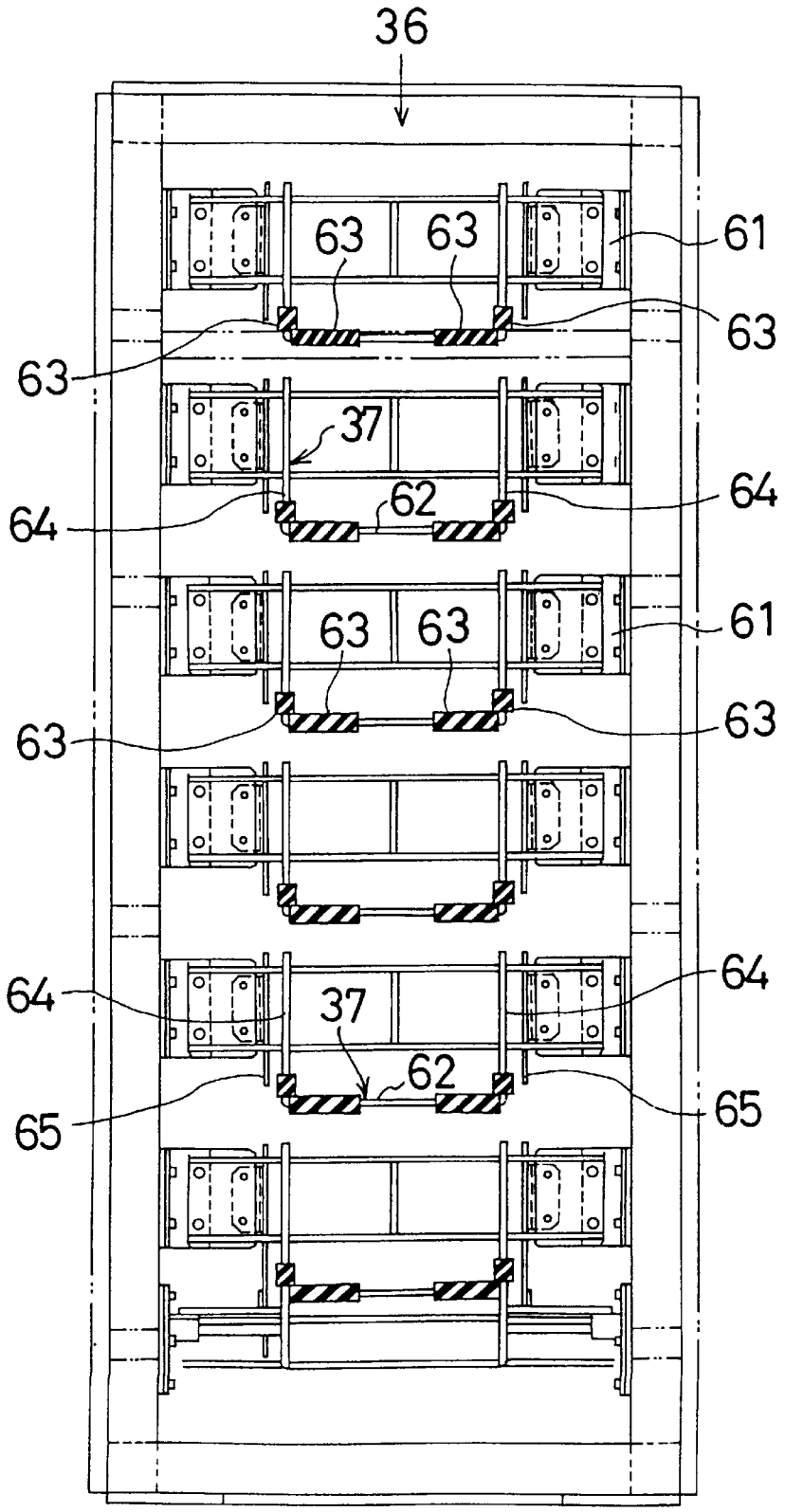
FIG. 7 is a view of a collection mechanism of the paint cartridge in the stock unit shown in FIG. 3, as viewed in a direction of an arrow A—A.
Figure 8:
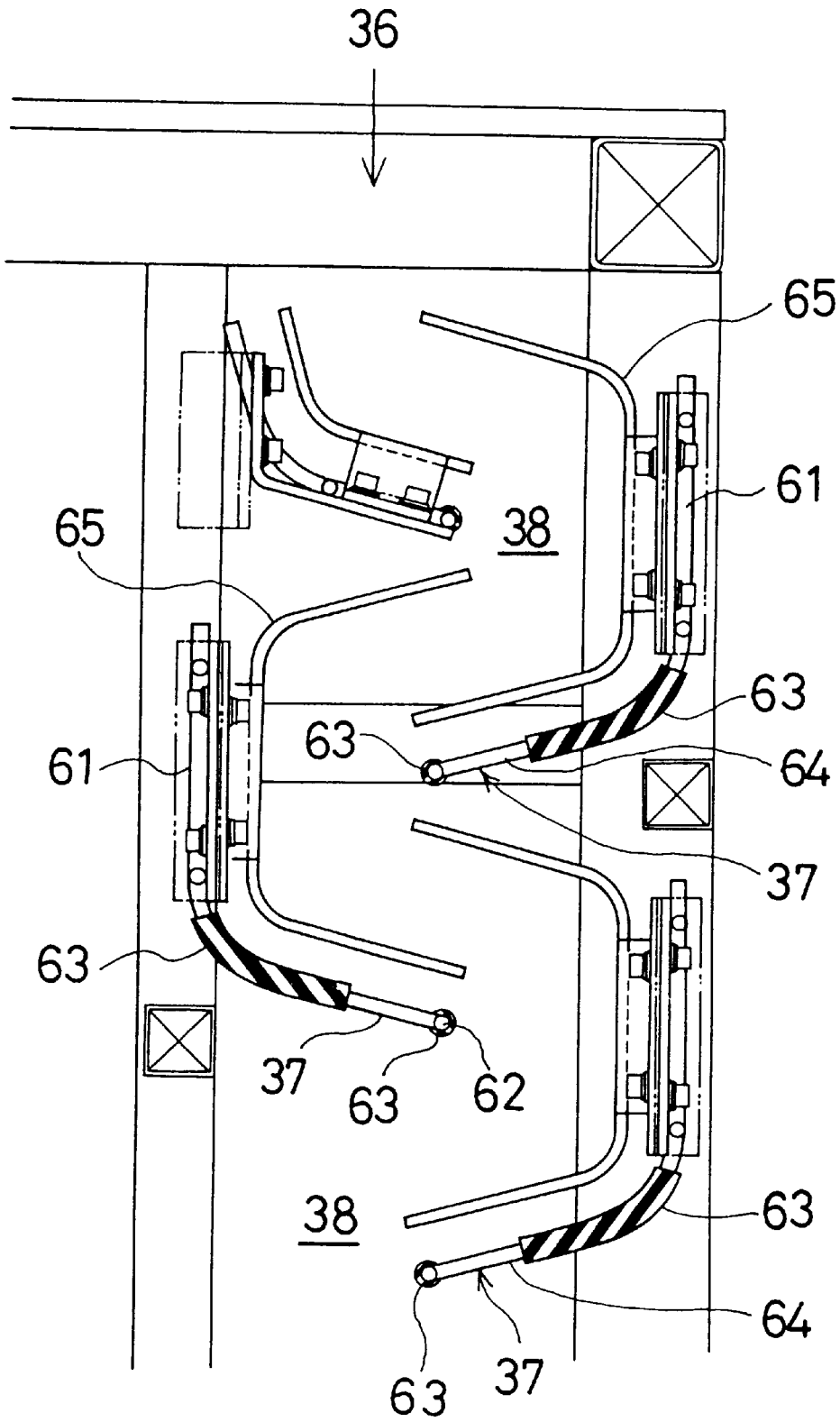
FIG. 8 is an enlarged view showing an upper portion of the collection mechanism shown in FIG. 3.
Figure 9:
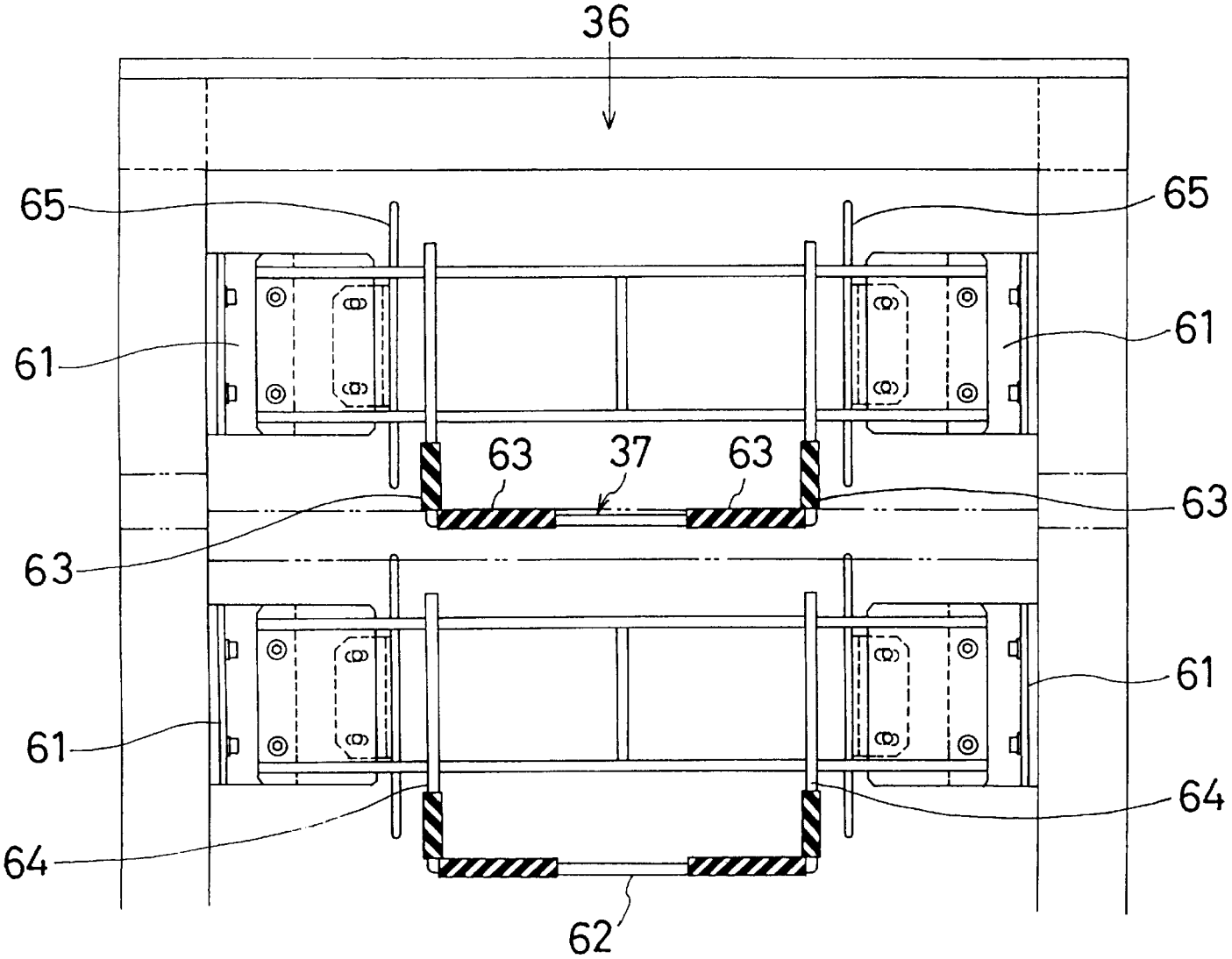
FIG. 9 is an enlarged view showing an upper portion of the collection mechanism shown in FIG. 7.

As shown in FIGS. 7 to 9 in detail, the receiver bars 37 are bars made of metal, bent substantially in a U-shape and fixed to the support base 61 of the stock unit body, and the right and left receiver bars 37, 37, . . . facing each other in an obliquely downward posture with their central portion 62 being kept substantially horizontally.

Cover members 63 are provided for each receiver bar 37 for covering the latter at both end portions of the central portion 62 of the receiver bar 37 and at both side portions 64 continuous thereto. The cover member 63 is made of polyvinylchloride resin having a Shore hardness of 50 to 60.

Furthermore, jumping preventing bars 65 and 65 each of which is substantially in the form of a U-shape are provided vertically in the vicinity of the right and left side portions 64 and 64 of each receiver bar 37. The central portion of each jumping preventing bar 65 is fixed to the support base 61. Accordingly, the upper and lower side portions of the jumping preventing bar 65 extend away from the support base 61. Namely, the upper side portion of the jumping preventing bar 65 is provided to face, substantially in parallel with the side portion 64 of the receiver bar 37 above the side portion 64.

Accordingly, after the completion of the painting work, the chuck means 32*a* of the carrier 4 is lowered down to the carrier area 50 of the painting robot 1. Subsequently, the chuck means 32*a* grips the used paint cartridge 2 and picks up it from the painting robot 1. Then, subsequently to the elevation of the chuck means 32*a*, a carrier member 42 is moved close to the stock unit 3 to carry the used paint cartridge 2 to the stock unit 3, and subsequently, releases the paint cartridge 2 in the stage where the chuck means 32*a* is lowered and close to the collection port 36. Then, the paint cartridge 2 cast into the collection port 36 is collected from the pickup port 40 through the passages 38 and 39 of the stock unit 3. Accordingly, in accordance with this system, in addition to the loading of the paint cartridge 2 to the painting robot 1, it is possible to collect the used paint cartridge 2.

Among others, since the collection mechanism 12 of this example has a shock dampening material having a cover member 63 made of PVC, i.e., a shock absorbing material of a Shore hardness of 50 to 60 as the substantially U-shaped receiver bars 37, 37, . . . for receiving the paint cartridge 2 that drops in the zigzag manner, it is possible to smoothly collect the used cartridge 2, which has been carried and returned back by the painting robot 1, in the stock unit 3 without any fear that the interior of the collection passage 38 would be clogged. Even if the paint cartridge 2 would be collided against the receiver bar 37 and would jump, the jumping preventing bars 65 and 65 come into contact with the outer circumferential surfaces at both right and left ends of the paint cartridge 2 that has jumped actually. Accordingly, it is possible to suppress the jumping motion thereof. Accordingly, there remarkably decreases a fear that the paint cartridge 2 and the collection mechanism 12 would be damaged or deformed in accordance with such a collection work.

Figure 10:
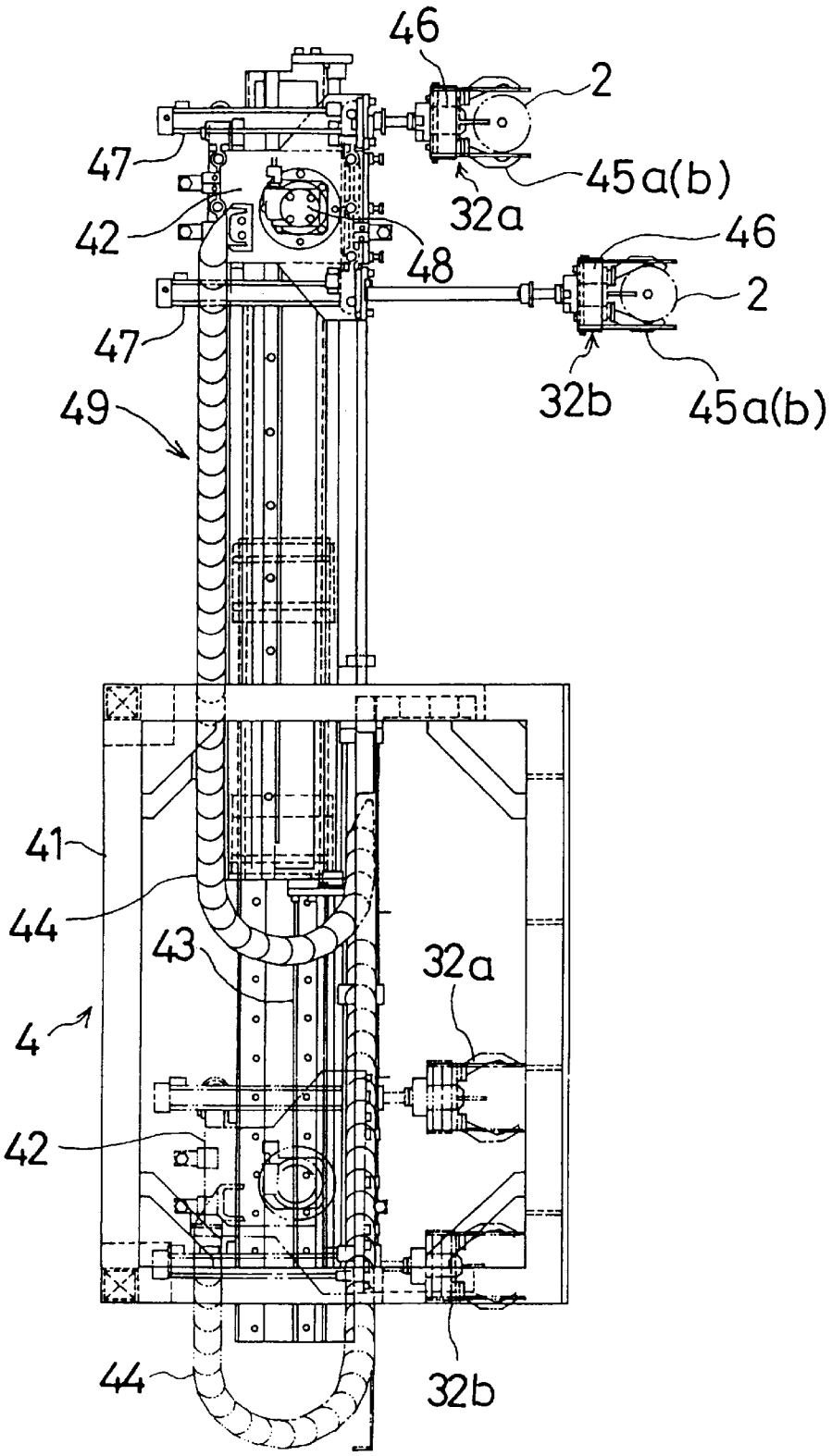
FIG. 10 is a frontal view showing the entire carrier used in the multi-color small amount painting system according to the first embodiment.
Figure 11:
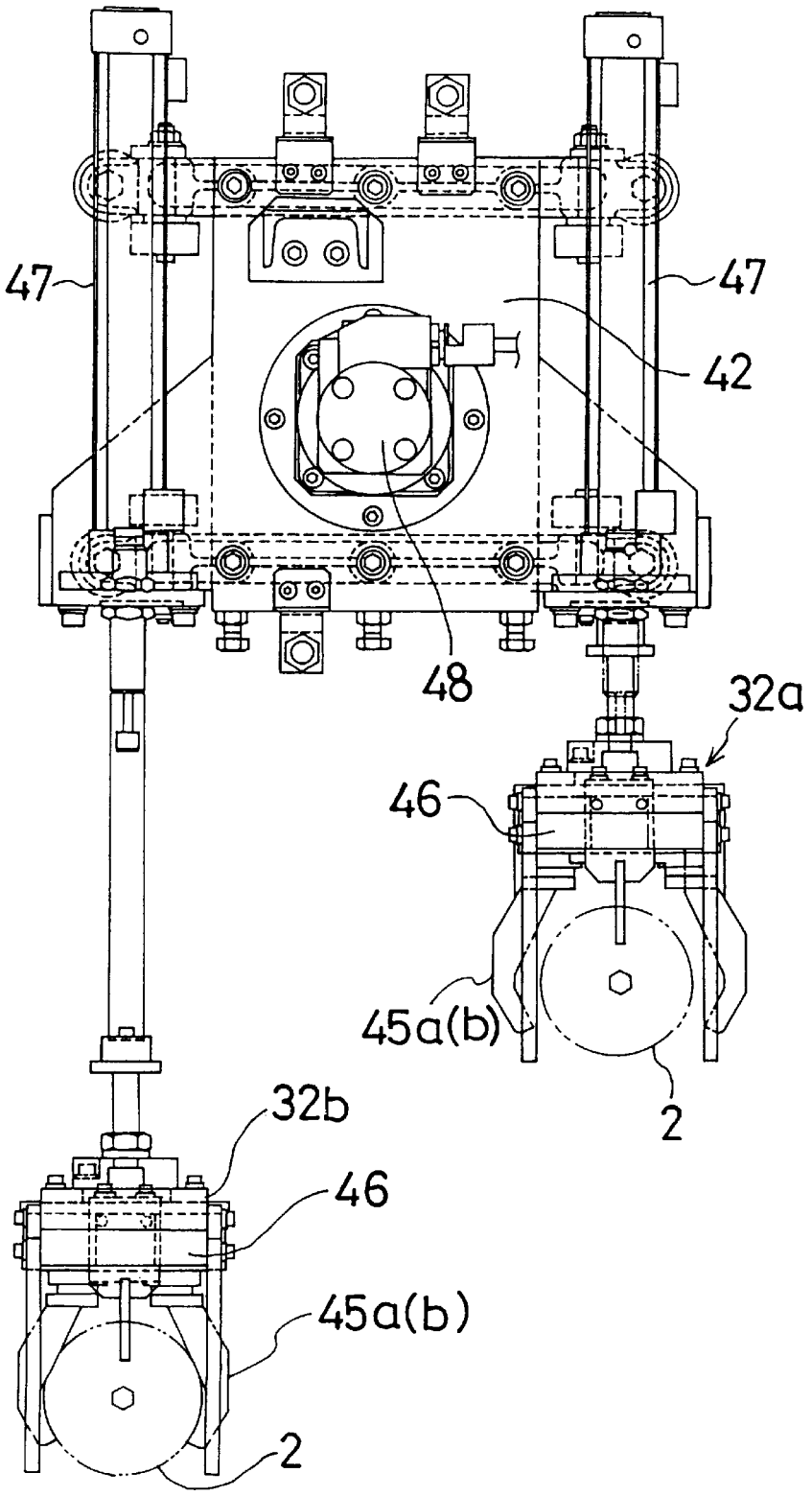
FIG. 11 is an enlarged frontal view showing the chuck means and a carrier member of the carrier shown in FIG. 10.
Figure 12:
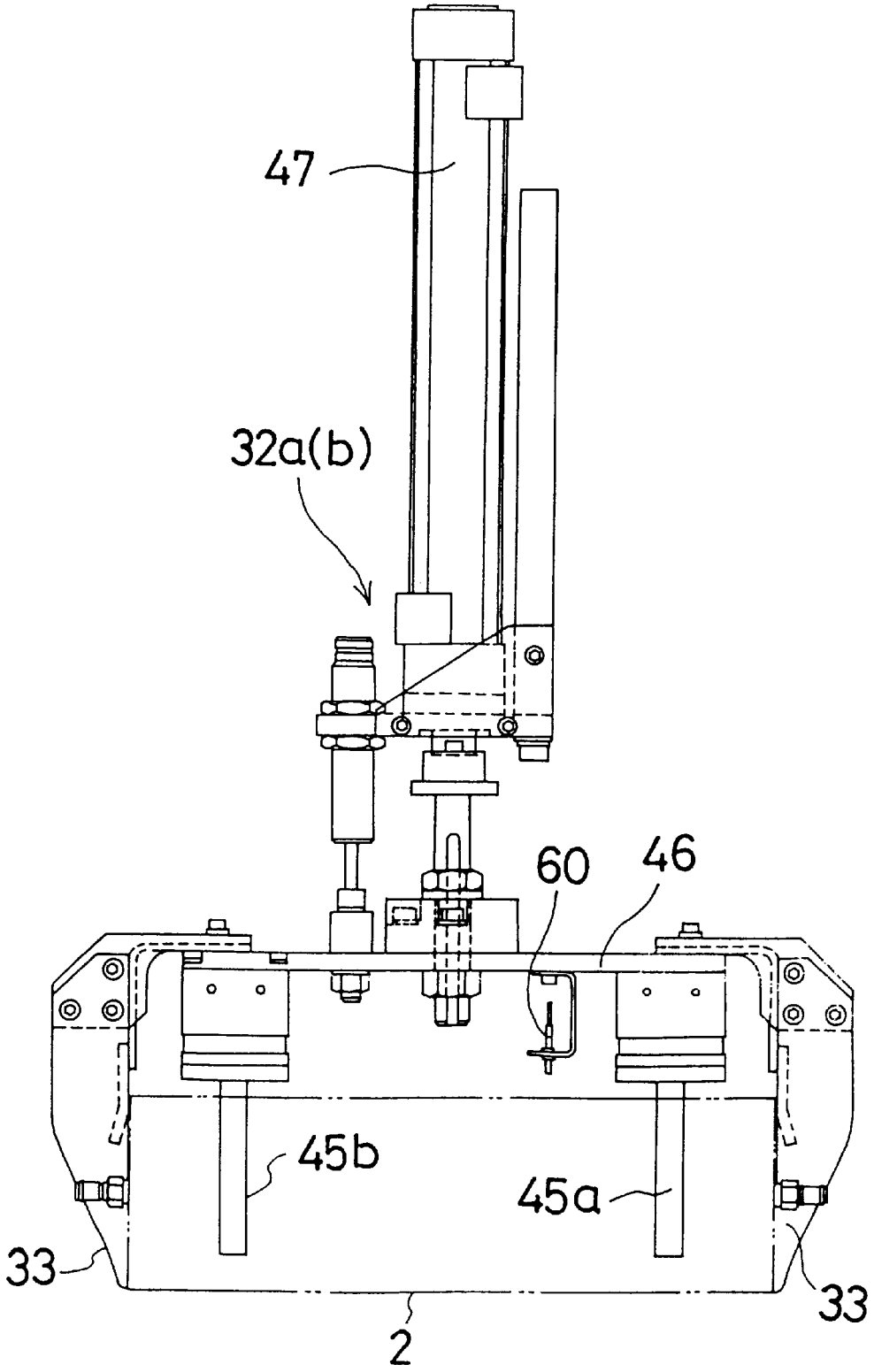
FIG. 12 is an enlarged side elevational view showing the chuck means of the carrier shown in FIG. 10.

Also, the carrier 4 is a unit for simultaneously performing the loading of the paint cartridge 2 to the painting robot 1 and the collection of it from the loading robot 1 and is composed of the carrier member 42, two chuck means 32*a* and 32*b*, the driver 49 and the controller (not shown) in addition to the unit body 41, as shown in FIGS. 10 to 12.

The unit body 41 is a structure in which guide rails 43 are provided in the horizontal manner over the upper portion of the painting robot 1 and over the upper portion of the stock unit 3.

The carrier member 42 is a part supported reciprocatingly slidably to the guide rails 43 of the unit body 41 and may reciprocatingly move and slide in the horizontal manner along the guide rails 43 by the operation of the conveyor mechanism 44, i.e., an explosion preventing AC servo motor 48.

Also, the carrier member 42 suspends a pair of right and left chuck means 32*a* and 32*b* together in parallel at a predetermined interval.

In the respective chuck means 32*a* and 32*b*, a pair of chucks 45*a* and 45*b* swingable freely are mounted on the base portions 46 and perform the opening/closing operation by the operation of the cylinder assembly. With this, the base portions 46 are provided movably up and down by the operation of the cylinder assembly 47. Accordingly, the respective chuck means 32*a* and 32*b* may cause the pair of chucks 45*a* and 45*b* to be close to the paint cartridge 2 located therebelow and to be separated therefrom by the ascending/descending operation of the base portions 46. Also, it is possible to grip and release the paint cartridge by the opening/closing operation of the pair of chucks 45*a* and 45*b* concomitant with this.

As described above, the two chuck means 32*a* and 32*b* of the carrier 4 may grip and release the paint cartridges 2, respectively. Then, the carrier 4 may reciprocatingly carry the paint cartridges 2 suspended by the grip between the painting robot 1 and the stock unit 3 by the reciprocating motion of the carrier 42.

The controller is a unit for totally controlling the variety of operations of the carrier 4. The controller carries out the following series of operations. When the carrier 42 is positioned on the stock unit 3 side, the chuck means 32*a* which has carries the used paint cartridge 2 is lowered to be close the collection port 36 of the stock unit 3. Subsequently, the used paint cartridge 2 is released to be cast into the collection port 36. Thereafter, the chuck means 32*a* is raised and simultaneously therewith, the chuck means 32*b* is lowered to be close to the pickup position 20 of the stock unit 3. Subsequently, the paint cartridge 2 of the color paint to be painted is gripped and removed from the stock unit 3, and thereafter, the chuck means 32*b* is raised. Also, when the carrier 42 is located on the painting robot 1 side, the chuck means 32*a* is lowered to be close to the loading area 50 of the painting robot 1, grips the used paint cartridge 2 which has already been loaded thereon and picks up from the painting robot 1. Thereafter, the chuck means 32*a* is raised, and subsequently, the chuck means 32*b* that has carried the paint cartridge 2 of the new paint color is lowered to be close to the loading area 50 of the painting robot 1. The chuck means 32*b* releases the new paint cartridge 2 and loads it on the painting robot 1. Thereafter, the chuck means 32*b* is raised.

More specifically, the carrier 4 performs the following series of operations in cooperation with the stock unit 3.

Figure 25:
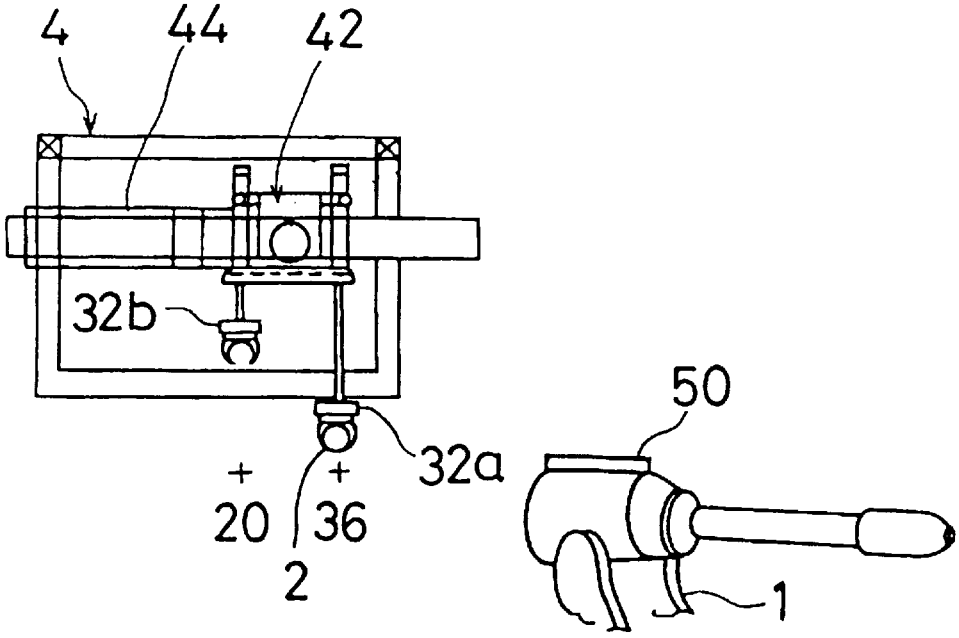
FIG. 25 is a view showing a mode of an operation of the carrier shown in FIG. 10.

First of all, as shown in FIG. 25, the carrier member 42 is stopped above the collection port 36, and subsequently, the chuck means 32*a* is lowered to be close to the collection port 36. Subsequently, the chuck means 32*a* releases the used paint cartridge 2 that has been gripped and casts it into the collection port 36. After casting, the chuck means 32*a* is raised and returned back to the original position. On the other hand, the used paint cartridge 2 cast into the collection port 36 is collected from the pickup port 40 through the passages 38 and 39 of the stock unit 3.

Figure 26:
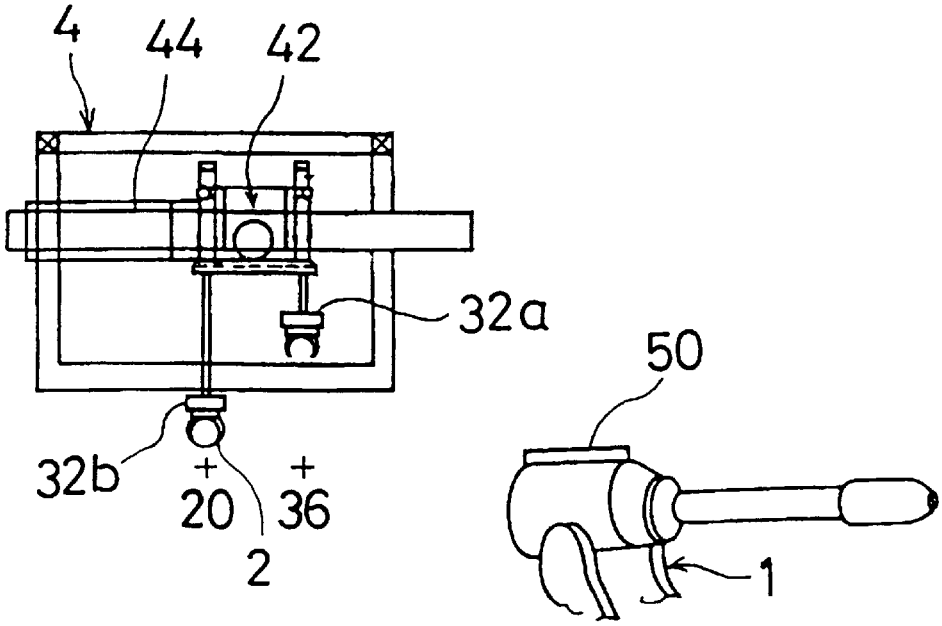
FIG. 26 is a view showing a mode of an operation of the carrier shown in FIG. 10.

Subsequently, as shown in FIG. 26, the carrier member 42 is moved close to the stock unit 3 and stopped above the pickup position 20. Next, the chuck means 32*b* is lowered to be close to the pickup position 20. Subsequently, the chuck means 32*b* grips a desired paint cartridge 2 of the paint color to be painted and picks it up from the stock unit 3. Subsequently, the chuck means 32*b* is raised and returned back to the original position. Then, subsequent thereto, the carrier member 42 is moved horizontally close to the painting robot 1.

Figure 27:
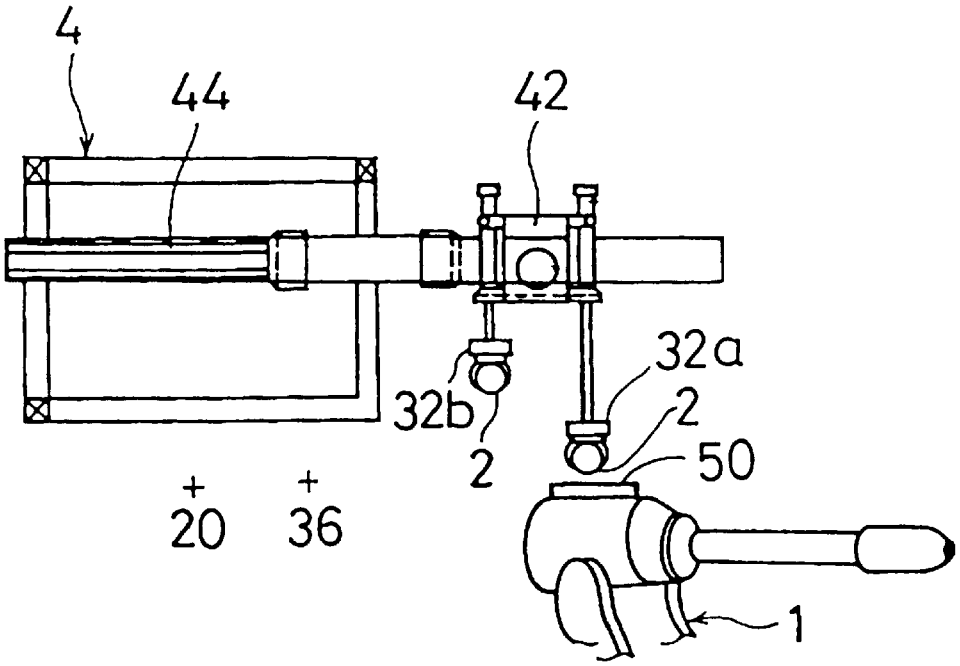
FIG. 27 is a view showing a mode of an operation of the carrier shown in FIG. 10.

Subsequently, as shown in FIG. 27, the carrier member 42 is moved so that the chuck means 32*a* is moved up to a position above the loading area 50 of the paint robot 1 and stopped thereat. Subsequently, the chuck means 32*a* is lowered to be close to the area 50. Subsequently, the chuck means 32*a* grips the used paint cartridge 2 ( i.e., the paint cartridge 2 loaded in advance on the area 50 and used for painting) and picks it up from the painting robot 1. Thereafter, the chuck means 32*a* is raised and returned back to the original position.

Figure 28:
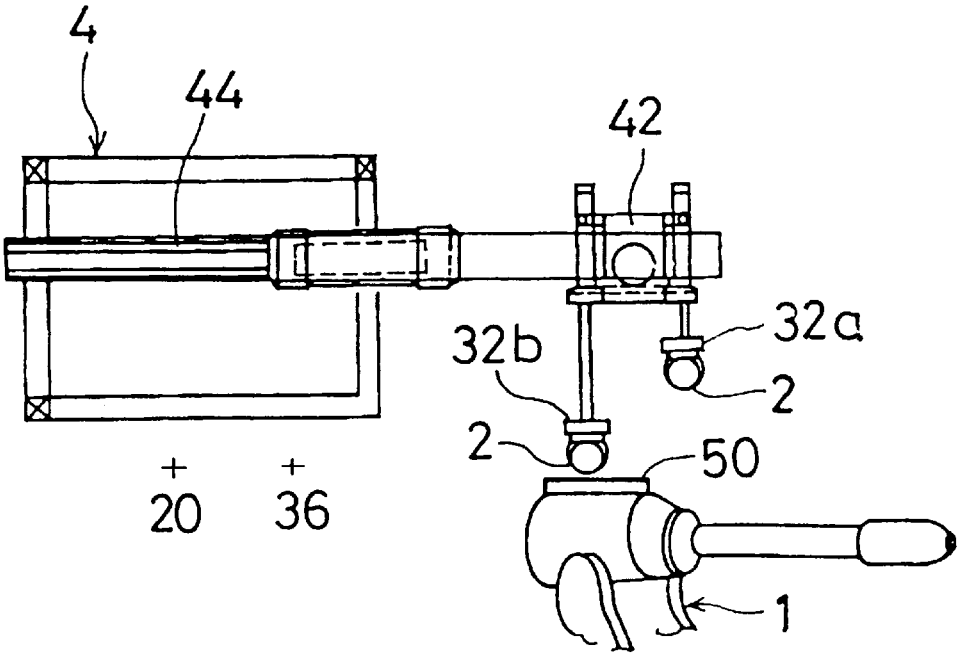
FIG. 28 is a view showing a mode of an operation of the carrier shown in FIG. 10.

Subsequently, as shown in FIG. 28, the carrier member 42 is further moved close to the painting robot 1 and stopped at a position where the chuck means 32*b* reaches the position above the loading area 50 of the painting robot 1. Subsequently, the chuck means 32*b* is lowered to be close to the area 50, then releases the paint cartridge 2 of the desired paint color and loads it on the painting robot 1. Thereafter, the chuck means 32*b* is raised and returned back to the original position.

Then, finally, the carrier member 42 is moved horizontally close to the stock unit 3 and is returned back to the position shown in FIG. 25.

Accordingly, the carrier 4 takes a reciprocating motion between the stock unit 3 and the painting robot 1 while suspending the paint cartridge 2, grips the paint cartridge 2 of the paint color to be painted in the pickup position 20 on the stock unit side and picks it up from the stock unit 3 by using the two chuck means 32*a* and 32*b*. In addition, the used paint cartridge 2 is cast to the collection port 36 of the collection mechanism 12. On the other hand, on the painting robot side, the used paint cartridge 2 is gripped and picked up from the painting robot 1 in the area 50. Subsequently, the paint cartridge 2 of the paint color to be painted is released and loaded on the painting robot 1.

In addition, with the single reciprocating motion with the two chuck means, the loading of the paint cartridge of the paint color to be painted from the stock unit to the painting robot and the collection of the used paint cartridge from the painting robot to the stock unit may be simultaneously performed by using the carrier 4.

Incidentally, in this example, each chuck means 32*a*, 32*b* is provided with the widening members 33 and 33 at the right and left ends of the base portion 46. As shown in FIGS. 5 and 6, when the pair of chucks 45*a* and 45*b* approach the paint cartridge 2 held by the retaining means 11, the right and left widening members 33 and 33 push and rotate the retainer arms 23 and 23 (retainer members 29 and 29) outwardly while contacting a pin 51 of the right and left upper arm portions 28 and 28. Then, when the right and left upper arm portions 28 and 28 are slanted outwardly from the upright posture, the upper portions 28 and 28 of the right and left retainer arms 23 and 23 are strongly rotated. The respective pusher members 31 and 31 at the ends of the lower arm portions 30 push the paint cartridge 2 inserted into the receiver frame 22 upwardly. Accordingly, the grip of the paint cartridge 2 by the pair of chucks 45*a* and 45*b* may readily be performed. In the drawings, numeral 60 denotes a sensor for detecting whether or not the paint cartridge 2 is gripped.

Figure 13:
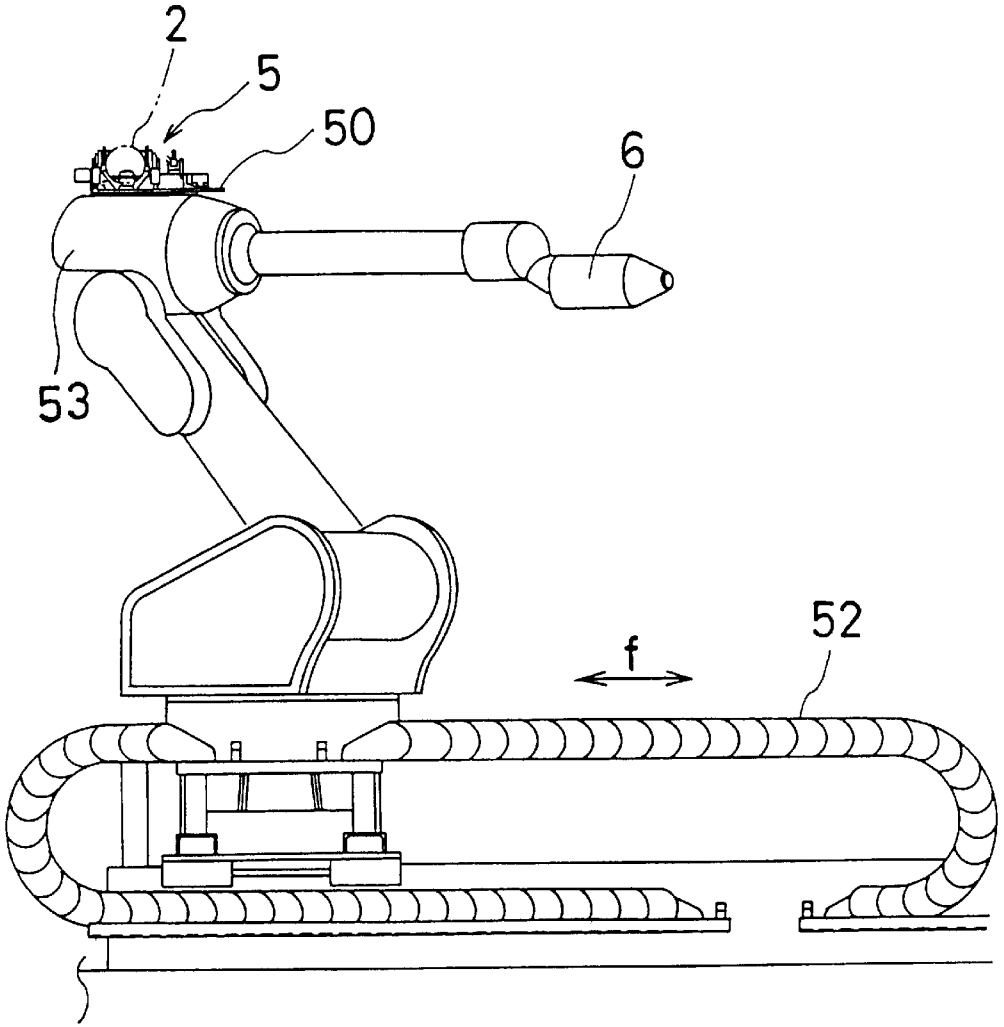
FIG. 13 is a frontal view showing an entire painting robot used in the multi-color small amount painting system according to the first embodiment.

As shown in FIGS. 13 and 2, the painting robot 1 is provided with a mechanism which may be reciprocatingly moved in a carrying direction f of the workpiece W by the conveyor mechanism (tracking mechanism) 52, swivel and deflect the painter 6 and may perform the automatic painting to the workpiece W by these motion operations.

Furthermore, as shown in FIG. 13, the painting robot 1 has on an upper surface of its head portion (the rear end portion of the second arm) 53 the loading area 50 on which the paint cartridge 2 may be loaded and is provided with the paint feeding mechanism 5 on a base plate 54 of the area 50.

As shown in FIG. 14, the paint feeding mechanism 5 is a mechanism for coupling with the paint cartridge 2, then extruding the paint contained in the paint cartridge 2 in the coupling condition and feeding to the painter 6 of the painting robot 1 through a paint path A when the paint cartridge 2 is loaded by the operation of the carrier 4 and is composed, as shown in FIGS. 15 to 18, of a fixing means 55 of the paint cartridge 2, a paint connector 56, an extruding means 57, a cleaning connector 58 and a joint means 59 for painting and cleaning. Incidentally, a paint color changing device (CCV) 66, a pressure sensor 67 and a flow rate regulating means (gear pump) 68 are connected to the paint path A to the painter 6.

Figure 17:
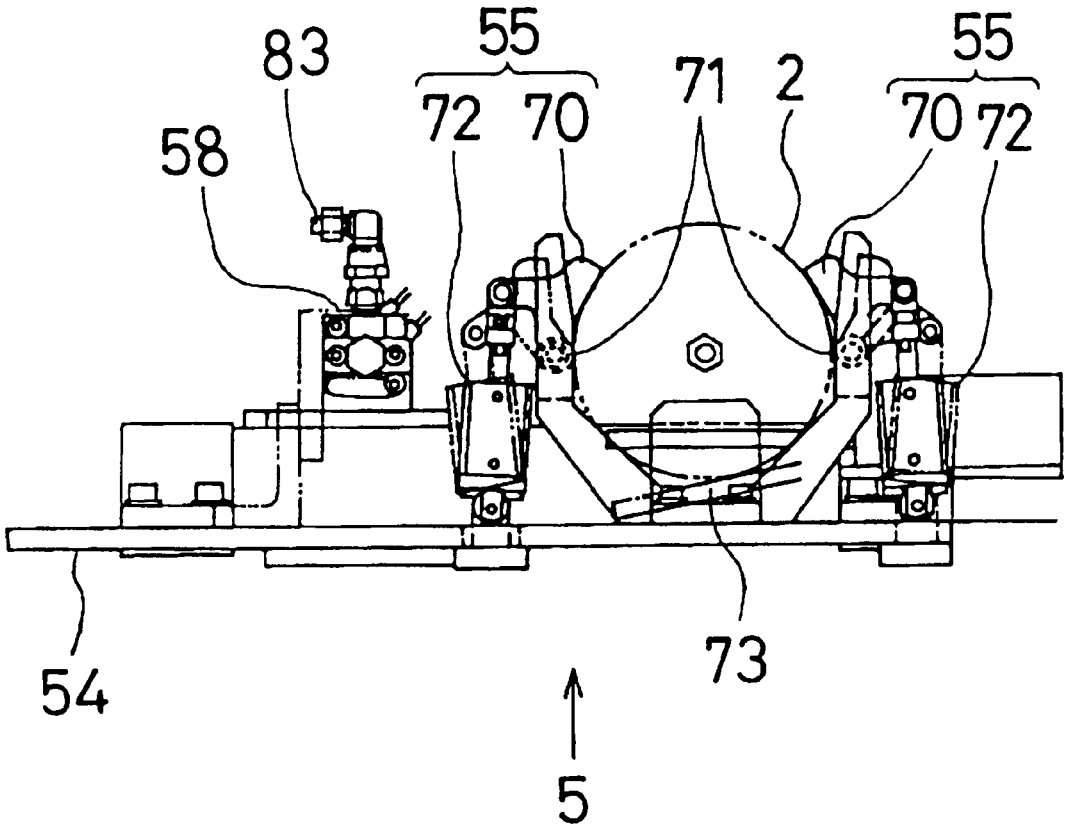
FIG. 17 is a view showing the paint feeding mechanism shown in FIG. 14, as viewed in a direction of an arrow S.

As shown in those drawings, the fixing means 55 is so constructed as to rotatably support fixing arms 70 about hinge pins 71 at peripheral portions of the loaded paint cartridge 2 (at front and rear and left and right four positions), cause air cylinder assemblies 72 to be connected to the fixing arms 70 and make it possible to rotate the fixing arms 70 and push the paint cartridge 2 by the arms 70 from above as shown in detail in FIG. 17 by the operation of the cylinder assemblies 72.

Accordingly, when the chuck means 32*a* and 32*b* of the carrier 5 are lowered and carry the griped paint cartridge 2 down to the loading position B within the painting robot 1, the loaded paint cartridge 2 is fixed and held at the loading position B by the operation of the fixing means 55. Incidentally, in FIG. 15, numeral 73 denotes a sensor for detecting whether or not the paint cartridge 2 is present in the loading position B. The information is fed to the controller of the multi-color small amount painting system.

The extruder means 57 is provided at the rear end side of the paint cartridge 2. The extruder means 57 is composed of a connector 74 into which the pressurized air is introduced through a feeding port and an air cylinder assembly 75 which moves the connector 74 in a direction of an arrow ±r (in FIGS. 15 and 18) and makes it possible to couple or decouple with the air inlet port 9 of the paint cartridge 2. The pressurized air is injected into the interior of the cartridge body 76 to crash the paint bag 7 within the paint cartridge 2 whereby the paint within the paint cartridge 2 may be extruded in a stable manner from the outlet portion 8 to the outside. In this case, in accordance with a magnitude of the pressure of the air to be injected into the paint cartridge 2, it is possible to stably regulate the flow rate of the paint to be discharged through the outlet portion 8 of the paint cartridge 2.

Figure 15:
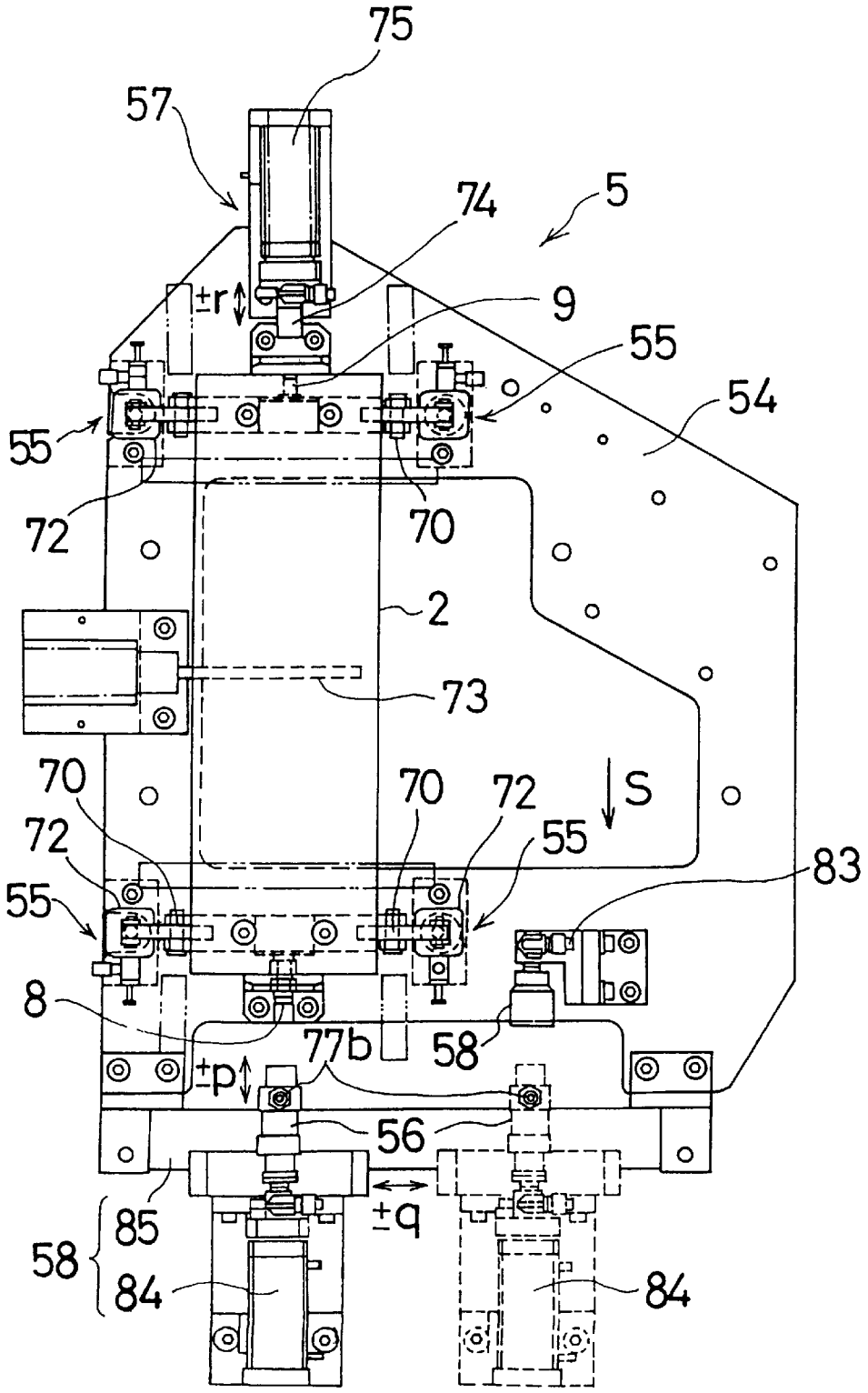
FIG. 15 is a plan view showing the paint feeding mechanism shown in FIG. 14.
Figure 16:
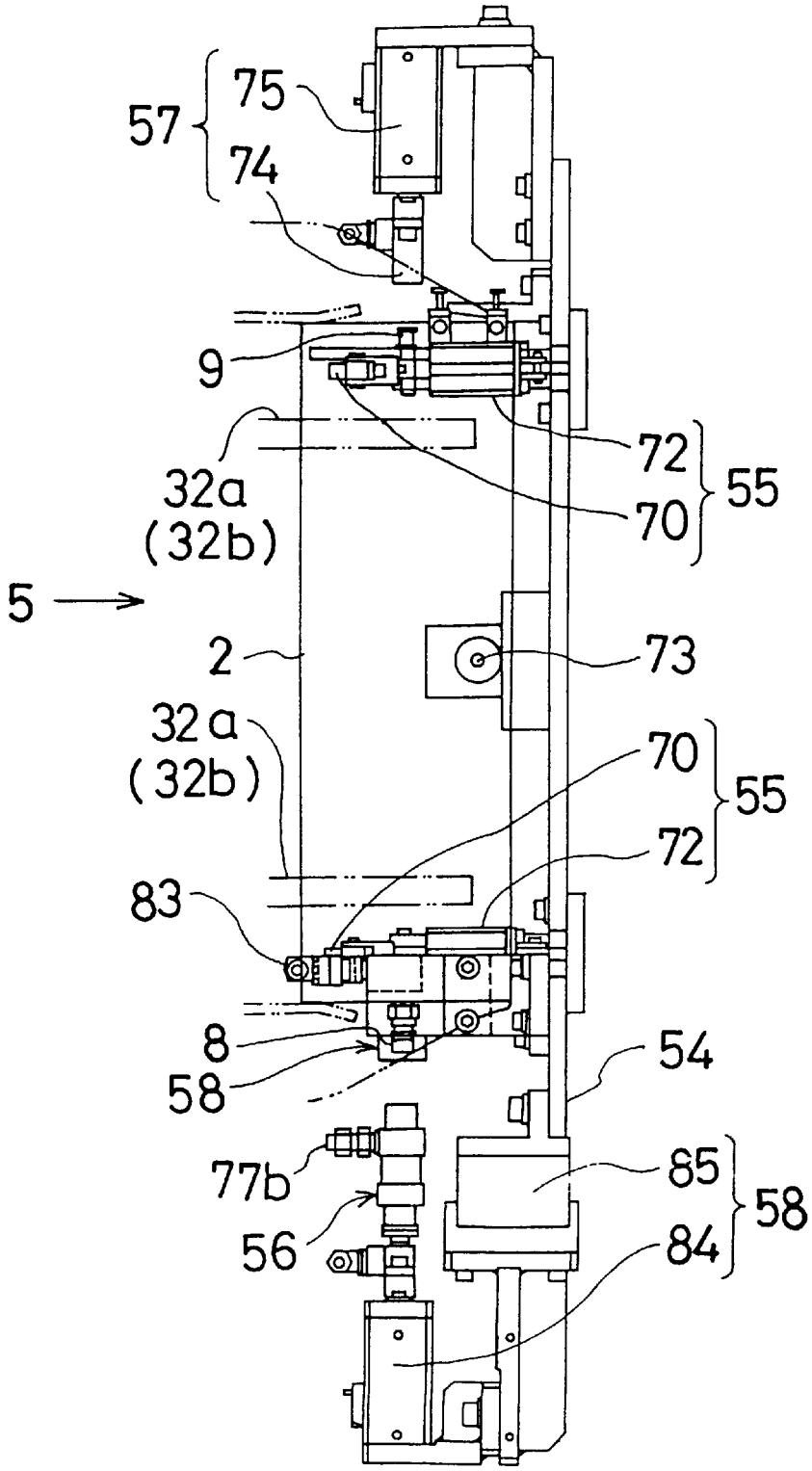
FIG. 16 is a frontal view showing the paint feeding mechanism shown in FIG. 14.

Also, as shown in FIG. 15, the paint connector 56 is provided at a front end side of the paint cartridge 2 to be loaded and the cleaning connector 58 is provided in a juxtaposed manner with the paint cartridge 2 in the vicinity of the loading position B.

Figure 19:
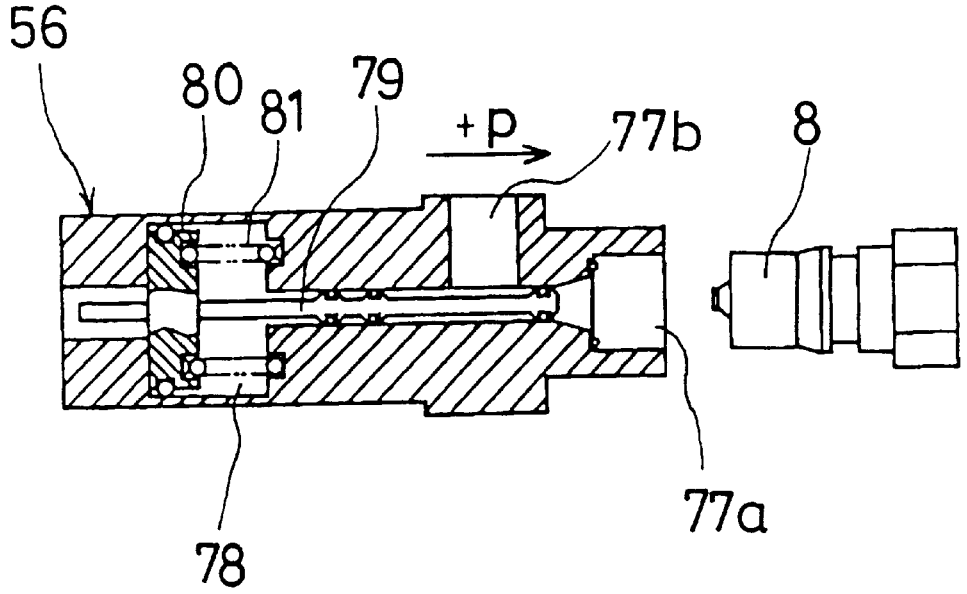
FIG. 19 is a view showing a process of connection between a paint connector and an outlet portion of the paint cartridge, used in the paint feeding mechanism shown in FIG. 14.
Figure 20:
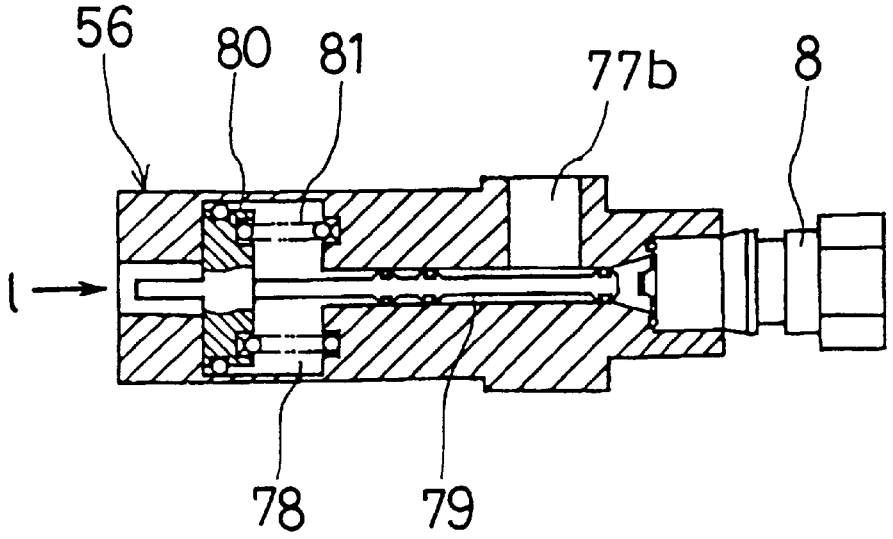
FIG. 20 is a view showing a process of connection between the paint connector and the outlet portion of the paint cartridge, used in the paint feeding mechanism shown in FIG. 14.
Figure 21:
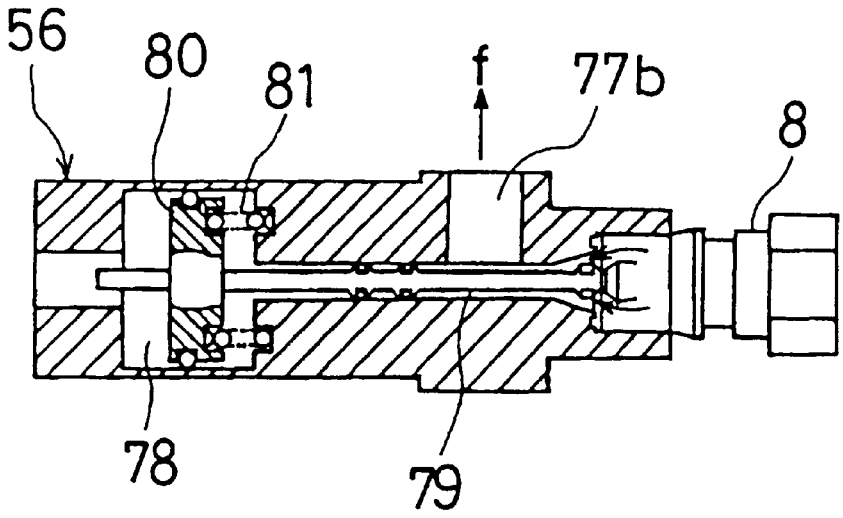
FIG. 21 is a view showing a process of connection between the paint connector and the outlet portion of the paint cartridge, used in the paint feeding mechanism shown in FIG. 14.

As shown in FIGS. 19 to 21, the paint connector 56 has a passage 77*a* extending from its tip end inwardly and a passage 77*b* extending on the side from the passages 77*a* and is provided in its internal cavity 78 with a needle valve having a piston, which is slidable in the longitudinal direction and whose tip end portion faces the passages 77*a* and 77*b*. A coil spring 81 is interposed between the piston portion 80 of the needle valve 79 and the inner wall of the paint connector 56 in the cavity 78. The above-described passage 77*b* is connected to the paint flow path A. Namely, the paint connector 56 is continuous to the painter 6 of the painting robot 1 through the paint flow path A. Accordingly, the outlet portion 8 of the paint cartridge 2 and the paint connector 56 take a structure in which the outlet portion 8 as the male engagement and the paint connector 56 as the female engagement may engaged with and disengaged from each other.

Figure 22:
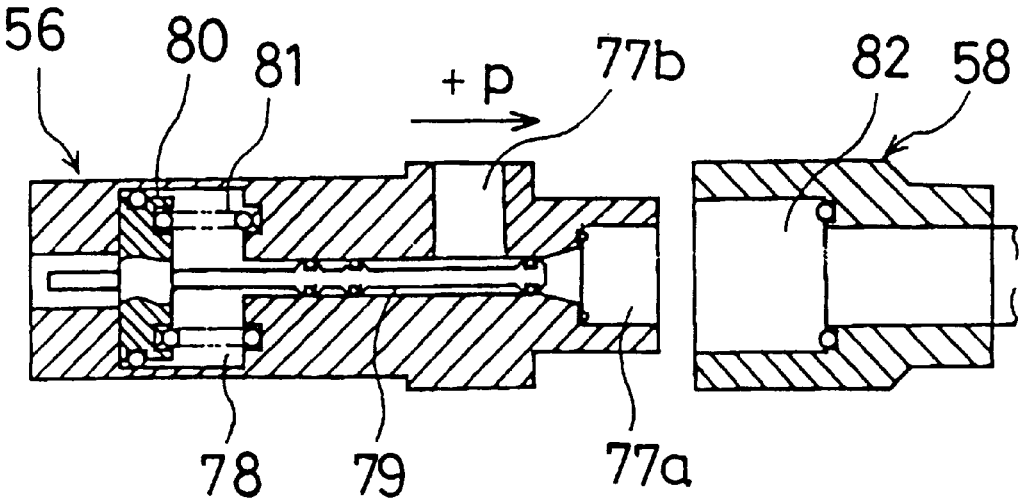
FIG. 22 is a view showing a process of connection between the paint connector and a cleaning connector, used in the paint feeding mechanism shown in FIG. 14.
Figure 23:
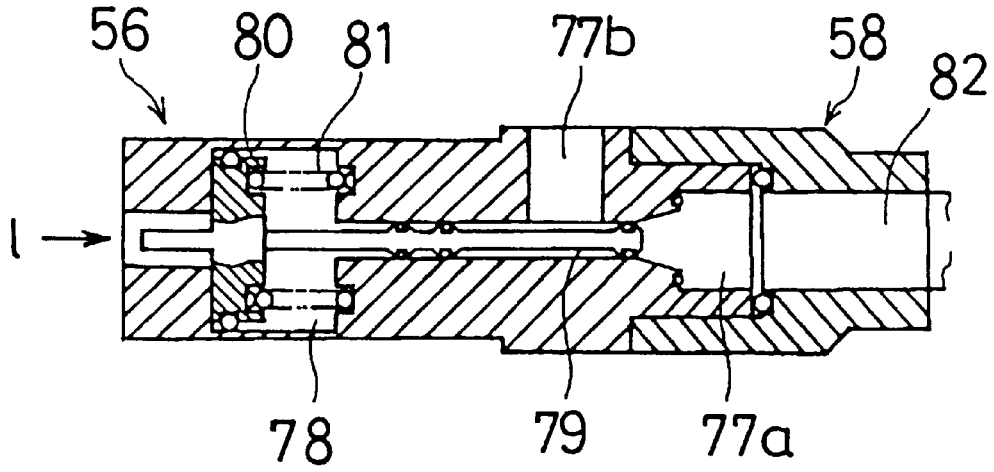
FIG. 23 is a view showing a process of connection between the paint connector and the cleaning connector, used in the paint feeding mechanism shown in FIG. 14.
Figure 24:
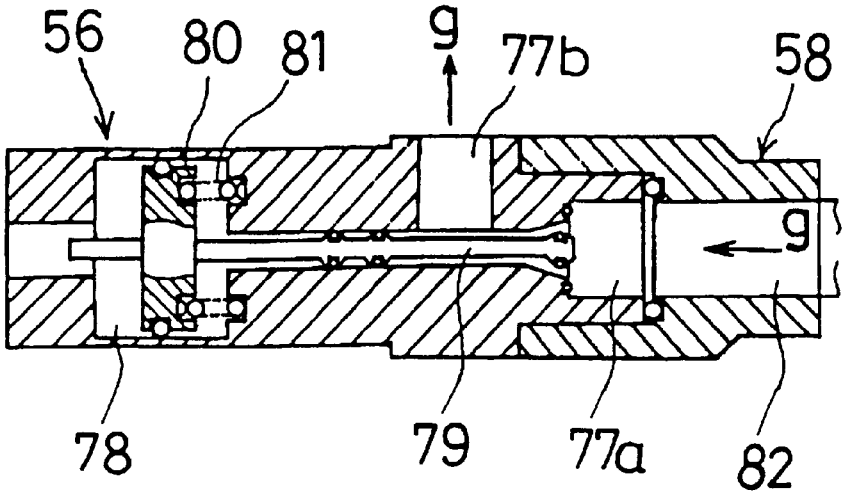
FIG. 24 is a view showing a process of connection between the paint connector and the cleaning connector, used in the paint feeding mechanism shown in FIG. 14.

Also, as shown in FIGS. 22 to 24, the cleaning connector 58 is a member having a passage 82 extending inwardly from its end. The passage 82 is continuous to cleaning thinner and air supply source (not shown) through a flow inlet port 83 (FIG. 15). As a result, the cleaning thinner and the air may be fed to the cleaning connector 58.

Accordingly, as shown in those drawings, the paint connector 56 as the male engagement and the cleaning connector 58 as the female engagement take a structure for engagement and disengagement with each other.

Also, this feeding mechanism 5 is provided with the joint means 59 for the painting and cleaning in cooperation with the painting connector 56 as shown in FIGS. 15 to 18. This joint means 59 is composed, in combination, of an air cylinder assembly 84 which may engage with or disengage from the outlet portion 8 of the paint cartridge 2 (and the cleaning connector 58), be connected to the paint connector 56 and move (approaching and separating) the paint connector 56 in a direction of an arrow ±p (in a direction close to the paint cartridge 2 (and in a direction away from the paint cartridge 2) and an air cylinder assembly 85 which may displace the paint connector 56 between a position to face the outlet portion 8 of the paint cartridge 2 and a position to face the cleaning connector 58 in a direction of an arrow ±q.

Accordingly, the paint connector 56 may be engaged with and disengaged from the outlet portion 8 of the paint cartridge 2 to face it by the operation of the cylinder assembly 84 and the paint connector 56 is displaced to the position to face the cleaning connector 58 by the operation of the cylinder assembly 85. Subsequently, the paint connector 56 may be engaged with or disengaged from the cleaning connector 58 by the operation of the cylinder assembly 84.

In brief, the paint cartridge 2 may be connected to the painter 6 by the engagement and disengagement between the paint connector 56 and the outlet portion 8 of the paint cartridge 2, and the cleaning thinner and air may be fed to the paint path A from the interior of the paint connector 56 by the engagement and disengagement between the paint connector 56 and the cleaning connector 58.

A series of operations of the present feeding mechanism 5 will now be described. When the paint cartridge 2 is carried to the loading position B within the painting robot 1 by the carrier 4, first of all, the fixing arms 70 are rotated to press the paint cartridge 2 from above to thereby fix and hold the paint cartridge 2 in the loading position B by the fixing means 55.

Subsequently, the connector 74 of the extruder means 57 is moved and coupled with the air inlet port 9 of the paint cartridge 2 by the operation of the air cylinder assembly 75. Simultaneously therewith, the paint connector 56 is moved to be coupled with the outlet portion 8 of the paint cartridge 2 by the operation of the cylinder assembly 84. Then, the pressurized air is injected into the interior of the body 76 of the paint cartridge 2 from the air inlet port 9 so that the paint contained in the paint cartridge 2 is extruded in a stable manner into the paint connector 56 from the outlet portion 8.

This operation will be described in more detail. First of all, the paint connector 56 is moved in the direction of +p (FIG. 19), and engaged with the outlet portion 8. At this time, the outlet portion 8 is in intimate contact with the passage 77*a*. Subsequently, the needle valve 79 (which has been closed in the initial stage) is moved in a direction of an arrow l to be open by the air pressure. Then, the needle valve 79 pushes the end of the outlet portion 8. When it is pressingly inserted into the outlet portion 8, a check valve (not shown) within the outlet portion 8 is opened (FIG. 21). Then, at the same time, the pressurized air is injected into the paint cartridge 2, so that the paint within the paint bag 7 is extruded to be discharged through the passages 77*a* and 77*b* to the paint flow path A from the outlet portion 8 as indicated by an arrow f.

In this case, since the outlet portion 8 of the paint cartridge 2 and the paint connector 56 are coupled with each other, with the outlet portion 8 serving as the male engagement and the paint connector 56 serving as the female engagement, there is no fear that the leakage of the paint would occur.

Thus, the paint that has flowed from the paint cartridge 2 is fed to the painter 6 through the color changing unit 66 and the gear pump 68 along the paint flow path A to thereby be automatically painted by the painting robot 1.

After the painting, the paint connector 56 releases the engagement with the outlet portion 8 of the paint cartridge 2 by the operation of the cylinder assembly 84. Then, the paint connector 56 is moved in the direction of +q to be displaced up to the position to face the cleaning connector 58 by the operation of the cylinder assembly 85. Subsequently, the paint connector 56 is moved to be coupled with the cleaning connector 58 by the operation of the cylinder assembly 84. Then, the cleaning thinner and/or air is fed into the interior of the paint connector 56 from the cleaning connector 58, and further introduced into the paint flow path A to thereby perform the cleaning operation of the flow path A. Incidentally, simultaneously with this operation, the engagement of the connector 74 and the air inlet port 9 is released by the operation of the air cylinder assembly 75.

This operation will now be described in greater detail. First of all, the paint connector 56 that has been displaced in the direction of +q is moved in the direction of +p (FIG. 22) and is engaged with the cleaning connector 58. In this case, the outer wall at the end portion of the paint connector 56 is in intimate contact with the passage 82 of the cleaning connector 58 (FIG. 23). Subsequently, the needle valve 79 (what has been closed in the initial stage) is moved in the direction 1 and opened by the air pressure (FIG. 24). Then, simultaneously, the cleaning thinner or air is fed into the interior of the paint connector 56 from the passage 82 to flow to the paint flow path A through the passages 77*a* and 77*b*.

In this case, since the paint connector 56 and the cleaning connector 58 are engaged with each other with the paint connector 56 serving as the male engagement and the cleaning connector 58 serving as the female connector, it is also possible to satisfactorily clean the entire passage 77*a* of the end portion of the paint connector 56.

Accordingly, in the present feeding mechanism 5, it is possible to automatically and stably feed the paint within the paint cartridge 2 loaded in the painting robot 1 and also to automatically clean the paint flow path A up to the painter 6.

As described above, in the painting system according to the embodiment, a large number of paint colors of the paint are stored in the stock unit 3 in a small unit amount (in the form of the paint cartridges 2), the paint cartridge 2 of a special paint color is taken from the color group from the stock unit 3 by the carrier 4, and the paint of the paint color is fed to the painter 6 of the painting robot 1 by the paint feeding mechanism 5 whereby the multi-color small amount painting for the workpiece W may be performed for the selected paint color.

In addition, in the painting system according to this example, it is possible to accelerate the exchange of the paint colors (reciprocation of the paint cartridge 2 by the carrier 4) with the painting operation of the painting robot 1, thus considerably enhancing the working efficiency of the multi-color painting.

Also, in the painting system according to this example, since the cartridge 2 is rotated and carried during the storage of the paint cartridge 2, the paint within the paint cartridge 2 is agitated so that the paint may be more homogeneously mixed.

Furthermore, in the painting system according to this example, the paint feeding path (recirculation system) for each paint color is not introduced into the working area of the painting robot 1. Accordingly, this never requires a large size equipment.

Embodiment 2

A multi-color small amount painting system in accordance with this embodiment is the multi-color small amount system according to the embodiment 1 to which a control system is added for each operation of the stock unit and the carrier. Accordingly, the painting system according to this embodiment has basically the same structure as the painting system according to the embodiment 1 except for the control system.

Accordingly, the following description will be given to the structure and advantageous effect different from those of the painting system according to the embodiment 1, and the explanation of the same structure and advantageous effect as those of the embodiment 1 will be omitted. Also, in the following description, the same reference numerals are used to designate the members or components as those of the painting system according to the embodiment 1.

Figure 29:
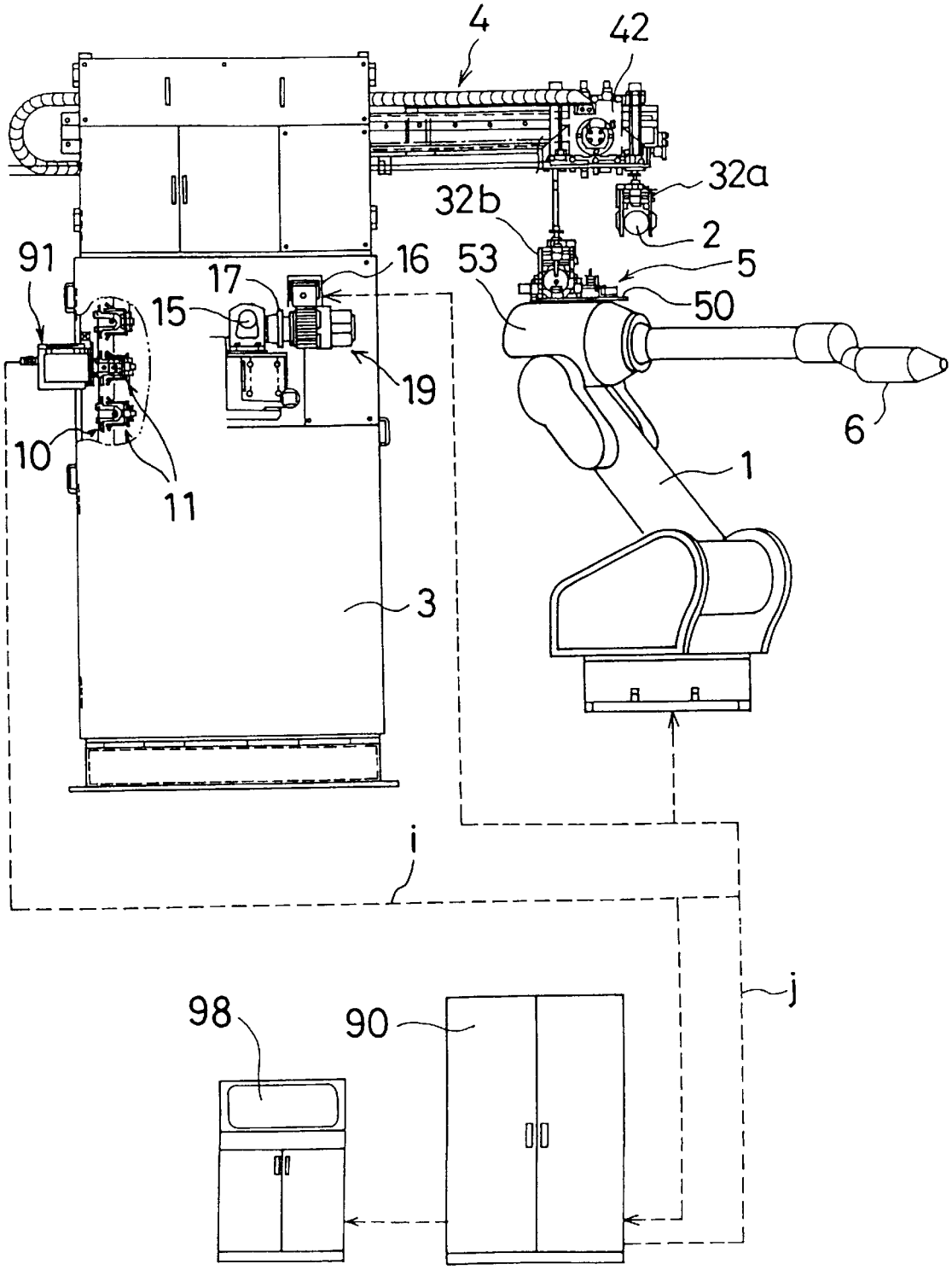
FIG. 29 is an overall view showing a multi-color small amount painting system according to a second embodiment.

As shown in FIG. 29, the painting system according to this example is provided with a total controller 90 for controlling the operation of each of the painting robot 1 (including the paint feeding mechanism 5), the stock unit 3 and the carrier 4.

Figure 30:
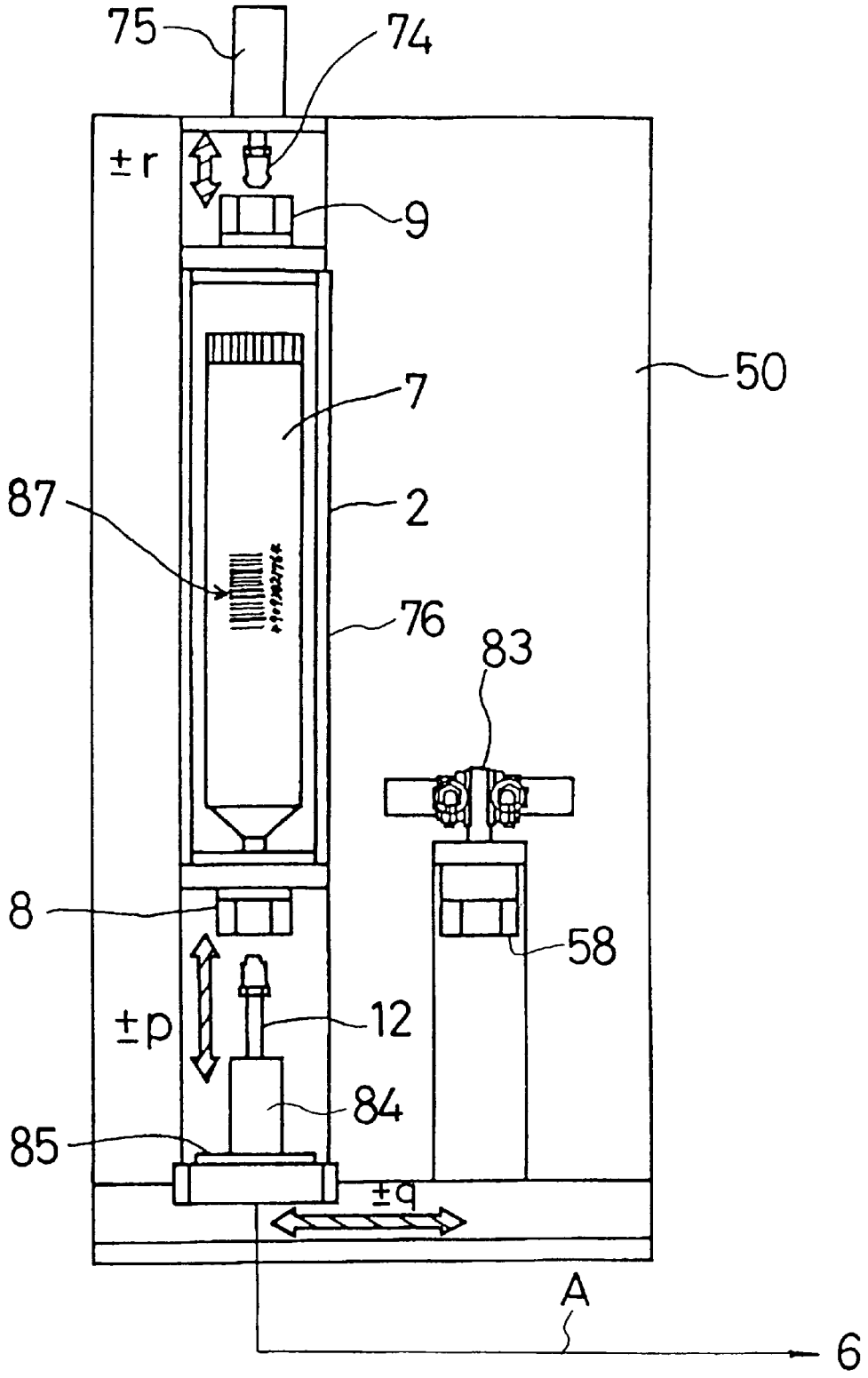
FIG. 30 is a schematic view showing a mounting area for a painting robot on which the painting cartridge to which an information recording member is added is mounted in the multi-color small amount mounting system according to the second embodiment.
Figure 32:
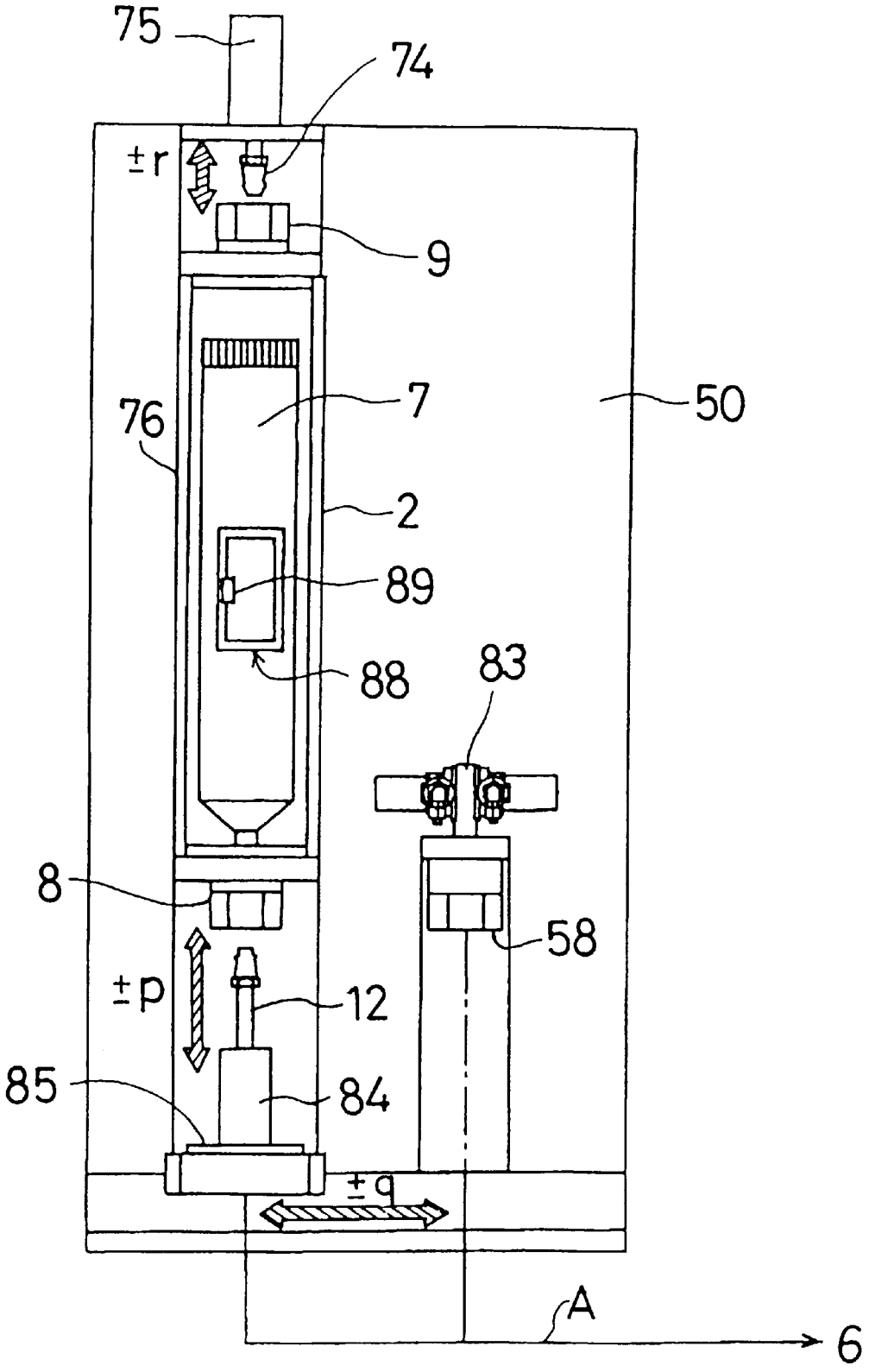
FIG. 32 is a view showing a state where the paint cartridge to which another information recording medium is added is mounted in the multi-color small amount system according to the second embodiment.

Also, for example, a bar code mark 87 as shown in, FIG. 30 or an IC card 88 as shown in FIG. 32 is added on an outer surface of each paint cartridge 2. The information recording medium 87 is a bar code mark obtained by binary coding painting information necessary for the automatic painting. Also, the information recording medium 88 is an IC card for recording the painting information necessary for the automatic painting onto an IC chip 89. The information recording media 87 and 88 are used to represent as binary data or record in an installed memory of the IC chip 89 the painting data such as a kind of color of paint filled in the painting cartridge 2, the date to load the paint cartridge 2 onto the stock unit 3 or to adjust the paint cartridge 2, a kind of the workpiece W to be painted, a range to be painted of an outer surface of the workpiece W, and a condition of the painting of the workpiece W (for example, an applied voltage to the workpiece W (in case of a static electric painter), an amount of discharged paint or a paint flow rate to the painter 6 (in other words, atomized air or an air pressure of pattern air), and an order of the painting (for example, an introduction route of the painter 6 for the workpiece W)). Incidentally, since, in general, the range and condition and the order are of the painting changed in accordance with the kind of the workpiece W, the painting data are determined individually for the kind of the workpiece W.

Figure 31:
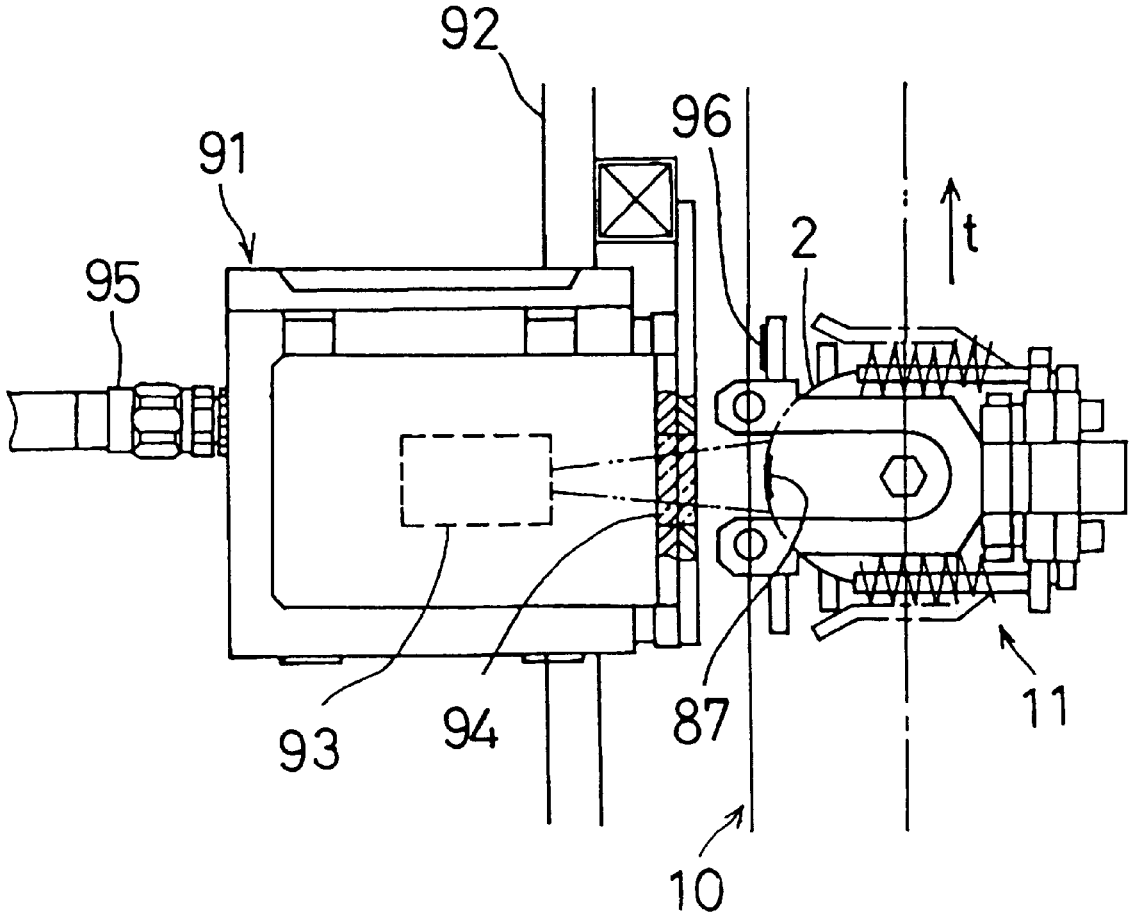
FIG. 31 is an enlarged view showing a readout means added to an endless conveyor mechanism in the multi-color small amount system according to the second embodiment.

As shown in FIG. 29, in the stock unit 3, a pressure durable explosion preventing type bar code reader 91 is added to the conveyor mechanism 10 as a readout means. Namely, as shown in FIG. 31 in detail, a box-shaped bar code reader 91 is fixed to an outer wall 92 of the stock unit 3. The bar code reader body 93 installed therein is disposed at a position to face the paint cartridge 2 held by the retaining means 11 along the conveyor path of the endless chain conveyor mechanism 10. In the reader 91, a transparent window 94 is provided on the side of the conveyor mechanism 10 and also a terminal 95 connected to the reader body 93 on the other side is coupled with the reader 91. The terminal 95 is connected to the total controller 90 through a wiring i as shown in FIG. 1.

Accordingly, the bar code reader 91 emits a laser beam (for example, He—Ne laser beam) toward the bar code mark 87 added on the outer circumferential surface of the paint cartridge 2 through the transparent window 94 from the reader body 93 and then introduces the reflective beam from the mark 87 to a light receiving sensor (not shown) to thereby optically read out the painting information (the information necessary for the automatic painting such as a paint color as described above).

Also, in this system, the bar code mark 96 representative of each address is added for the retaining means 11, 11, . . . within the stock unit 3 (FIG. 31), the above-described bar code reader 91 may optically read out the address information represented on the mark 96.

In short, the bar code reader 91 is so constructed as to read out the painting information represented by the bar code marks 87 and 96 of the information recording medium individually for each paint cartridge 2 inserted.

Figure 33:
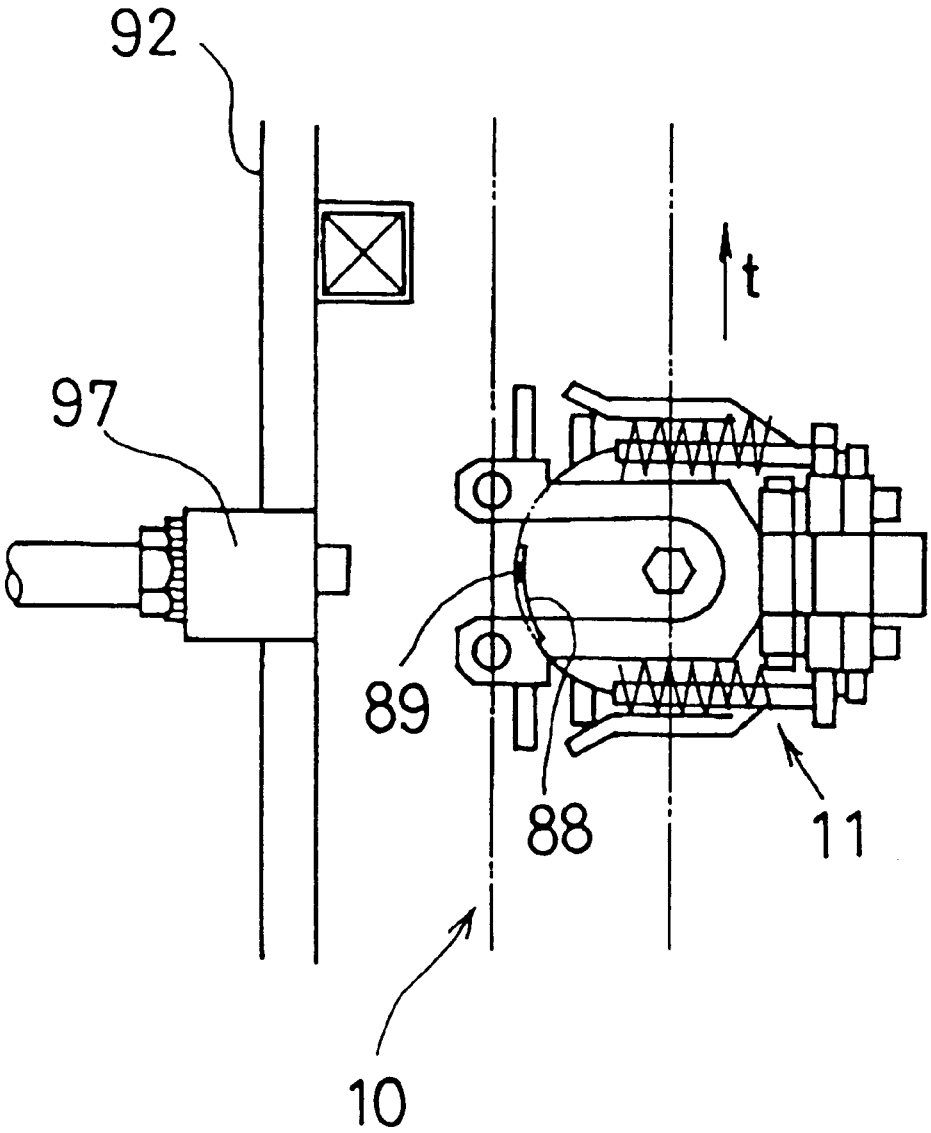
FIG. 33 is an enlarged view showing another readout means in the multi-color small amount painting system according to the second embodiment.

Also, in another example, as shown in FIG. 33, in the stock unit 3, the IC card readout unit is added to the conveyor mechanism 10 as the readout means; that is, a signal transmitter (having the pressure durable explosion preventing structure) 97 of the IC card readout unit is disposed and fixed to the outer wall 92 of the stock unit 3 at a position to face the paint cartridge 2 to be rotated and carried. This IC card readout unit is connected to the total controller 90 through the wiring i.

On the other hand, as shown in FIGS. 32 and 33, a thin IC card 88 made mainly of plastic is added to the paint cartridge 2. The IC chip 89 for recording the painting information is installed in the IC card 88.

Accordingly, the IC card readout unit may read out the painting information (the above-described information necessary for the automatic painting such as the paint color) recorded in the IC chip 89, i.e., the installed memory thereof by the wireless transmission with the IC card 88. Also, the recorded painting information may be canceled and new painting information is written therein.

In brief, the total controller 90 according to this system takes a structure in which the painting information recorded in the IC card 88 may be read out and integrated individually for each inserted paint cartridge 2 by the IC card 88 of the information recording medium.

Also, the total controller 90 is connected to the stock unit 3 through a wiring j. The painting information read out by the bar code reader 91 or the IC card readout unit is all integrated on the total controller 90. The total controller 90 controls the operation of the endless chain conveyor mechanism 10 for the stock unit 3 based on the inputted painting information. Namely, when the operator instructs the paint color to be painted to the controller 90 out of the about thirty paint cartridges 2, 2, . . . stored in the stock unit 3, the total controller 90 selects the paint cartridge 2 of the paint color to be painted out of the group of about thirty kinds of paint cartridges 2 stored. More preferably, in the case where a plurality of paint cartridges 2 having the same paint color are provided, the paint cartridge 2 which as an older adjustment date of the paint is selected. Then, the endless chain conveyor mechanism 10 is operated, and the operation of rotating and carrying the selected paint cartridge 2 to the pickup position (not shown) is performed.

The total controller 90 is connected also to the carrier 4 by the wiring j to control the overall carrier operation of the paint cartridge 2. Namely, the controller 90 carries out the following series of operations. When the carrier 42 is positioned on the stock unit 3 side, the chuck means 32*a* which has carried the used paint cartridge 2 is lowered to be close to the collection port (not shown) of the stock unit 3. Subsequently, the used paint cartridge 2 is released to be cast into the collection port. Thereafter, the chuck means 32*a* is raised and simultaneously therewith, the chuck means 32*b* is lowered to be close to the pickup position of the stock unit 3. Subsequently, the paint cartridge 2 of the color paint to be painted next is gripped and removed from the stock unit 3, and thereafter, the chuck means 32*b* is raised. Also, when the carrier 42 is located on the painting robot 1 side, the chuck means 32*a* is lowered to be close to the loading area 50 of the painting robot 1, grips the used paint cartridge 2 which has already been loaded thereon and picks it up from the painting robot 1. Thereafter, the chuck means 32*a* is raised, and subsequently, the chuck means 32*b* that has carried the paint cartridge 2 of the next paint color is lowered to be close to the loading area 50 of the painting robot 1. The chuck means 32*b* releases the paint cartridge of the color and loads it on the painting robot 1. Thereafter, the chuck means 32*b* is raised.

Also, the controller 90 is connected to the painting robot 1 by the wiring j to control the overall robot operation including the swivelling motion and deflection of the painter 6 in addition to the horizontal motion, and the operation of the paint feeding mechanism 5 for the painting robot 1.

As described above, the total controller 90 is a device for controlling the respective operations of the painting robot 1, the stock unit 3 and the carrier 4 and is further provided with a display device 98.

For the respective paint cartridges 2 loaded in the stock unit 3, all the painting information such as addresses, painting colors, dates, kinds of workpiece W and the painting data (range, condition, order and the like of the painting) read out by the bar code reader 91 or the IC card readout unit is stored in the total controller 90 and is to be displayed on the display device 98.

The display device 98 is provided with a circuit structure into which signals representative of the operational conditions of the painting robot 1, the stock unit 3 and the carrier 4 are inputted through the controller 90 in addition to the painting information. These are displayed on the display panel by the circuit structure. For example, the display device 98 may display on the panel in a table list manner all the paint cartridges 2 stored in the stock unit 3 and more preferably has a performance to display in color only the display area for the paint cartridge 2 of the paint color designated out of the table of the displayed paint cartridges when the desired paint color is designated by the key board input.

Then, the total controller 90 performs the following series of operations when the operator designates the kind of the paint color to be painted next or the kind of the workpiece W. First of all the total controller 90 selects the paint cartridge 2 of the paint color to be painted (or the paint color suitable for the subject workpiece W) out of the group of a number of cartridges 2, 2, . . . stored in the stock unit 3 in accordance with the integrated painting information, more preferably, selects the paint cartridge 2 having the older adjustment date or loading date, subsequently starts the operation of the conveyor mechanism 10 of the stock unit 3, carries and rotates the paint cartridge 2 of the paint color to be painted up to the pickup position, next starts the operation of the carrier 4, picks up the rotated and carried paint cartridge 2 from the stock unit 3 and carries it, loads it on the painting robot 1, next starts the operation of the painting robot 1, operates the paint feeding mechanism, feeds the paint contained in the loaded paint cartridge 2 to the painter 6, and at the same time, performs the automatic painting operation by the painting robot 1 for the workpiece W that is the object to be painted, in accordance with the special painting data for the selected paint cartridge 2. Accordingly, a coating film of the paint color to be painted is formed at a predetermined thickness on a predetermined part of the surface of the workpiece W by the automatic painting operation using the present system.

Furthermore, after the painting operation has been completed for the paint cartridge 2 of certain paint color, the total controller 90 also controls a series of the operations of starting the operation of the carrier 4, removing the used paint cartridge 2 from the painting robot 1, carrying it up to the stock unit 3, and collecting the used paint cartridge 2 to the collection mechanism (not shown) of the stock unit 3.

Accordingly, the painting system according to this embodiment may perform the multi-color small amount painting corresponding to a variety of parameters of the workpiece W including the paint color for the individual workpiece W.

In particular, by displaying all the information concerning the automatic painting of the workpiece W on the display device 98, it is possible to visually supervise the painting process and to issue a necessary command as desired timing to considerably facilitate the administration of the painting operation.

Embodiment 3

A multi-color small amount painting system in accordance with this embodiment has basically the same structure as that of the multi-color small amount painting system according to the embodiment 1 except for the stock unit. Accordingly, the paint cartridge and the painting robot have the same structures as those of the embodiment 1. Also, the carrier has the same structure as that of the embodiment 1 except for the point that a pair of chucks of the chuck means for picking up the paint cartridge from the stock unit are additionally provided with the function to rotate horizontally.

Figure 34:
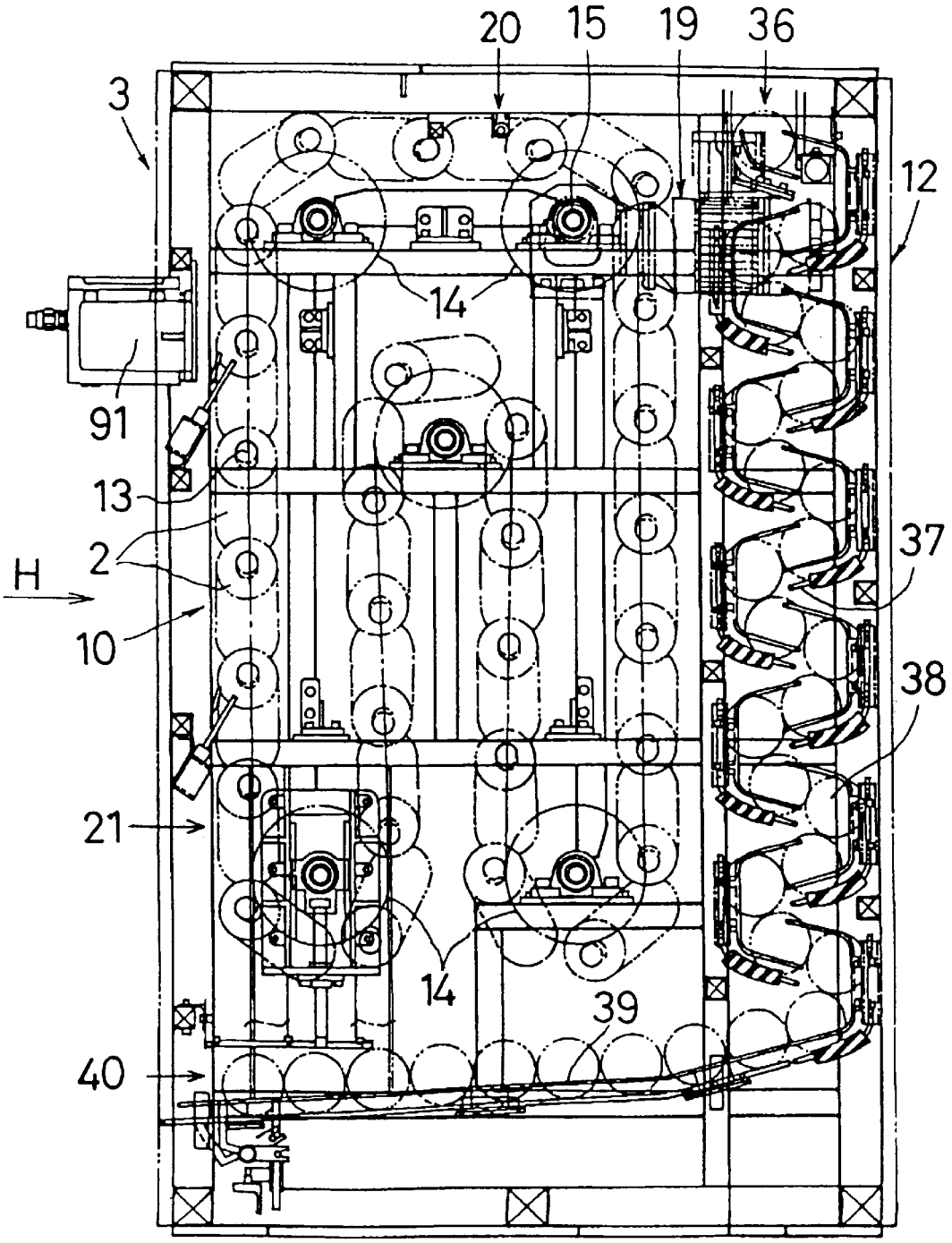
FIG. 34 is a schematic frontal view showing an interior of a stock unit in a multi-color small amount painting system according to a third embodiment.
Figure 35:
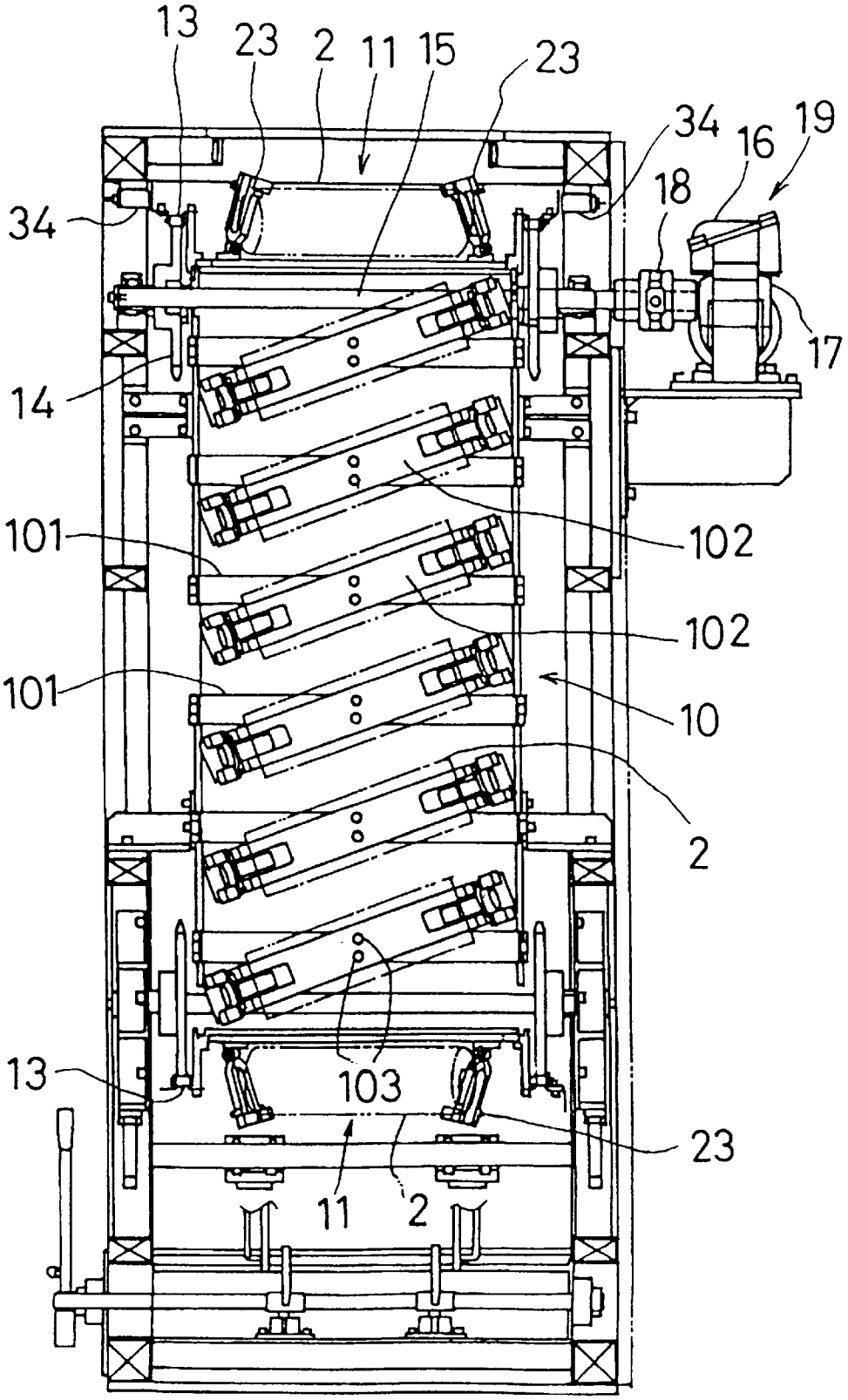
FIG. 35 is a side elevational view of the stock unit shown in FIG. 34 as viewed from side.
Figure 36:
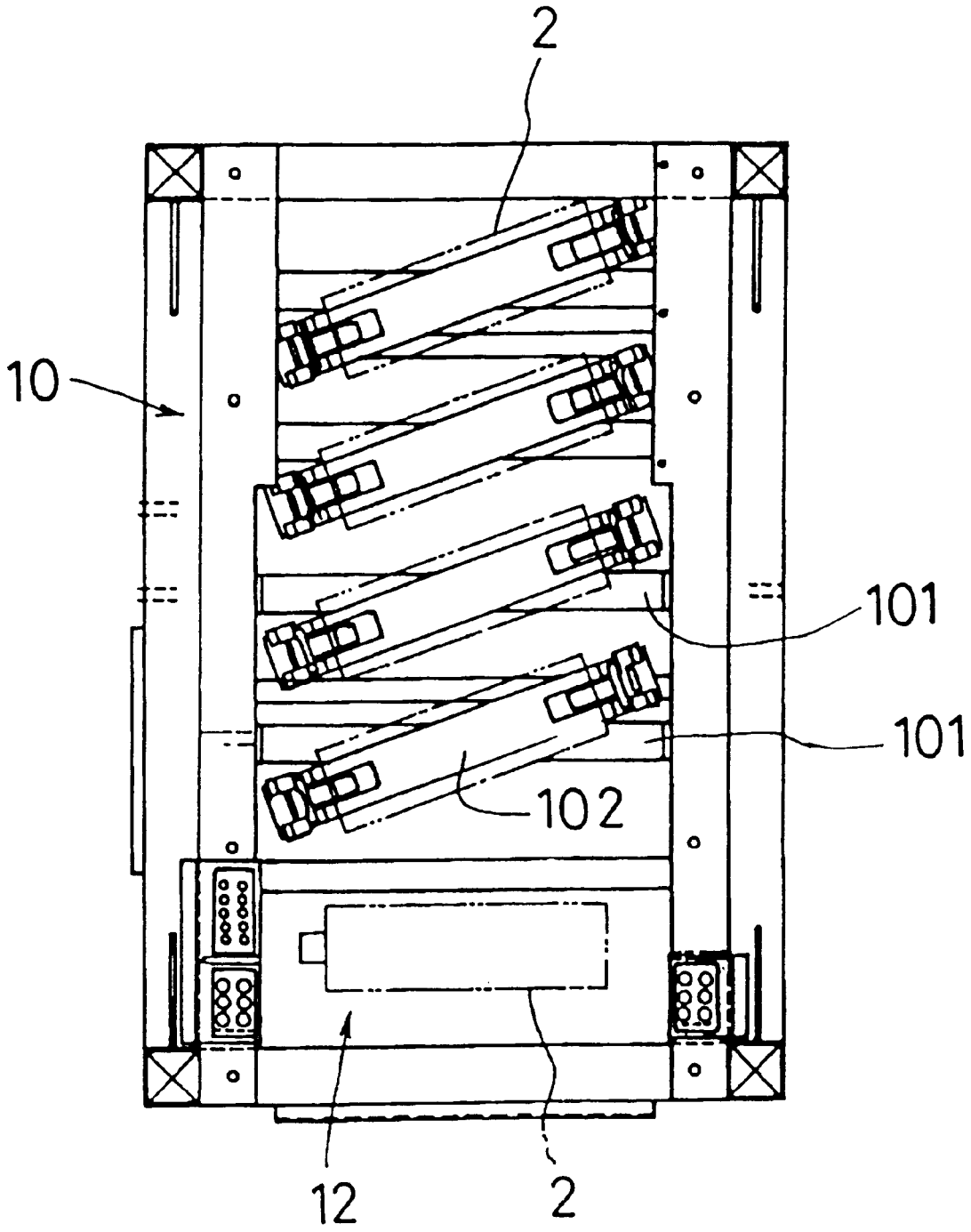
FIG. 36 is a view of the stock unit shown in FIG. 34 as viewed from above.

The stock unit of this example is shown in FIGS. 34 to 36. Incidentally, in these drawings, the members or components of the stock unit 3 corresponding to the members or components of the stock unit 3 of the embodiments 1 and 2 are designated by the same reference numerals or characters as used in the embodiments 1 and 2.

As shown in these drawings, in the stock unit 3, a pair of right and left endless chains 13 and 13 are provided in parallel, and a number (about 30) of retaining means 11, 11, are mounted obliquely on conveyor plates 101, 101, . . . between these chains 13 and 13. Namely, base plates 102, 102, . . . of the retaining means 11 are fixed so as to intersect obliquely to the conveyor plates 101, 101, . . . of the endless chain conveyor mechanism 10 and to be in parallel with each other, respectively. In FIGS. 35 and 36, numeral 103 denotes fixed positions of the base plates 102. The other structure of the endless chain conveyor mechanism 10 such as the retaining means 11 composed of the right and left retainer arms 23 and 23 and the collection mechanism 12 have the same structures as those of the embodiment 1.

Also, in FIG. 34, numeral 91 denotes a bar code reader added to the endless chain conveyor mechanism 10. The reader 91 may read out the bar code (representative of the paint color or the like) added on the outer circumferential surface of the paint cartridge 2.

The controller (not shown) of the conveyor mechanism 10 has a structure which drives the conveyor mechanism 10 on the basis of the information such as the paint color or the like read out by the bar code reader 91 for a number (about 30) of paint cartridges 2, 2, . . . stored within the stock unit 3, picks up the paint cartridges 2 and rotates and carries the paint cartridges 2 of the paint color to be picked up to the pickup position.

Accordingly, it is possible to store a large number (about 30) of paint colors also in the multi-color small amount painting system according to this embodiment. When the paint color to be painted is designated in the controller, in accordance with its control, the endless chain conveyor mechanism 10 is operated, the paint cartridge 2 of the paint color is rotated and carried up to the pickup position, subsequently, the paint cartridge 2 of the paint color is gripped at the pickup position by the carrier 4, taken from the stock unit 3 and loaded on the painting robot 1 through the lowering movement and the elevating movement of the chuck means 32*a* and 32*b*, the horizontal movement of the carrier member 42 and the lowering movement and elevating movement of the chuck means 32*a* and 32*b*, and then the paint within the paint cartridge 2 may be fed into the painter 6 by the paint feeding mechanism 5. Accordingly, in the present system, the automatic painting operation may be performed by the painting robot 1 in a small unit amount using the paint of the selected paint color. In addition, after the completion of the painting operation, the collection of the used paint cartridge 2 to the stock unit 3 may be carried out by the painting robot 1.

Moreover, the stock unit 3 holds the respective paint cartridges 2, 2, . . . obliquely to the respective conveyor plates 101. During the rotational carrying of the respective paint cartridges 2 stored, the paint cartridges 2 are rotated about their axes and moved up and down and swung while keeping the oblique posture to the horizontally held conveyor plates 101 so that the front end and the rear end of each cartridge are displaced with each other in the vertical relationship. Accordingly, in comparison with the system according to the embodiment 1, it is possible to more effectively agitate the paint within the paint cartridge 2.

Figure 37:
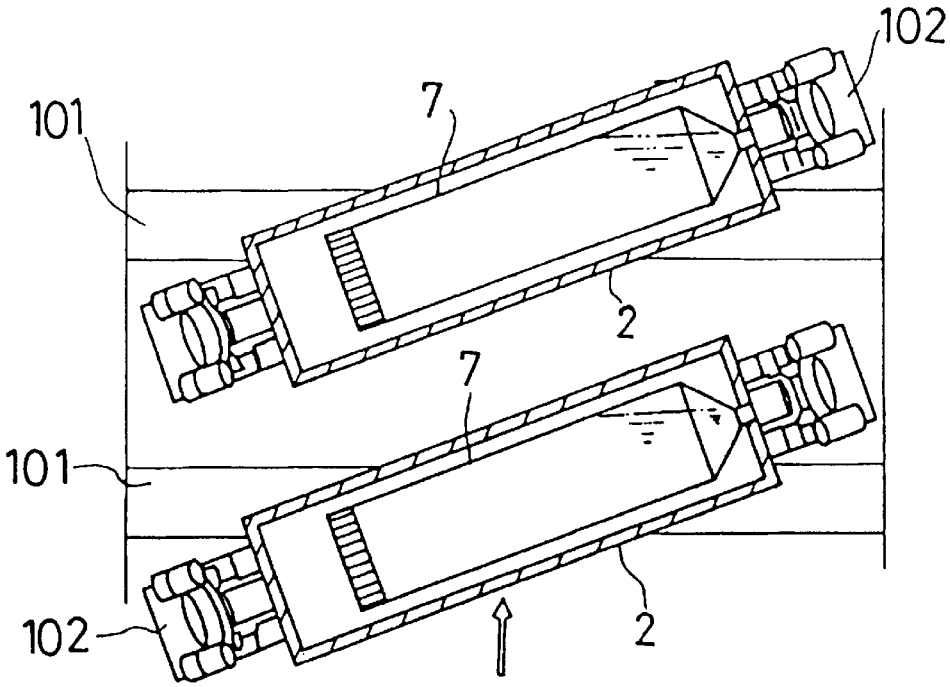
FIG. 37 is a view showing an inner condition of a paint cartridge when the paint cartridge is moved upwardly rotating in the stock unit shown in FIG. 34.
Figure 38:
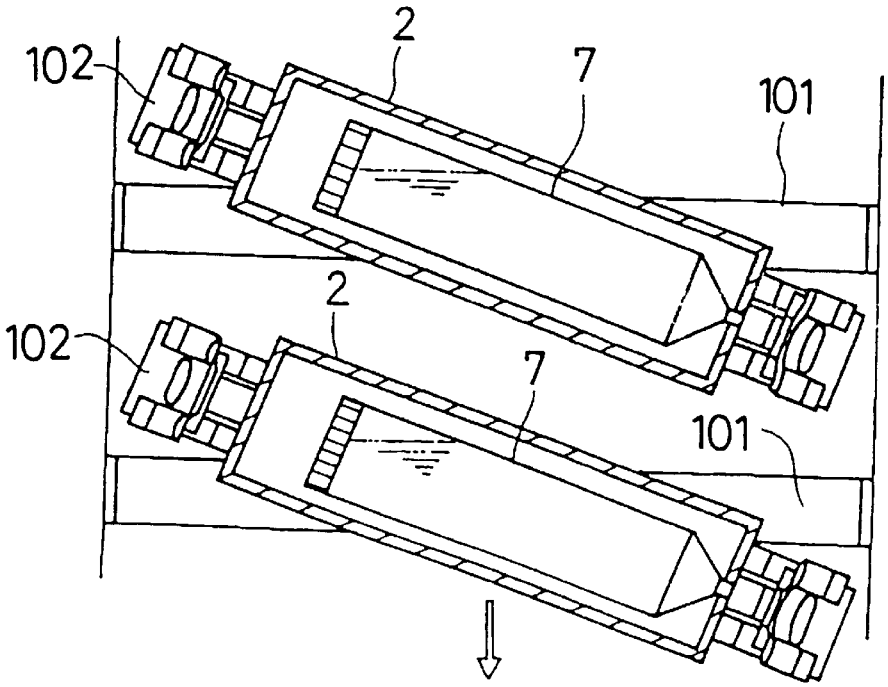
FIG. 38 is a view showing an inner condition of the paint cartridge when the paint cartridge is moved downwardly rotating in the stock unit shown in FIG. 34.

For instance, in the case where a small amount of air is injected into the paint bag 7 of the paint cartridge 2, when the paint cartridge 2 is rotated and carried upwardly as shown in FIG. 37, the air within the paint bag 7 is gathered close to the front end of the paint cartridge 2, and inversely when the paint cartridge 2 is rotated and carried downwardly as shown in FIG. 38, the air within the paint bag 7 is gathered close to the rear end of the cartridge 2.

Thus, the paint cartridge 2 is rotated and carried and the air injected thereinto is shifted in the interior of the paint cartridge 2 so that the paint contained in the interior may be more effectively agitated. Incidentally, in the case where instead of the small amount of air, glass balls or steel balls are inserted into the interior of the paint bag 7 of the paint cartridge 2, the same effect is ensured.

Embodiment 4

A multi-color small amount painting system according to this embodiment has basically the same structure as the multi-color small amount painting system according to the embodiment 1 except for the partition chamber to be described later or the like. Accordingly, the following description will be given to the structure and advantageous effect different from those of the painting system according to the embodiment 1, and the explanation of the same structure and advantageous effect as those of the embodiment 1 will be omitted. Also, in the following description, the same reference numerals and characters are used to designate the same members or components as those of the painting system according to the embodiment 1.

Figure 39:
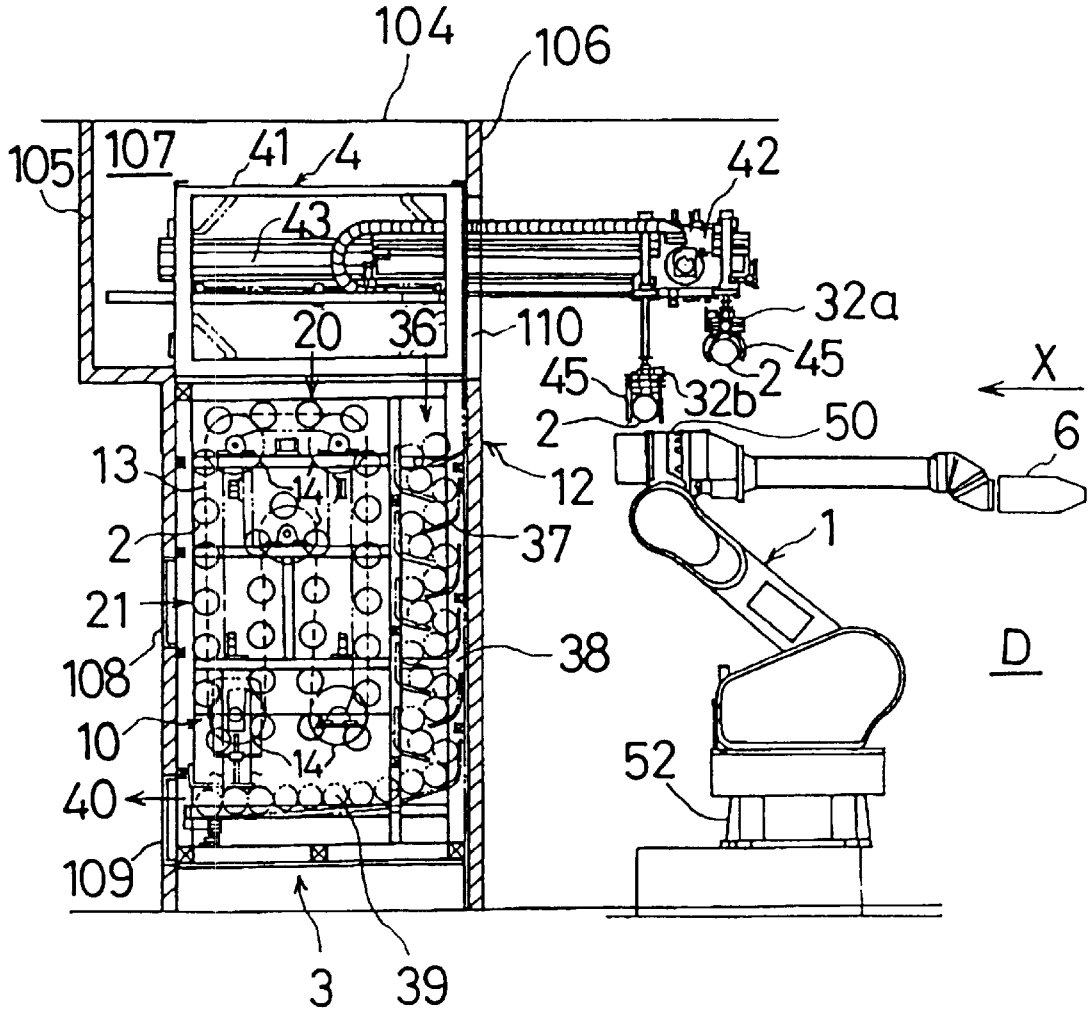
FIG. 39 is a frontal view showing a multi-color small amount painting system in accordance with a fourth embodiment.
Figure 40:
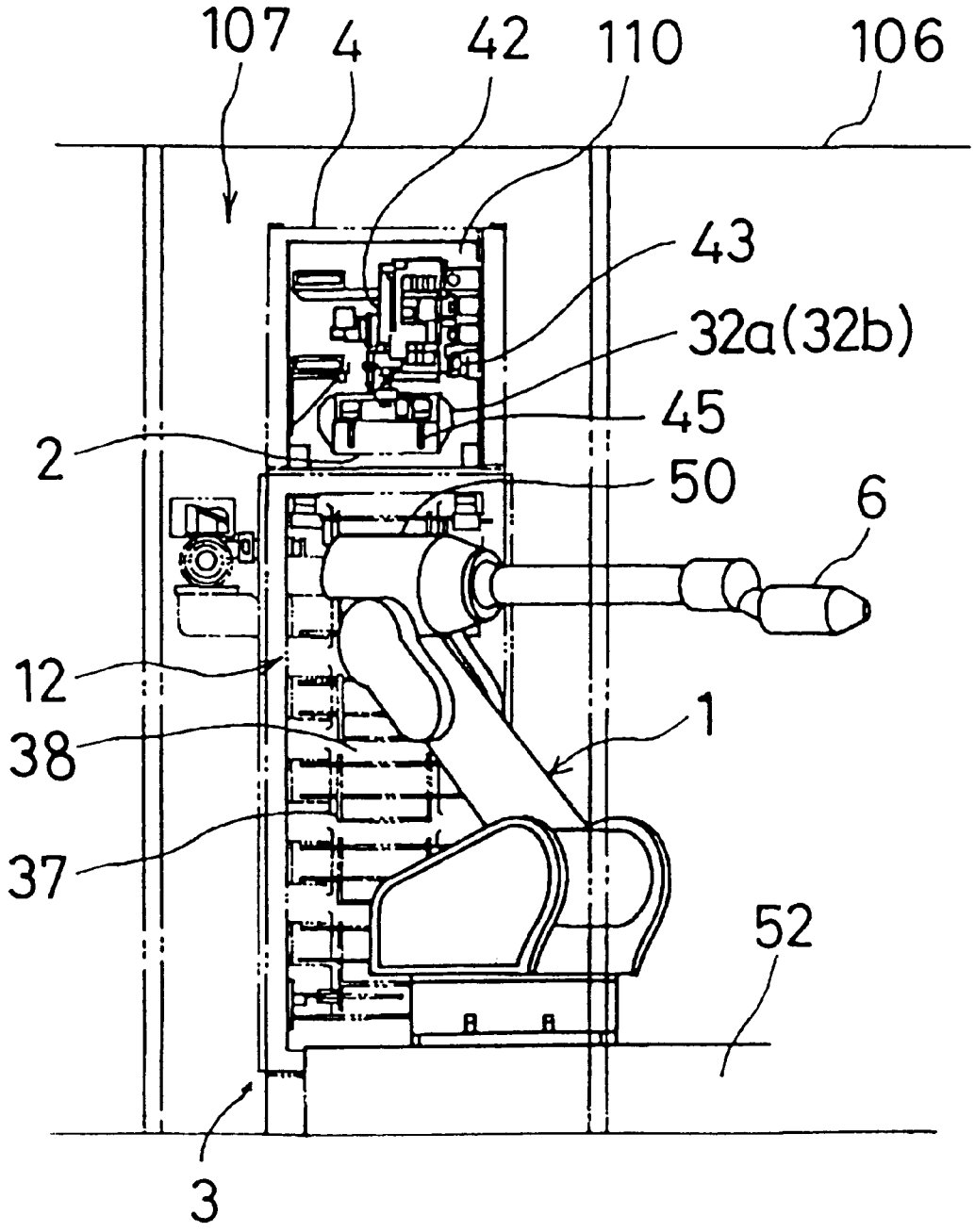
FIG. 40 is a view of the multi-color small amount painting system shown in FIG. 39 as viewed from a direction of X of FIG. 39.
Figure 41:
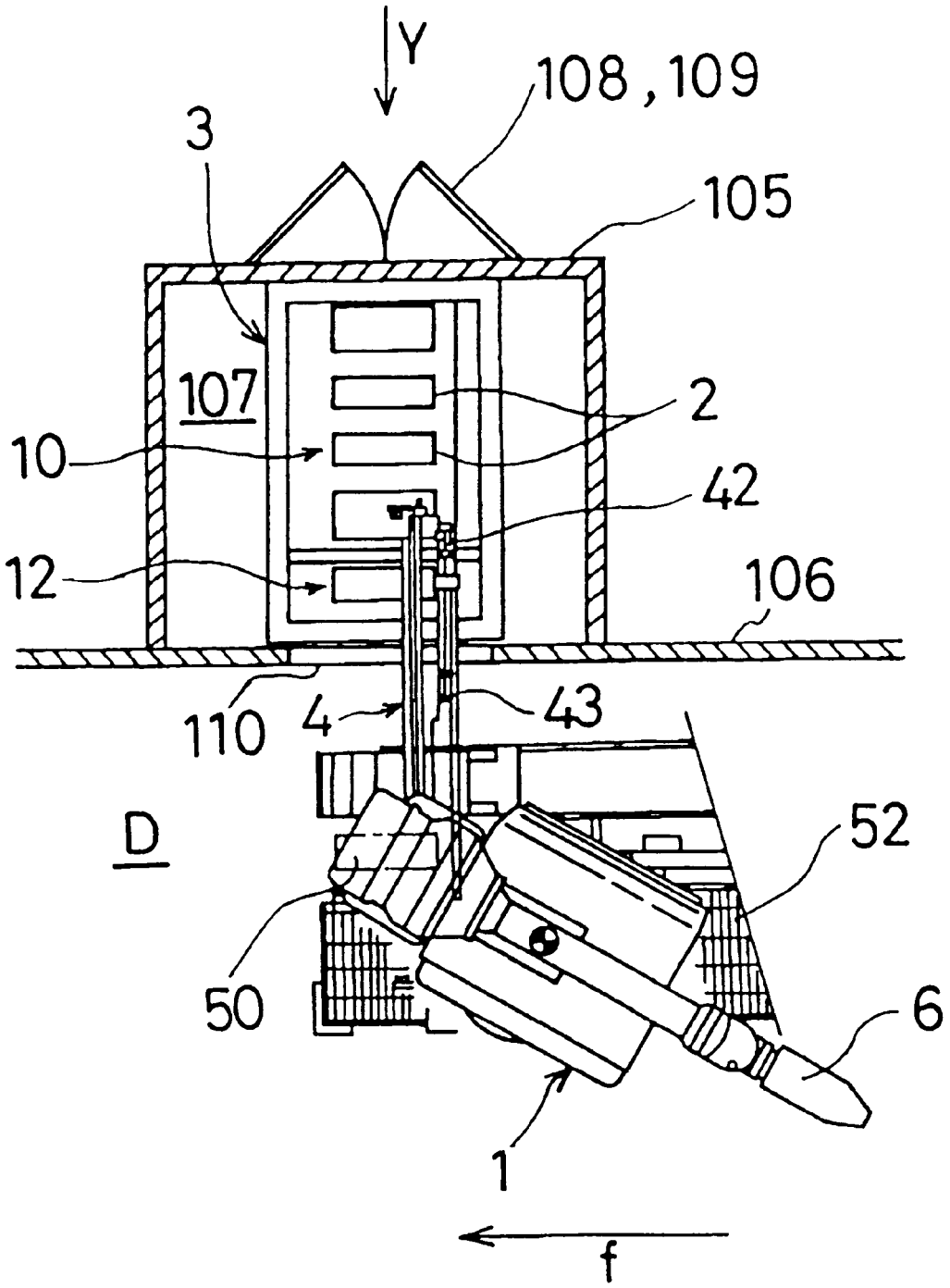
FIG. 41 is a view showing the multi-color small amount painting system shown in FIG. 39 as viewed from above (a driver for the stock unit being omitted)

As shown in FIGS. 39 and 41, the painting robot 1 is disposed in the vicinity of a booth internal wall 106 of the painting booth D and may be reciprocated in a direction f of the carrying of the workpiece W by the tracking mechanism 52. Also, it is provided with a mechanism for swivelling and deflecting the painter (bell-type static electric painter) 6. With such an operation, it is possible to perform the automatic spray painting to the workpiece in accordance with a predetermined painting program.

The stock unit 3 is received in the partition chamber 107 as shown in FIGS. 39 to 42. The partition chamber 107 is a chamber for surrounding the stock unit 3 and is located at a position to face the interior of the painting booth D outside of the painting booth D. Accordingly, the partition chamber 107 is composed of a ceiling wall 104 and three side walls 105. . . for partitioning the interior of the partition chamber 107 from the outside of the painting booth D in addition to the booth inner wall 106.

Also, in the carrier 4, the guide rail 43 for reciprocatingly supporting the carrier member 42 is provided over the painting robot 1 and the over the stock unit 3 through a window 110 formed in the booth inner wall 106 (FIG. 39).

Figure 42:
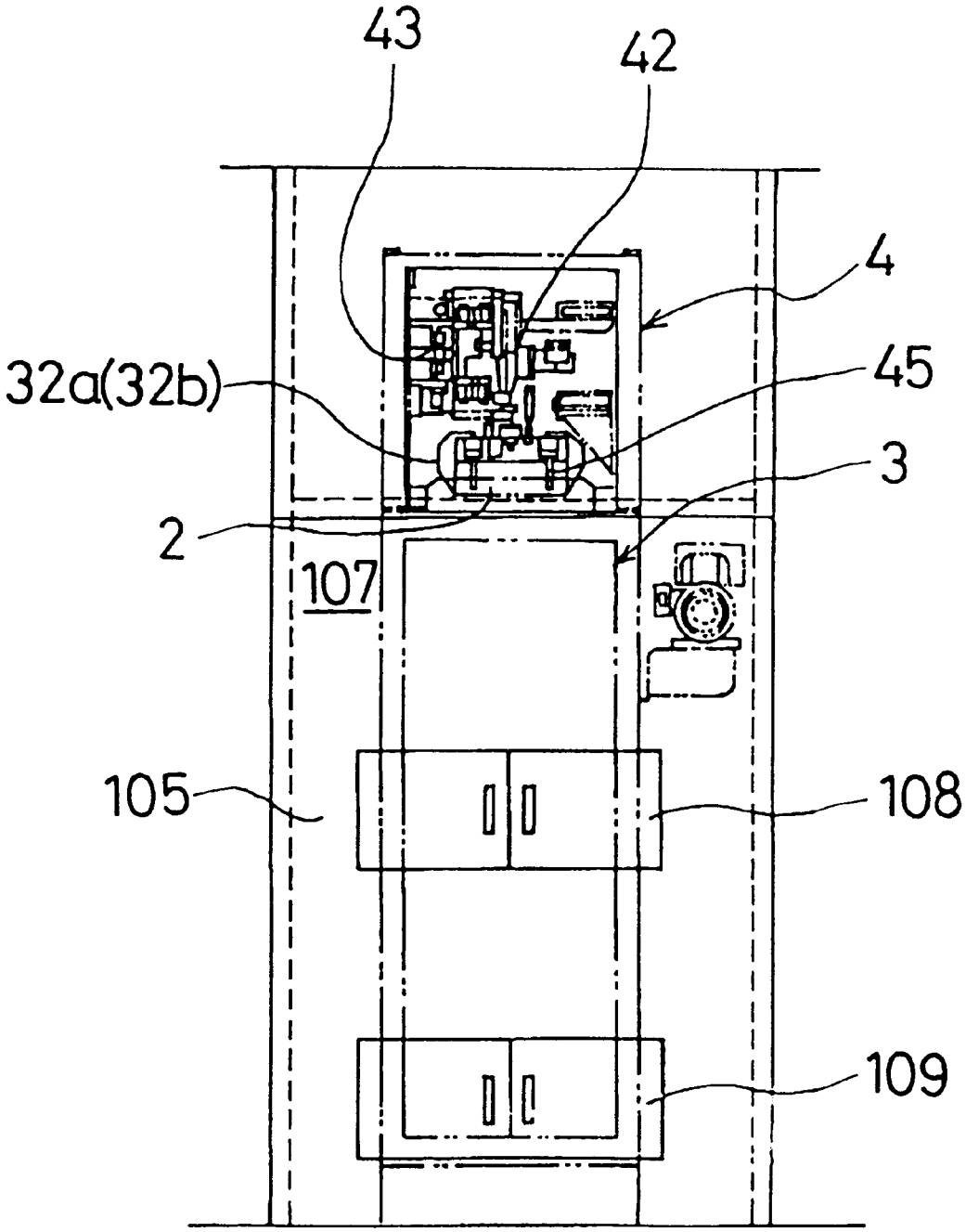
FIG. 42 is a view showing an interior of a partitioned chamber of the multi-color small amount painting system shown in FIG. 39 as viewed in a direction of Y of FIG. 39.

Furthermore, two working doors 108 and 109 are provided on the side wall 105 on the opposite side to the painting booth D of the partition chamber 107 (FIG. 42). The upper working door 108 is used for loading a new paint cartridge from the outside of the painting booth D and is provided at a position corresponding to the loading position 21. The lower working door 109 is used for taking a collected paint cartridge 2 from the outside of the painting booth D and is provided at a position corresponding to the pickup position 40. Incidentally, each of the working doors 108 and 109 has a high sealability to avoid the leakage of the atmosphere within the painting booth D when either of the working doors 108 and 109 is closed.

Accordingly, in the painting system according to this embodiment, the stock unit 3 is received in the partition chamber 107 provided with the working doors 108 and 109. As a result, for the work of maintenance and administration, the operator only opens the working doors 108 and 109 without any necessity for him or her to enter the painting booth D so that the collected and used paint cartridge 2 may be taken out from the stock unit 3 and a new paint cartridge 2 may be loaded in the stock unit 3.

Embodiment 5

Figure 43:
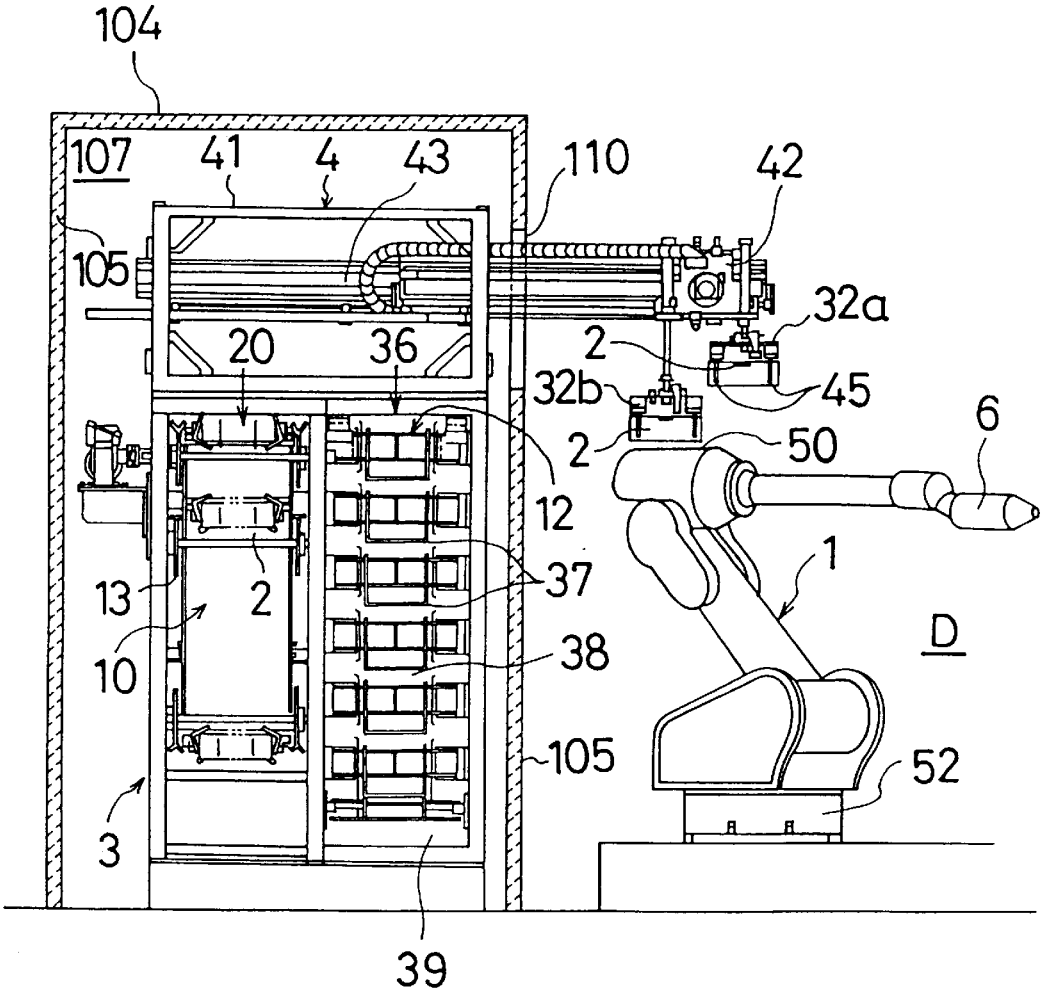
FIG. 43 is a frontal view showing a multi-color small amount painting system in accordance with a fifth embodiment.
Figure 44:
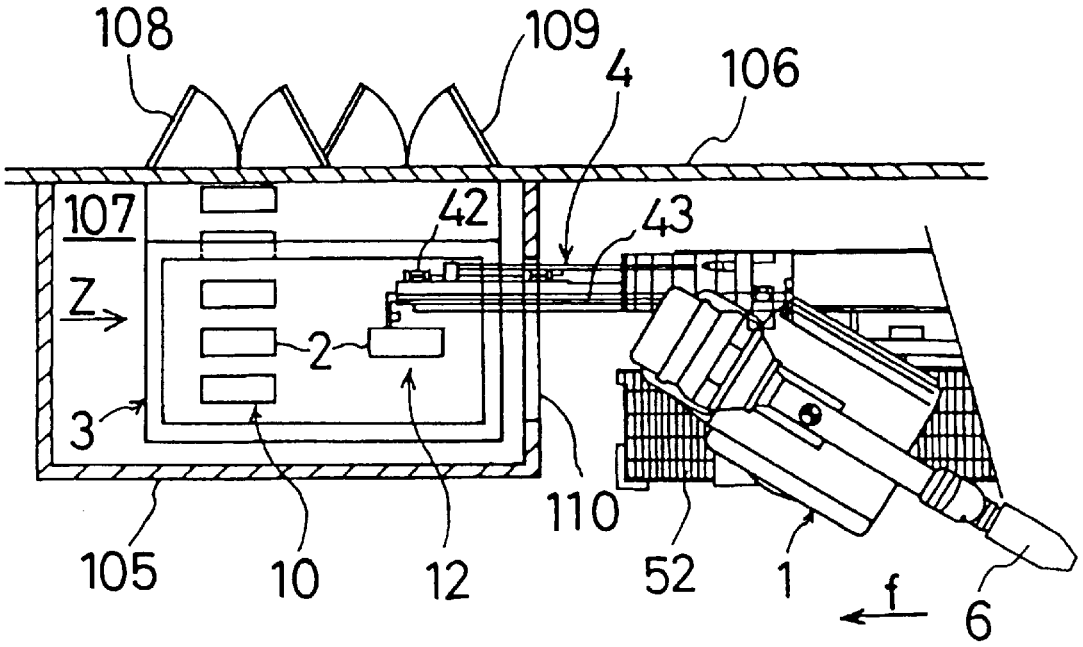
FIG. 44 is a view showing the multi-color small amount painting system shown in FIG. 43 as viewed from above (a driver for the stock unit being omitted)
Figure 45:
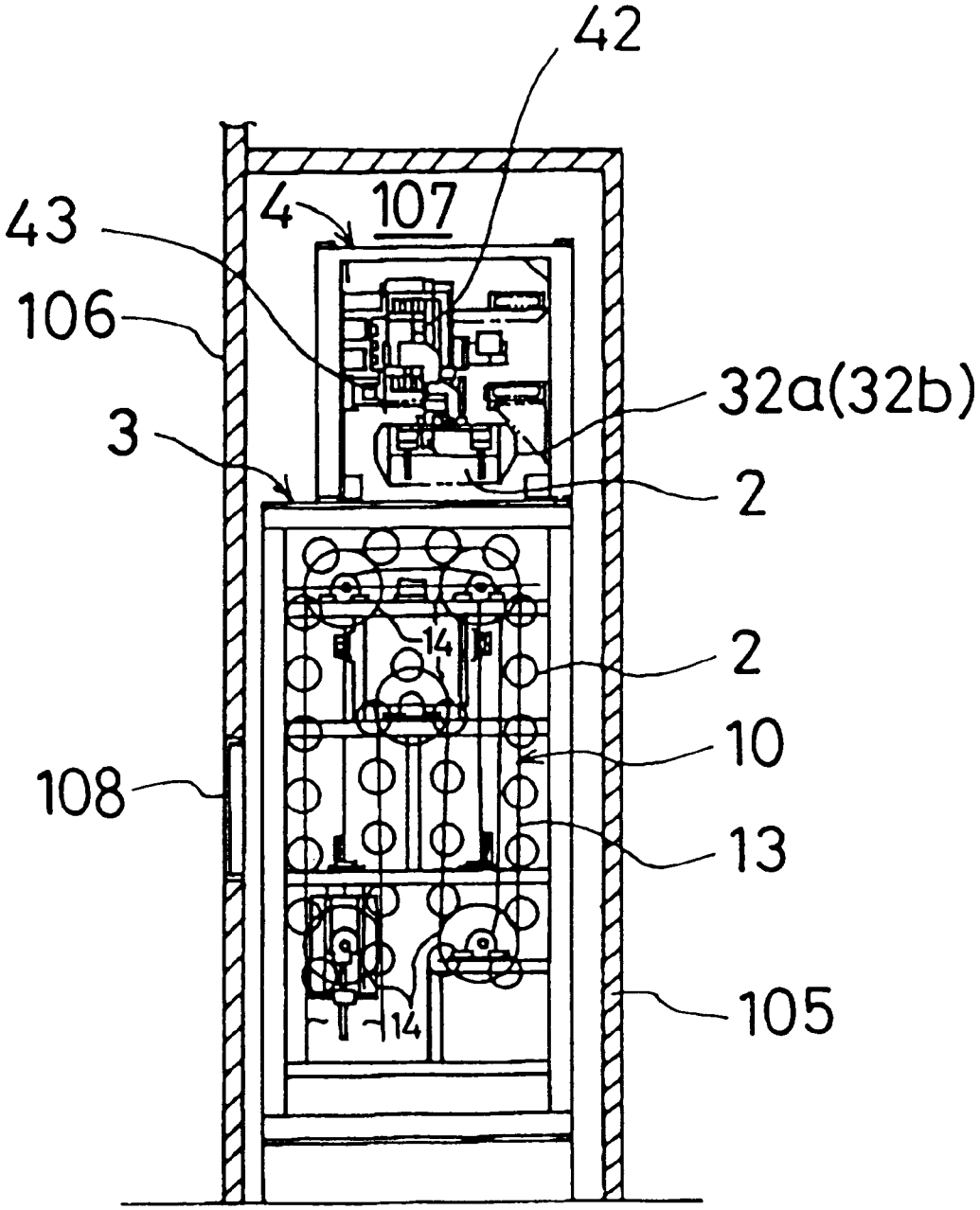
FIG. 45 is a view showing an interior of a partitioned chamber of the multi-color small amount painting system shown in FIG. 43 as viewed in a direction of Z of FIG. 44.

FIGS. 43 to 45 show a multi-color small amount painting system according to this embodiment. Incidentally, in these drawings, the same reference numerals and characters are used to designate the same members or components as those of the painting system according to the embodiment 1.

The multi-color small amount painting system according to this embodiment has the same structure as that of the multi-color small amount painting system according to the embodiment 4 except for the following two items.

The partition chamber 107 for surrounding the stock unit 3 is provided at a position to face the outside of the painting booth D in the painting booth D. Namely, the partition chamber 107 is composed of a booth inner wall 106, a ceiling wall 104 and the side walls 105, 105, . . . and the stock unit 3 is received therein. Then, a loading working door 108 for loading a new paint cartridge 2 and a pickup working door 109 for picking up the collected paint cartridge 2 are provided at positions corresponding to the loading position and the pickup position, respectively, in the booth inner wall 106 for partitioning the interior of the partition chamber 107 and the outside of the painting booth D.

Also, the chuck means 32*a* and 32*b* of the carrier 4 are deflected through 90° so that the posture of the paint cartridge 2 to be carried are deflected through 90°. Also, in accordance with this, the arrangement of the endless conveyor mechanism 10 and the collection mechanism 12 within the stock unit 3 is changed from the vertical to the horizontal.

Thus, also in the painting system according to this embodiment, a large number (about 30) of painting cartridges 2, 2, . . . are stored in the stock unit 3, the painting cartridge 2 of the selected paint color is taken out from the stock unit 3 and loaded on the painting robot 1 by the operation of the carrier 4 and the like and subsequently, the paint of the color is fed to the painter 6 of the painting robot 1 for the multi-color small amount painting of the workpiece.

In addition, also in the present embodiment, the operator may open the working doors 108 and 109 without entering the painting booth D, so that the used paint cartridge 2 is picked up and a new paint cartridge 2 is loaded for the work of maintenance and administration.

Embodiment 6

FIGS. 46 to 57 show a multi-color small amount painting system according to this embodiment. Incidentally, in these drawings, the same reference numerals and characters are used to designate the same members or components as those of the painting system according to the embodiment 1.

Figure 46:
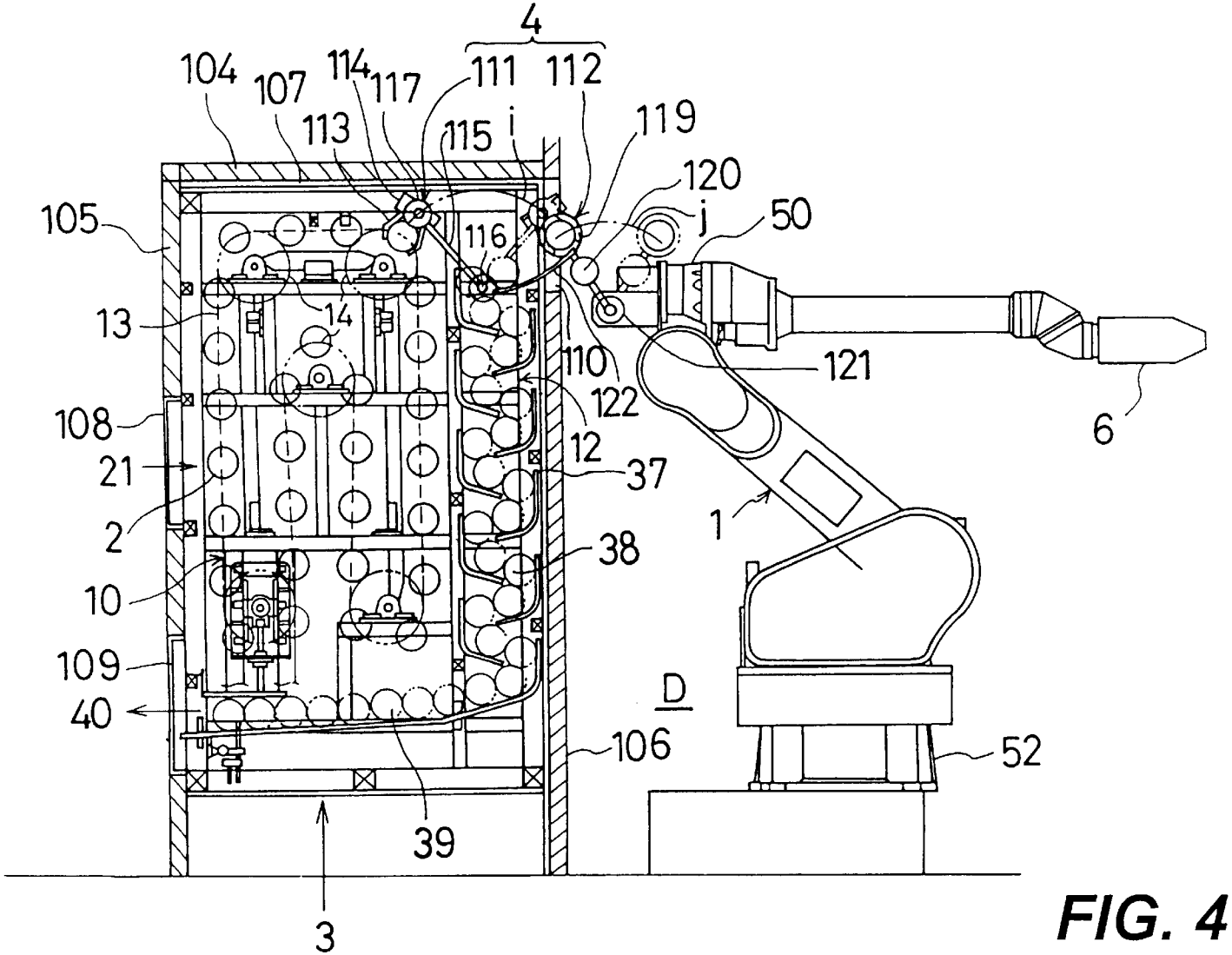
FIG. 46 is a frontal view showing a multi-color small amount painting system in accordance with a sixth embodiment.
Figure 47:
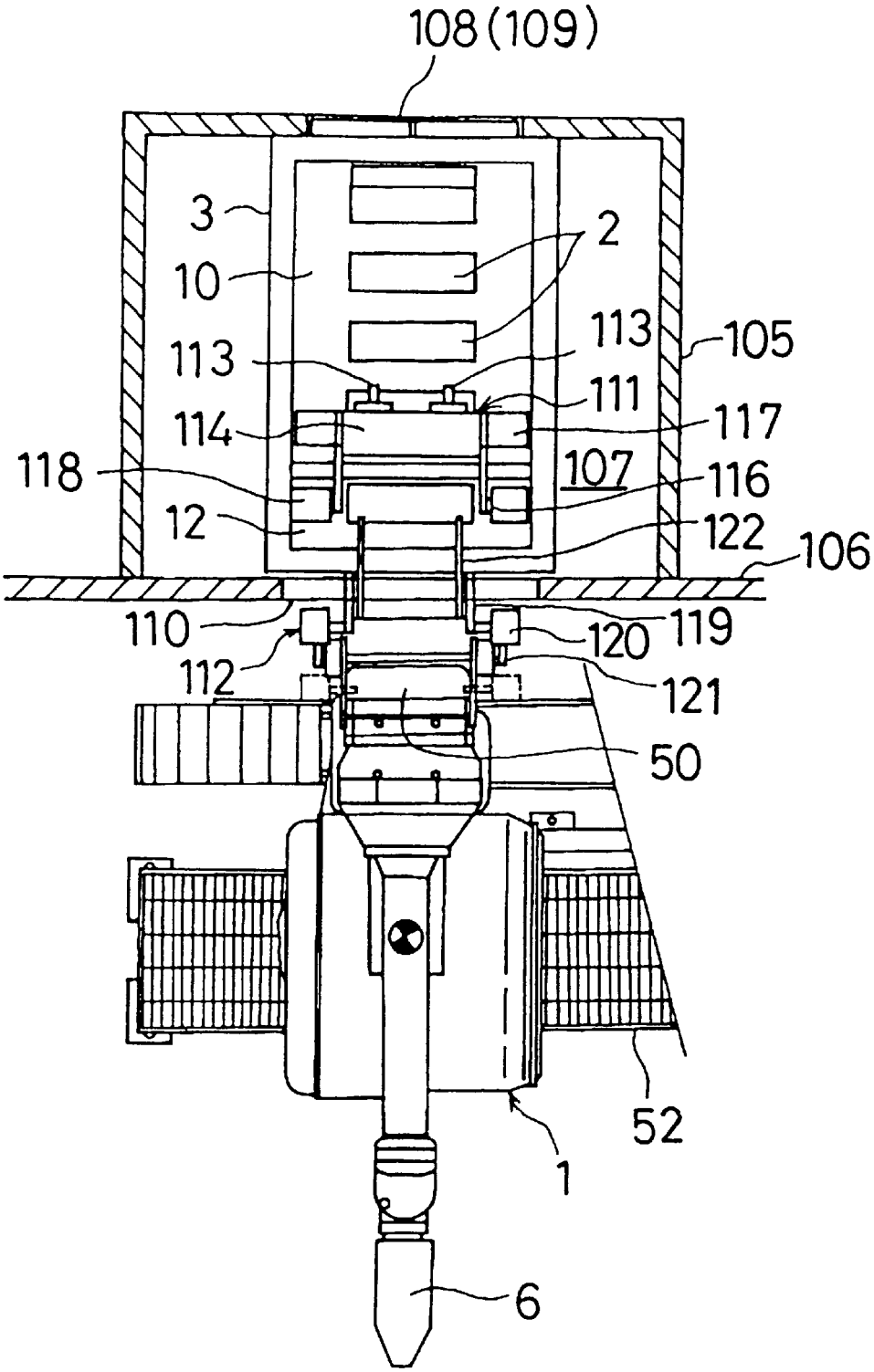
FIG. 47 is a view showing the multi-color small amount painting system shown in FIG. 46 as viewed from above (a driver for the stock unit being omitted)

The multi-color small amount painting system according to this embodiment has the same structure as that of the multi-color small amount painting system according to the embodiment 4 except for the different structure of the carrier 4 as shown in FIGS. 46 and 47.

Accordingly, also in the present painting system, the operator may open the working doors 108 and 109 without entering the painting booth D, so that the used paint cartridge 2 is picked up and a new paint cartridge 2 is loaded for the work of maintenance and administration.

Figure 48:
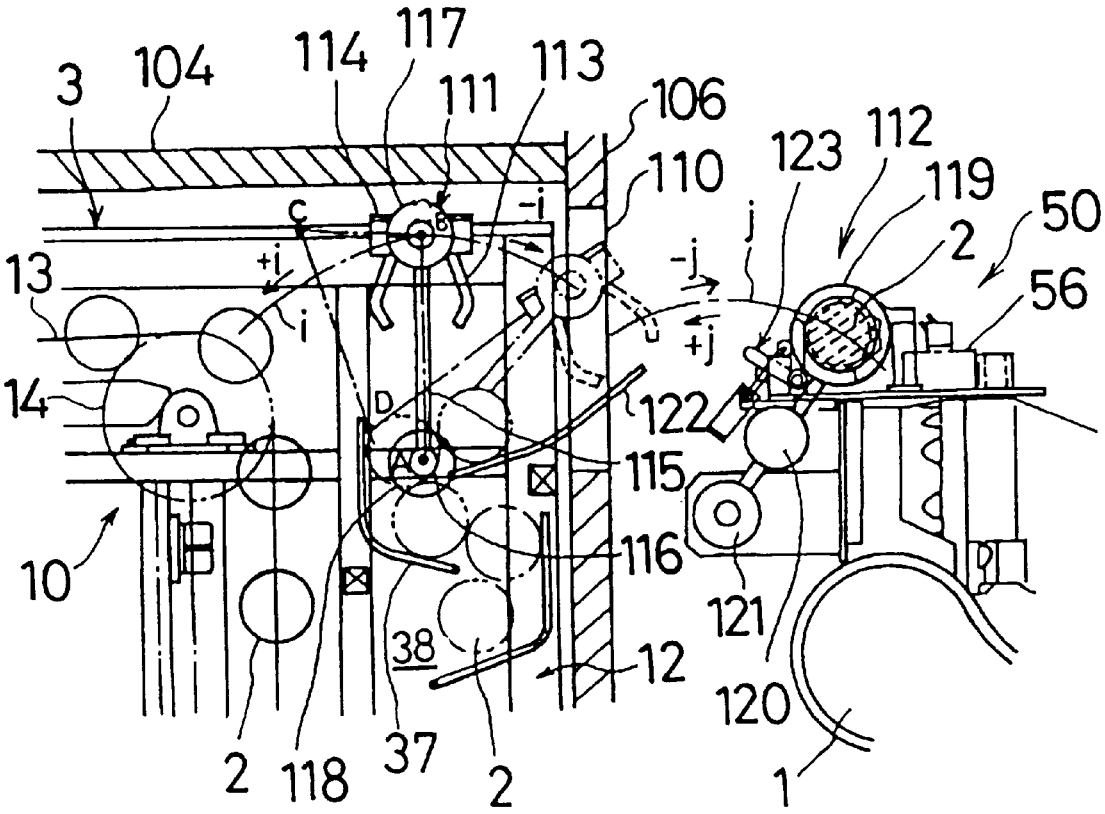
FIG. 48 is a frontal view showing a carrier of the multi-color small amount painting system shown in FIG. 46.
Figure 49:
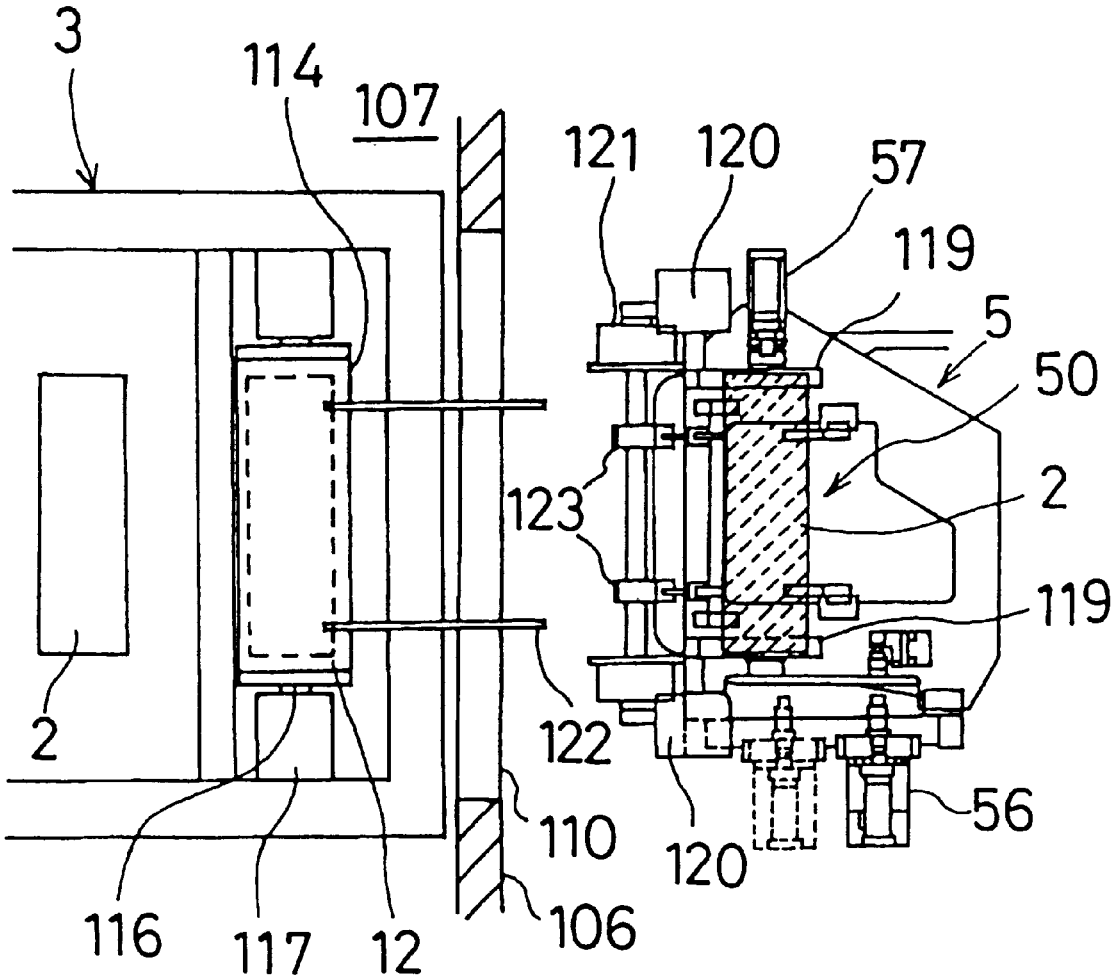
FIG. 49 is a view showing the carrier shown in FIG. 48 as viewed from above.

As shown in FIGS. 48 and 49, the carrier 4 according to this embodiment is composed of a grip means 111 provided within the stock unit 3 and a clamp means 112 assembled in the painting robot 1.

The grip means 111 connects a base plate 114, into which a pair of chucks 113 and 113 are assembled so as to be capable of opening/closing, to a drive shaft 116 through right and left links 115 and 115. The base plate 114 is supported rotatably about the shaft 116. The pair of chucks 113 and 113 are opened and closed by the operation of a cylinder unit 117 and also rotated along an arcuate line i together with the links 115 and 115 by the operation of a cylinder assembly 118. Furthermore, the grip means 111 is provided with a modified four point link mechanism shown by points A to D in FIG. 48 (detail thereof being not shown). Accordingly, as shown in these drawings, when the links 115 and 115 are rotated on the endless conveyor mechanism 10 side (in the direction of the arrow +i) by the operation of the cylinder assembly 118, the pair of chucks 113 and 113 are deflected toward the conveyor mechanism 10 from the vertically suspended posture so that the paint cartridge 2 held by the conveyor mechanism 10 may be gripped by the operation of the cylinder assembly 117. Inversely, when the links 115 and 115 are rotated on the painting robot 1 side (in the direction of the arrow −i), the pair of chucks 113 and 113 are deflected in the opposite direction from the vertically suspended posture so that the paint cartridge 2 gripped may be released by the operation of the cylinder assembly 117.

The clamp means 112 is provided with a pair of right and left clamp rings 119 and 119 for clamping the paint cartridge 2 from both right and left end sides. The clamp rings may be reciprocated in the longitudinal direction of the paint cartridge 2 by the operation of right and left cylinder assemblies 120 and 120. Furthermore, the cylinder assemblies 120 and 120 are coupled with a drive shaft 120 so that the clamp rings 119 and 119 may be rotatable along the arcuate line j by the rotation of the shaft 121. Accordingly, the clamp means 112 may clamp or release the paint cartridge 2 by the operation of the cylinder assemblies 120 and 120, and may reciprocatingly carry the clamped paint cartridge 2 over the loading area 50 of the painting robot 1 and the support rod 122 of the stock unit 3 (in the direction of the arrow ±j).

Figure 50:
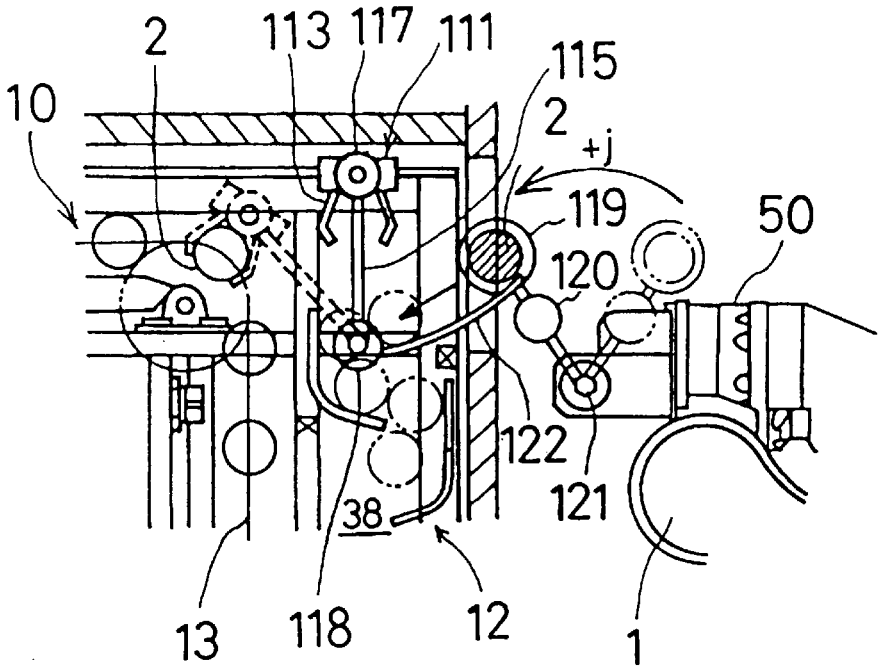
FIG. 50 is a view showing a process of carrying the paint cartridge (collection step) using the carrier shown in FIG. 48.
Figure 51:
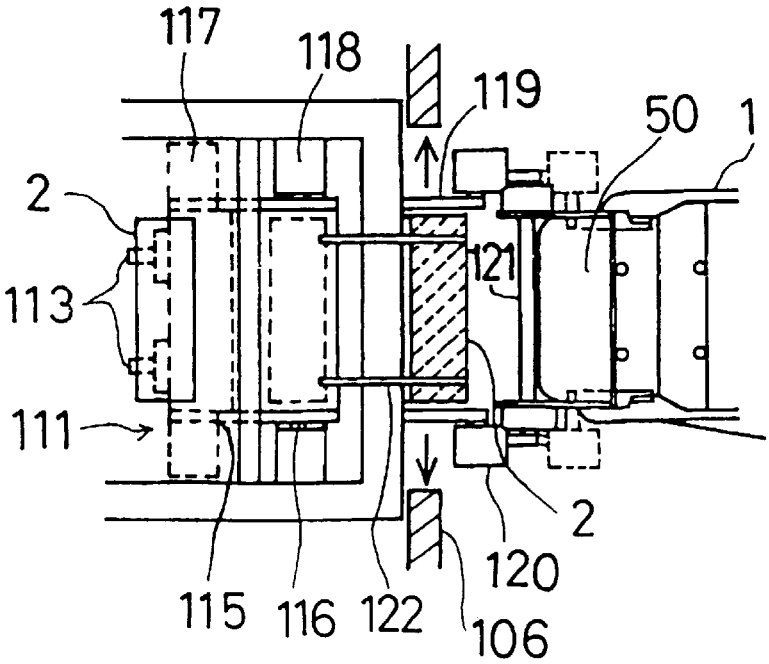
FIG. 51 is a top view of the carrier in the carrying process shown in FIG. 50.

Furthermore, the carrying process of the paint cartridge 2 by using the above-described means 111 and 112 will be described. First of all, as shown in FIG. 49, the paint cartridge 2 is loaded on the painting robot 1. The paint cartridge 2 is held and fixed to the loading area 50 by the retaining means 123 (which is composed of a rotatable arms and cylinder assemblies). Then, when the outlet portion 8 of the loaded paint cartridge 2 is connected to the paint connector 56 (which is continuous to the painter 6 through the paint flow path), the pressurized air is injected into the interior of the paint cartridge 2 by the extruder mechanism 57 so that the paint is extruded to the outside and fed into the painter 6. Thus, the automatic painting to the workpiece is possible. After the completion of the painting operation, the clamp means 112 moves the clamp rings 119 and 119 inwardly to clamp the used paint cartridge 2 from the right and left end sides (FIG. 49). Subsequently, as shown in FIG. 50, the clamp means 112 rotates the clamp rings 119 and 119 in the direction of the arrow +j while clamping the paint cartridge 2 and carries the paint cartridge 2 to a position above the support rod 122 of the stock unit 3. Subsequently, as shown in FIG. 51, the clamp means 112 moves the clamp rings 119 and 119 outwardly by the operation of the cylinder assemblies 120 and 120 to release the clamped paint cartridge 2. Then, the paint cartridge 2 is dropped on the support rod 122 of the collection mechanism 12 and slidingly dropped in a zigzag manner in the passage 38 to finally reach the pickup port 40. Thus, it is possible to open the above-described working door 109 to pick up the collected paint cartridge 2 at a suitable timing.

Figure 52:
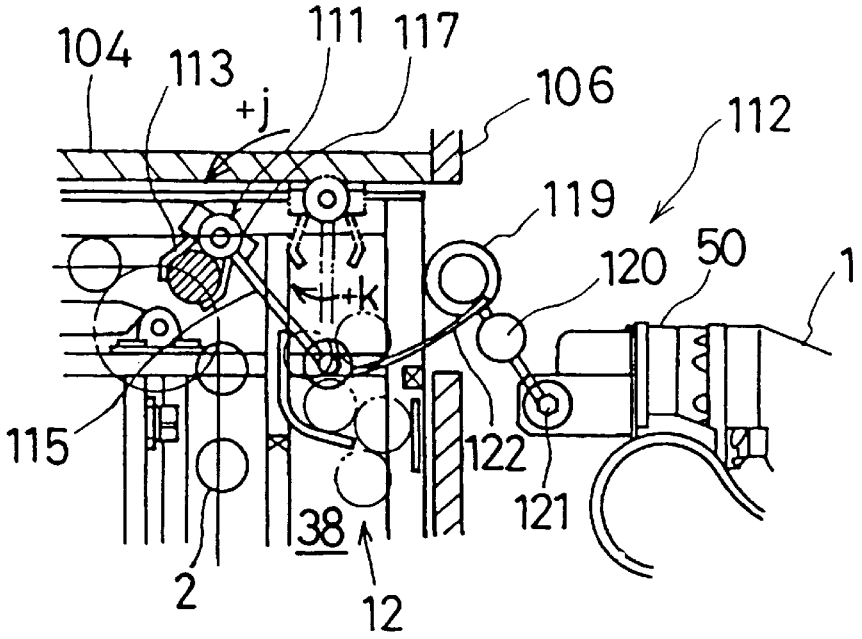
FIG. 52 is a view showing the carrying process (pickup step) of the paint cartridge using the carrier shown in FIG. 48.
Figure 53:
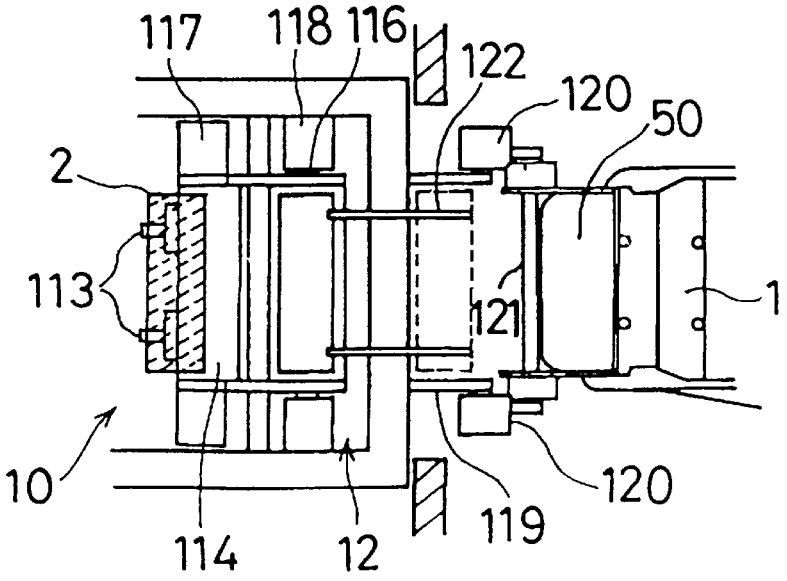
FIG. 53 is a top view showing the carrier in the carrying process shown in FIG. 52.

Also, as shown in FIG. 52, the grip means 111 operates simultaneously with the collection of the paint cartridge 2 or subsequently to the collection thereof, the rinks 115 and 115 are rotated in the direction of the arrow +i on the endless conveyor mechanism 10 side, simultaneously therewith the pair of chucks 113 and 113 are deflected in the direction of the arrow +k from the vertically suspended posture, then, the pair of chucks 113 and 113 are closed by the operation of the cylinder assembly 117, and grips the paint cartridge 2 held by the conveyor mechanism 10 (FIGS. 52 and 53), whereby the paint cartridge 2 is picked up from the stock unit 3. In this case, by using the suitable control mechanism, the grip means 111 may pick up the paint cartridge 2 of the paint color to be painted from the stock unit 3 out of the paint cartridges 2, 2, . . . stored in the stock unit 3 (selective pickup of the paint cartridge 2).

Figure 54:
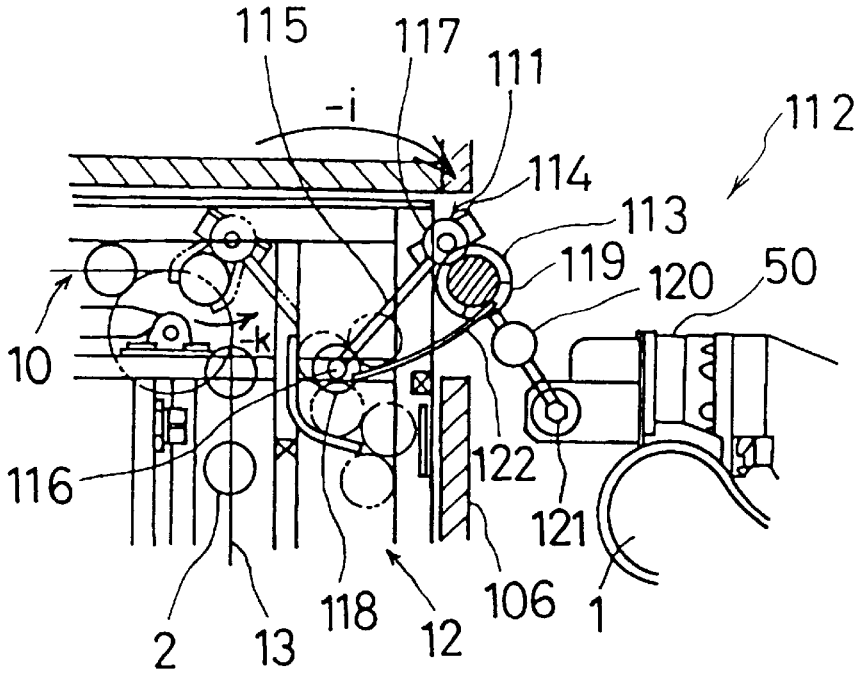
FIG. 54 is a view showing a carrying process (carrying step) of the paint cartridge using the carrier shown in FIG. 48.
Figure 55:
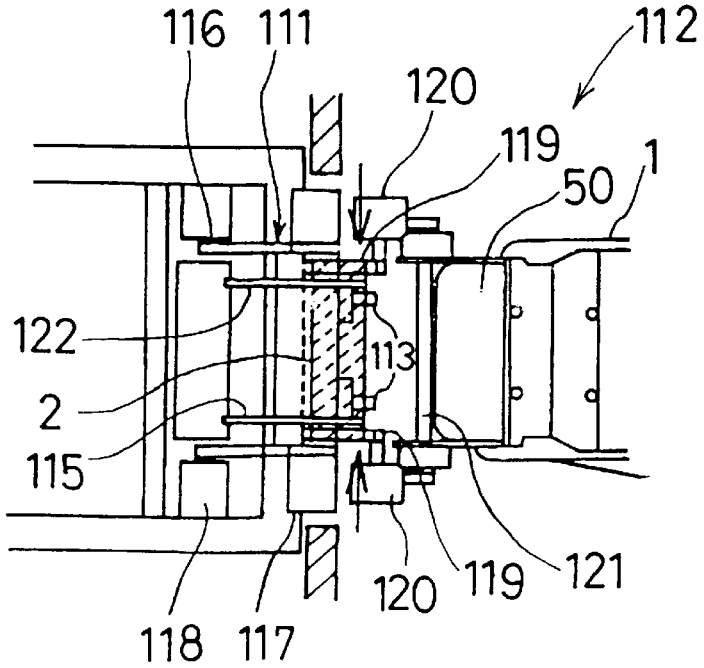
FIG. 55 is a top view showing the carrier in the carrying process shown in FIG. 54.

Thereafter, as shown in FIGS. 54 and 55, the links 115 and 115 are rotated in the direction of the arrow −i on the painting robot side 1, carries the gripped paint cartridge 2, in this case, the pair of chucks 113 and 113 are deflected in the direction of the arrow −k from the vertically suspended posture, and then, the paint cartridge 2 picked up from the stock unit 3 is carried to the position above the support rod 112.

Then, at this time, the clamp means 112 moves the clamp rings 119 and 119 inwardly and clamps the taken paint cartridge 2 from the right and left end sides (see FIGS. 55). After the completion of the clamp, the grip means 111 opens the pair of chucks 113 and 113 by the operation of the cylinder assembly 117 to release the paint cartridge 2. Thus, the paint cartridge 2 is replaced from the grip means 111 to the clamp means 112. Incidentally, thereafter, the clamp means 112 is returned back to the original position.

Figure 56:
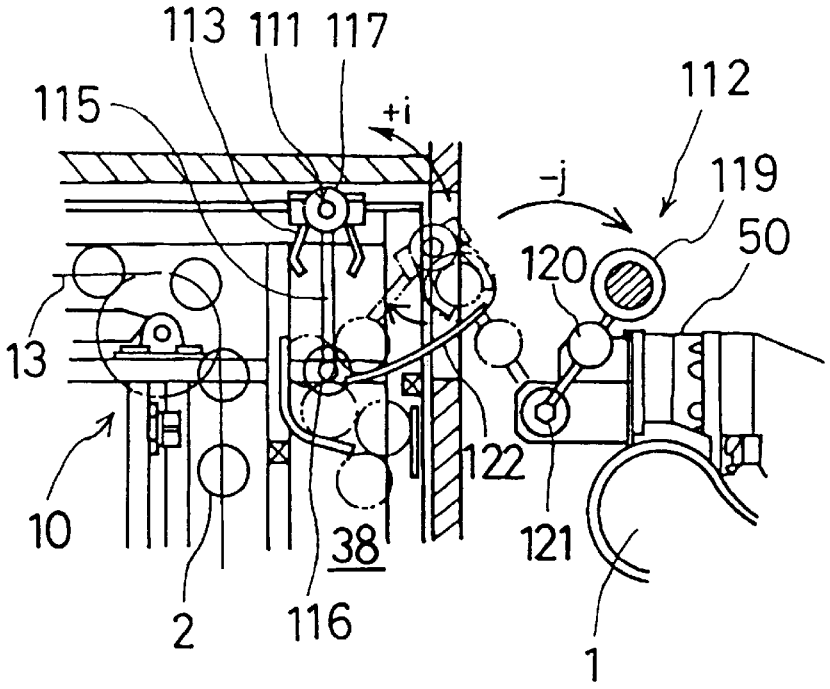
FIG. 56 is a view showing a carrying process (loading step) of the paint cartridge using the carrier shown in FIG. 48.
Figure 57:
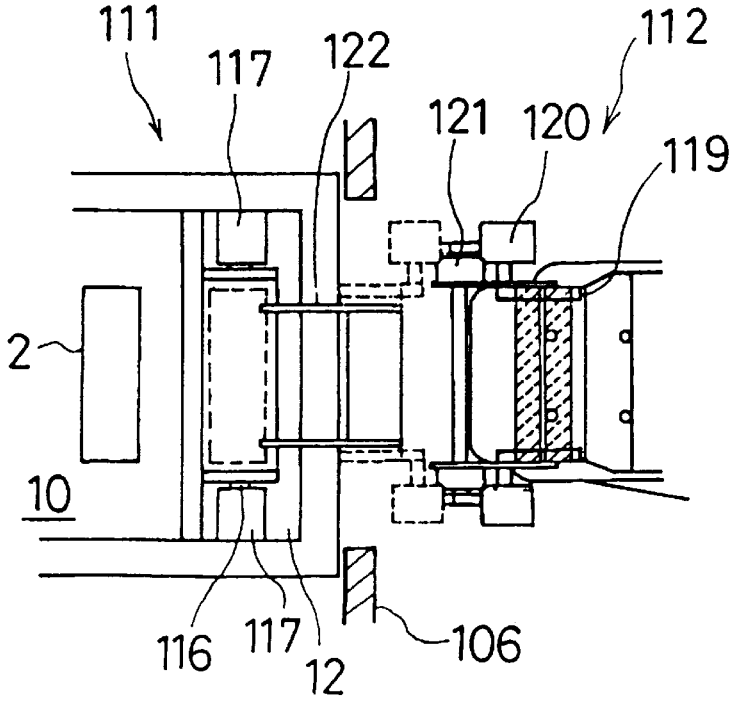
FIG. 57 is a top view showing the carrier in the carrying process shown in FIG. 56.
Figure 58:
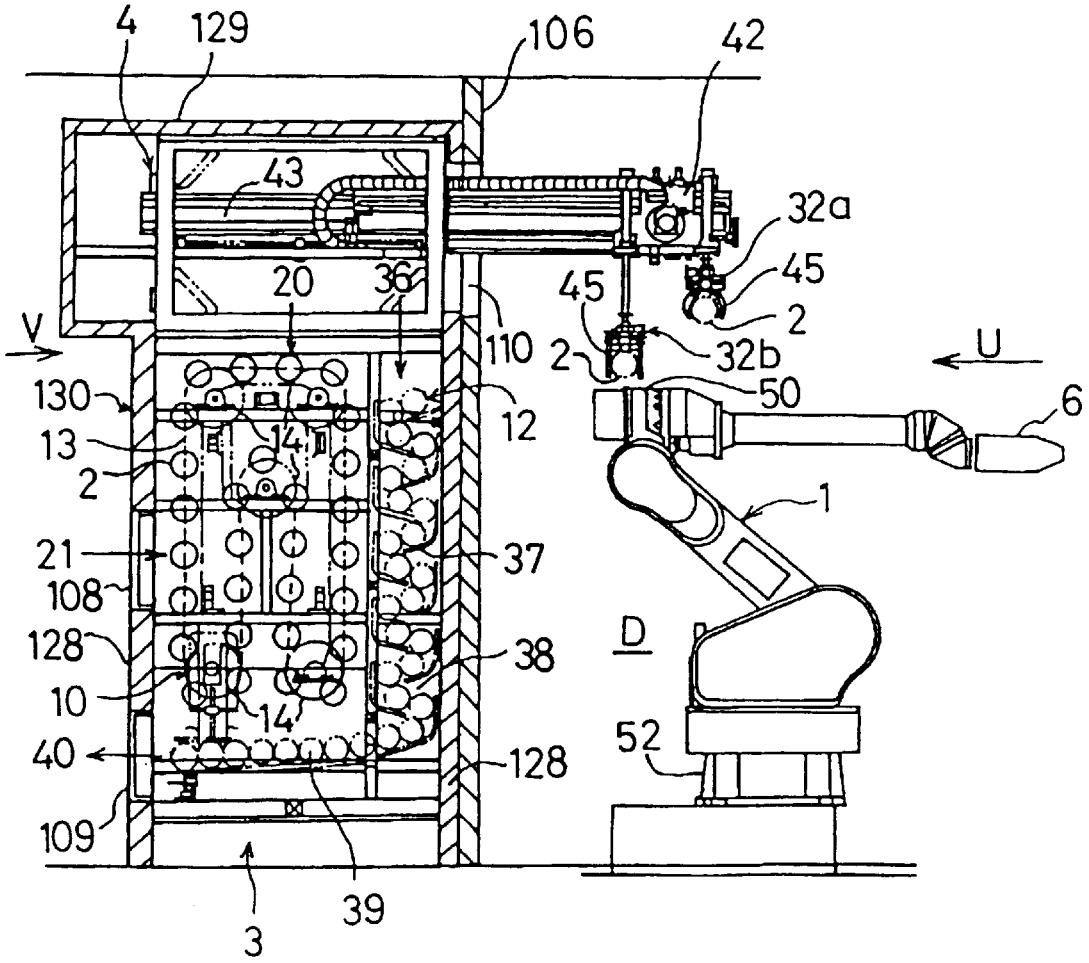
FIG. 58 is a frontal view showing a multi-color small amount painting system in accordance with a seventh embodiment.
Figure 59:
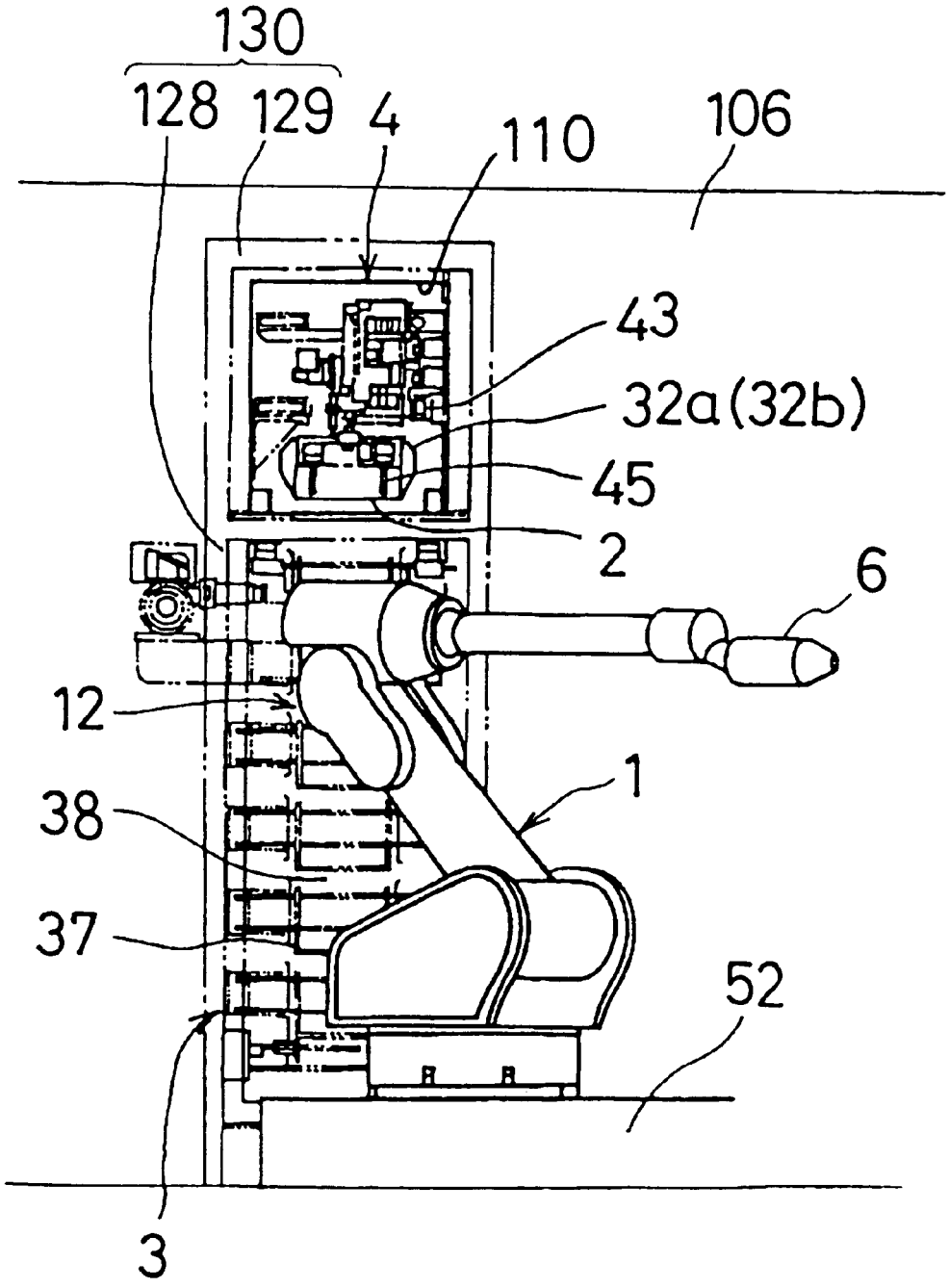
FIG. 59 is a view showing the multi-color small amount painting system shown in FIG. 58, as viewed in a direction of an arrow U of FIG. 58.
Figure 60:
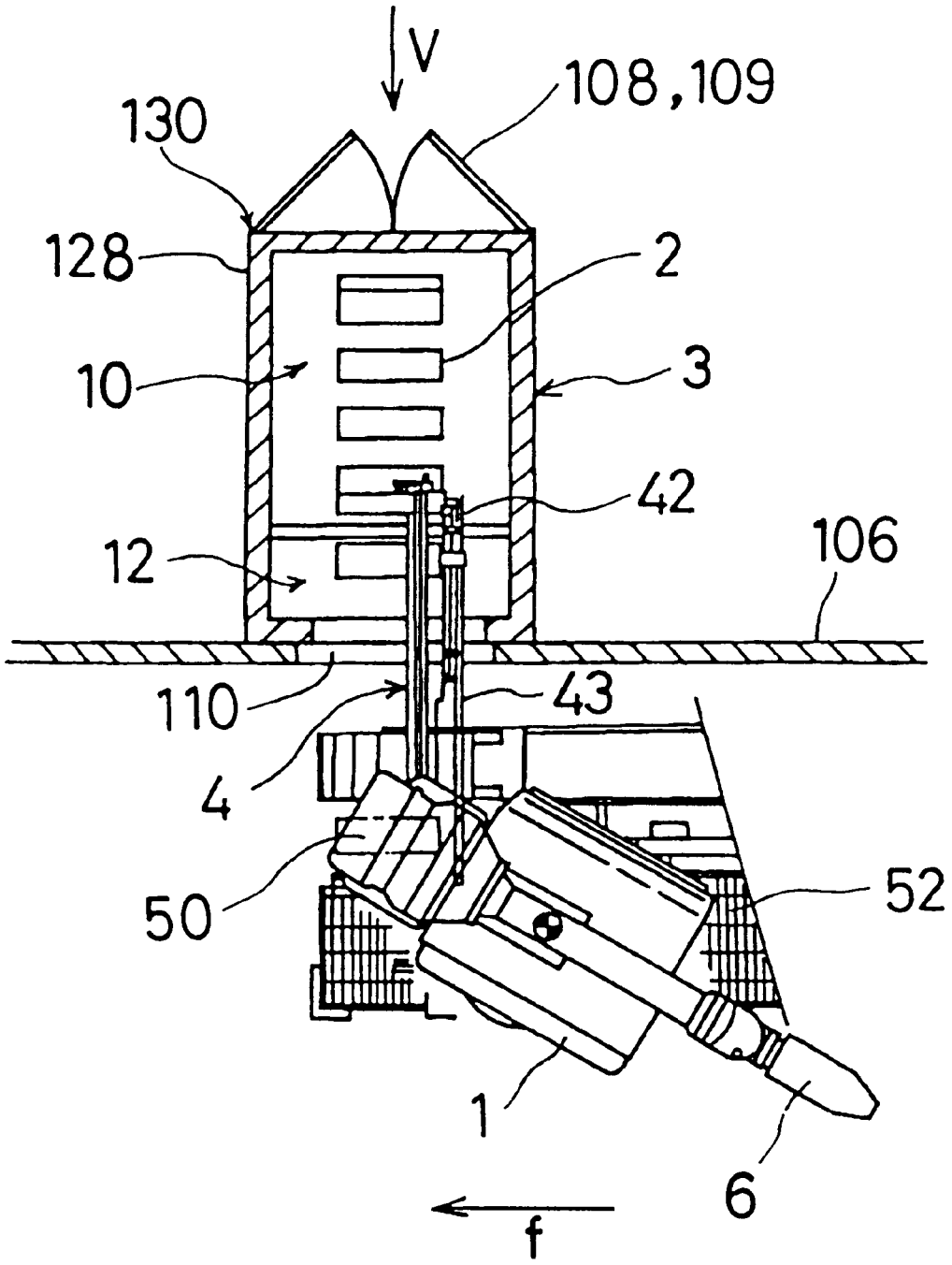
FIG. 60 is a view showing the multi-color small amount painting system shown in FIG. 58 as viewed from above (a driver for the stock unit being omitted)
Figure 61:
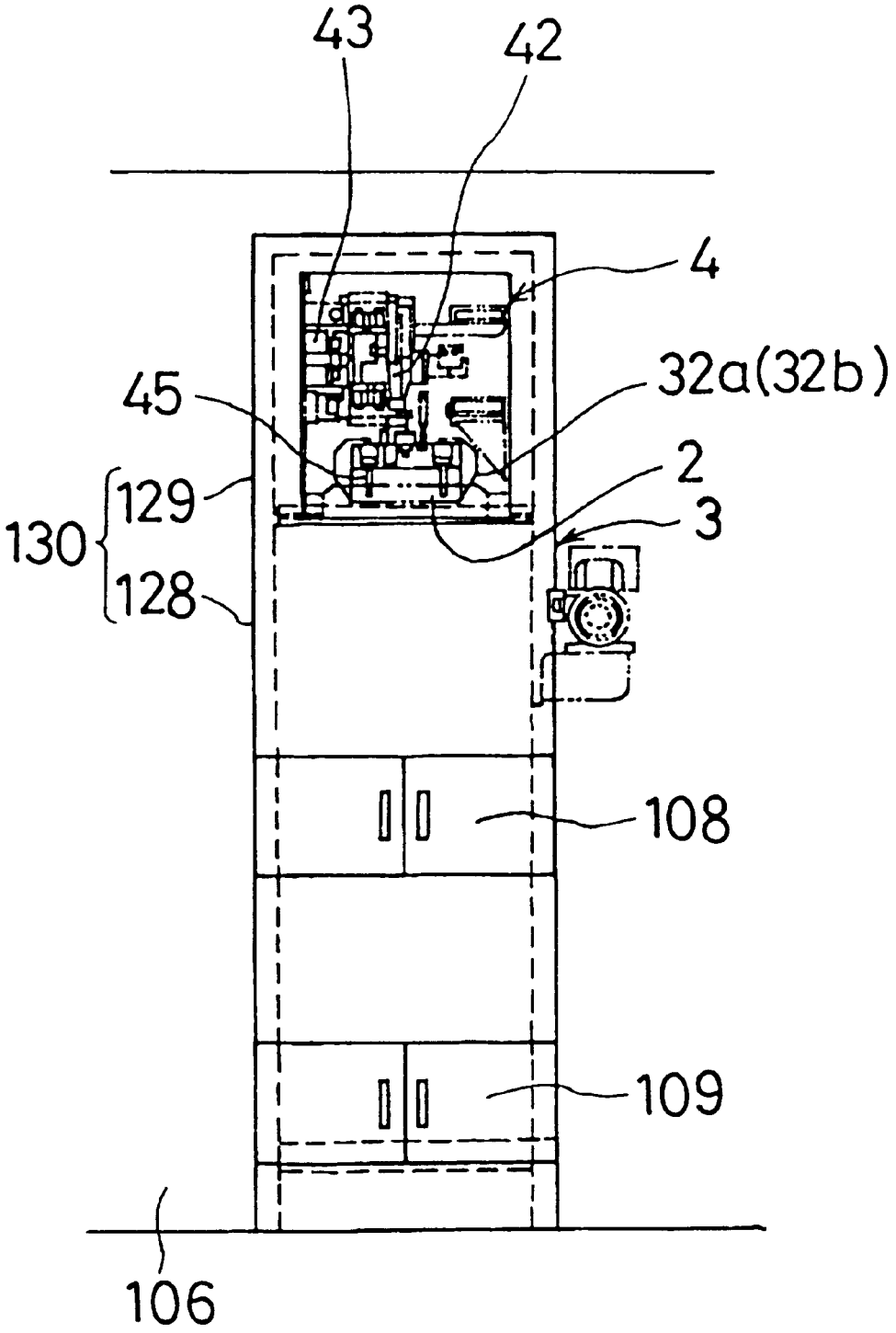
FIG. 61 is a view showing the multi-color small amount painting system shown in FIG. 58 as viewed in a direction of an arrow V of FIG. 58.

Thereafter, as shown in FIGS. 56 and 57, the clamp means 112 rotates the clamp rings 119 and 119 in the direction of the arrow −j while clamping the paint cartridge 2, carries the paint cartridge 2 to the loading area 50 of the painting robot 1, subsequently thereto, moves the clamp rings 119 and 119 outwardly and releases the clamped paint cartridge 2. Simultaneously therewith, the retaining means 123 of the area 50 is operated. Thus, the paint cartridge 2 is loaded on the painting robot 1 and may be used for the painting.

Accordingly, the painting system according to this embodiment may perform the automatic painting using the paint of the cartridge 2 of the desired color selected, by storing the paint cartridges 2, 2, . . . of a large number of paint colors in the stock unit 3, picking up the paint cartridge 2 of the selected paint color from the stock unit 3 and loading it on the painting robot 1 by the operation of the carrier 4.

Embodiment 7

FIGS. 58 to 61 show a multi-color small amount painting system according to this embodiment. Incidentally, in these drawings, the same reference numerals and characters are used to designate the same members or components as those of the painting system according to the embodiment 1.

The multi-color small amount painting system according to this embodiment has the same structure as that of the multi-color small amount painting system according to the embodiment 4 except for the provision of the partition wall 130 instead of the partition chamber 107 as described below.

The stock unit 3 is provided at a position to face the interior of the painting booth D outside of the painting booth D. Then, the closed wall structure is formed by the casing 128 of the stock unit 3 and the extension member 129 extending so as to cover the body of the carrier 4 from the upper end of the casing 128. The partition wall 130 for partitioning the interior of the stock unit 3 from the outside of the painting booth D is thus formed. Thus, the interior of the stock unit 3 is hermetically closed from the outside of the painting booth D.

Then, the loading working door 108 for loading a new paint cartridge 2 and a pickup working door 109 for picking up the collected paint cartridge 2 are provided at positions corresponding to the loading position and the pickup position, respectively, in the partition wall 130 (casing 128).

Accordingly, also in the painting system according to this embodiment, a large number (about 30) of painting cartridges 2, 2, . . . are stored in the stock unit 3, the painting cartridge 2 of the selected paint color is selectively taken and loaded on the painting robot 1 by the operation of the carrier 4 and the like and subsequently, by the paint feeding mechanism 5, the paint of the color is fed to the painter 6 of the painting robot 1 for the multi-color small amount automatic painting of the workpiece.

In addition, also in the present embodiment, the operator may open the working doors 108 and 109 without entering the painting booth D, so that the used paint cartridge 2 is picked up and a new paint cartridge 2 is loaded for the work of maintenance and administration.

The entire disclosure of Japanese Patent Applications Nos. He 9-158152, He 9-158153, and He 9-158154 filed on May 30, 1997, of Japanese Patent Application. No. He 9-168048 filed on Jun. 10, 1997, and of Japanese Patent Application Nos. He 9-173038 and He 9-173039 filed on Jun. 13, 1997, including specifications, claims, drawings and abstracts, are incorporated herein by reference in its entirety.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A multi-color small amount painting system which may store small unit amounts of a variety of colors of paint and may selectively feed a desired paint color of paint to a painter, comprising:

a suitable number of paint cartridges filled with small amounts of certain paint color, respectively;

a stock unit provided with an endless conveyor mechanism for holding the suitable number of paint cartridges for rotating and carrying the suitable number of paint cartridges of the desired paint color up to a pickup position;

one of a painting robot and an automatic painting device provided with a structure for mounting the paint cartridge;

a carrier for picking up the paint cartridge of the desired paint color from said stock unit and loading the paint cartridge of the desired paint color onto one of said painting robot and said automatic painting device; and a paint feeding mechanism which may be connected to the loaded paint cartridge and extruding the paint within the paint cartridge upon the connection to feed the paint to the painter of one of said painting robot and said automatic painting device.

2. The multi-color small amount painting system according to claim 1, wherein said stock unit comprises:

the endless conveyor mechanism disposed for rotating and carrying the paint cartridge through a loading position and a pickup position;

a suitable number of retaining means assembled into the endless conveyor mechanism for retaining each paint cartridge to be detachable, respectively; and a controller for operating a driver for the endless conveyor mechanism on the basis of detected information and inputs of the loaded paint cartridge for rotating and carrying the desired paint cartridge up to the pickup position by said carrier.

3. The multi-color small amount painting system according to claim 1, wherein said stock unit comprises a mechanism for collecting a cylindrical used paint cartridge, said collection mechanism has a suitable number of cartridge receiver members so as to face each other in the vertical direction alternatively on right and left sides in a obliquely downward posture, and forms a collection passage through which the paint cartridge is slidingly dropped in a zigzag manner between the cartridge receiver members from a collection port located on an upper side, and a shock absorber is provided in each of said cartridge receiver members at a position where the dropping paint cartridge collides.

4. The stock unit according to claim 3, wherein each of said right and left cartridge receiver members is composed of a substantially U-shaped bent receiver bar, central side portions of the receiver bars are arranged substantially in parallel, and said shock absorbers are made of cover members for covering the receiver bars and are provided at both end portions of the central side portion of each receiver bar and both side portions continuous with the both end portions.

5. The stock unit according to claim 3, wherein said shock absorbers are made of synthetic resin or rubber material having a Shore hardness of 50 to 60, preferably, polyvinylchloride resin.

6. The multi-color small amount painting system according to claim 1, wherein said carrier comprises:

a carrier body;

a carrier member supported to be reciprocatingly movable over the stock unit and one of the painting robot and the automatic painting device relative to said carrier body;

first and second chuck means mounted together on said carrier member for gripping and releasing the paint cartridges by the operations of approach to or separation from the paint cartridge and opening and closing operations of chuck members;

a driver for reciprocating said carrier member and operating said first and second chuck means; and a controller for controlling a series of operations of said first chuck means casting the used paint cartridge to a collection port of said stock unit and said second chuck means picking up the desired paint cartridge from the stock when said stock unit when said carrier member is located on the stock unit side, said first chuck means picking up the used paint cartridge loaded on one of said painting robot and said automatic painting device therefrom when said carrier member is located on the side of one of said painting robot and said automatic painting device, and subsequently, said second chuck means loading the desired paint cartridge on one of said painting robot and said automatic painting device.

7. The multi-color small amount painting system according to claim 1, wherein said paint feeding mechanism comprises:

a fixing means for fixing and holding the paint cartridge to the loading position within one of said painting robot and said automatic painting device;

a paint connector provided on a paint outlet side of the paint cartridge continuous to the painter through a predetermined paint flow path;

an extruder means for stably extruding the paint contained in the paint cartridge from the outlet portion thereof to the outside;

a cleaning connector provided in the vicinity of the loading position for feeding cleaning thinner and air; and a painting/cleaning joint means provided in cooperation with said paint connector for moving said paint connector to engage with and disengage from the outlet portion of the paint cartridge, making it possible to connect the paint cartridge to the painter, displacing said paint connector to engage with and disengage from said cleaning connector, and making it possible to feed the thinner and air from the interior of said paint connector to the paint flow path.

8. The multi-color small amount painting system according to claim 1, further comprising:

information recording medium added to each of the paint cartridges and/or the retaining means for representing painting information such as the paint color and the like needed for the automatic painting;

readout means additionally provided to the endless conveyor mechanism of said stock unit for reading out optically, magnetically or through a wireless communication the painting information from said information recording medium for each loaded paint cartridge; and a controller for controlling the respective operations of said stock unit, said carrier and one of said painting robot and said automatic painting device on the basis of the read painting information and performing the automatic painting selectively using the paint cartridge of the paint color to be painted to an individual workpiece.

9. The multi-color small amount painting system according to claim 8, wherein the painting information comprises a kind of colors of the paint filled in the paint cartridge, a data when the paint cartridge is loaded in said stock unit, a kind of the workpiece to be painted, painting data for determining a range, a condition and an order of the painting workpiece, and any combination thereof.

10. The multi-color small amount painting system according to claim 1, wherein one of said painting robot and said automatic painting device is disposed in a paint spray booth, a partition chamber for receiving and surrounding said stock unit is formed so as to face the outside or the interior of the paint spray booth in or outside of the paint spray booth, and working doors for loading a new paint cartridge from the outside of the paint spray booth and picking up the collected paint cartridge are provided on the wall for partitioning the interior of the partition chamber and outside of the paint spray booth.

11. The multi-color small amount painting system according to claim 1, wherein one of said painting robot and said automatic painting device is disposed in a paint spray booth, said stock unit is formed so as to face the outside or the interior of the paint spray booth in or outside of the paint spray booth, a partition wall for partitioning the outside or inside of the paint spray booth and the interior of said stock unit is formed from a casing of said stock unit or including the casing, and working doors for loading a new paint cartridge from the outside of the paint spray booth and picking up the collected paint cartridge are provided on the wall for partitioning the interior of said stock unit and outside of the paint spray booth.

12. A stock unit for storing a number of paint cartridges having a number of paint colors, rotating and carrying a selected paint cartridge out of the number of paint cartridges up to a pickup position for the pickup by a carrier, an endless conveyor mechanism disposed for rotating and carrying the paint cartridge through a loading position and a pickup position;

retaining means assembled into the endless conveyor mechanism for retaining each paint cartridge to be detachable, respectively; and a controller for operating a driver for the endless conveyor mechanism on the basis of detected information and inputs of the loaded paint cartridge for rotating and carrying the selected paint cartridge up to the pickup position by said carrier.

13. The stock unit according to claim 12, wherein said retaining means comprises:

a receiver frame for receiving the paint cartridge;

a pair of right and left retainer arms supported to be rotatable about each bent portion on the outside of said receiver frame; and a spring means for biasing the right and left retainer arms inwardly so as to grip the paint cartridge;

wherein when each arm portion of the right and left retainer arms is pressed and widened outwardly, the other arm portions push upwardly the paint cartridge loaded in said receiver frame so that the paint cartridge may be picked up by said carrier.

14. A carrier for picking up a paint cartridge from a stock unit thereof and loading the paint cartridge on one of a painting robot and an automatic painting device, and picking up a used paint cartridge from one of the painting robot and the automatic painting device and collecting the same to the stock unit, comprising:

a carrier body;

a carrier member supported to be reciprocatingly movable over the stock unit and one of the painting robot and the automatic painting device relative to the carrier body;

first and second chuck means mounted together on said carrier member for gripping and releasing the paint cartridges by the operations of approach to or separation from the paint cartridge and opening and closing operations of chuck members;

a driver for reciprocating said carrier member and operating said first and second chuck means; and a controller for controlling a series of operations of said first chuck means casting the used paint cartridge to a collection port of said stock unit and said second chuck means picking up the desired paint cartridge from said stock unit when said carrier member is located on the stock unit side, said first chuck means picking up the used paint cartridge loaded on one of said painting robot and said automatic painting device therefrom when said carrier member is located on the side of one of said painting robot and said automatic painting device, and subsequently, said second chuck means loading the desired paint cartridge on one of said painting robot and said automatic painting device.

15. A paint feeding mechanism for feeding paint contained in a paint cartridge loaded on one of a painting robot and an automatic painting device to a painter, comprising:

a fixing means for fixing and holding the paint cartridge to the loading position within one of said painting robot and said automatic painting device;

a paint connector provided on a paint outlet side of the paint cartridge continuous to the painter through a predetermined paint flow path;

an extruder means for stably extruding the paint contained in the paint cartridge from the outlet portion thereof to the outside;

a cleansing connector provided in the vicinity of the loading position for feeding cleaning thinner and air; and a painting/cleaning joint means provided in cooperation with said paint connector for moving said paint connector to engage with and disengage from the outlet portion of the paint cartridge, making it possible to connect the paint cartridge to the painter, displacing said paint connector to engage with and disengage from said cleaning connector, and making it possible to feed the thinner and air from the interior of said paint connector to the paint flow path.

16. The stock unit according to claim 4, wherein said shock absorbers are made of synthetic resin or rubber material having a Shore hardness of 50 to 60, preferably, polyvinylchloride resin.

* * * * *